US007361438B2

(12) United States Patent
Suzuki et al.

(10) Patent No.: US 7,361,438 B2
(45) **Date of Patent: *Apr. 22, 2008**

(54) ELECTROPHOTOGRAPHIC PHOTOCONDUCTOR, AND IMAGE FORMING PROCESS, IMAGE FORMING APPARATUS AND PROCESS CARTRIDGE FOR AN IMAGE FORMING APPARATUS USING THE SAME

(75) Inventors: Tetsuro Suzuki, Shizuoka (JP); Hiroshi Tamura, Shizuoka (JP); Hiroshi Ikuno, Kanagawa (JP); Kazukiyo Nagai, Shizuoka (JP); Hongguo Li, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/616,180

(22) Filed: Dec. 26, 2006

(65) Prior Publication Data

US 2007/0122724 A1 May 31, 2007

Related U.S. Application Data

(62) Division of application No. 10/804,043, filed on Mar. 19, 2004, now Pat. No. 7,175,957.

(30) Foreign Application Priority Data

Mar. 20, 2003 (JP) ..... 2003-077316
Mar. 20, 2003 (JP) ..... 2003-077333

(51) Int. Cl.
*G03G 5/047* (2006.01)

(52) U.S. Cl. ..... 430/58.7; 430/66; 430/131; 399/159

(58) Field of Classification Search ..... 430/58.7, 430/66, 131, 126; 399/159
See application file for complete search history.

(56) References Cited

U.S. PATENT DOCUMENTS 5,374,494 A 12/1994 Kashimura et al.
6,180,303 B1 1/2001 Uematsu et al.
6,326,112 B1 12/2001 Tamura et al.
6,372,397 B1 4/2002 Maruyama et al.
6,416,915 B1 7/2002 Kikuchi et al.
6,432,596 B2 8/2002 Ikuno et al.
6,444,387 B2 9/2002 Ri et al.
6,489,073 B2 12/2002 Kotsugai et al.
6,492,079 B2 12/2002 Shimada et al.
6,548,216 B2 4/2003 Kawamura et al.
6,576,386 B1 6/2003 Ri et al.
6,596,449 B2 7/2003 Shimada et al.
6,625,409 B2 9/2003 Shakuto et al.
6,641,964 B2 11/2003 Ikuno et al.
6,654,579 B2 11/2003 Shakuto et al.
6,664,361 B2 12/2003 Sasaki et al.
6,686,114 B2 2/2004 Sakon et al.
7,175,957 B2 * 2/2007 Suzuki et al. ..... 430/66
7,179,573 B2 2/2007 Suzuki et al.
2005/0175911 A1 8/2005 Tamoto et al.
2005/0221210 A1 10/2005 Suzuki et al.

OTHER PUBLICATIONS

U.S. Appl. No. 11/621,257, filed Jan. 9, 2007, Suzuki et al.
U.S. Appl. No. 10/543,927, filed Jun. 2, 2006, Tamoto et al.

* cited by examiner

*Primary Examiner*—John I Goodrow
(74) *Attorney, Agent, or Firm*—Oblon, Spivak, McClelland, Maier & Neustadt, P.C.

(57) ABSTRACT

Disclosed is an electrophotographic photoconductor including at least a photoconductive layer on a conductive substrate, wherein the surface layer of the photoconductive layer contains at least a surface crosslinked layer formed by curing a tri- or more-functional radical polymerizable monomer without having a charge transporting structure and a mono-functional radical polymerizable compound having a charge transporting structure and the surface crosslinked layer has a surface roughness Rz of 1.3 μm or less.

35 Claims, 6 Drawing Sheets

ELECTROPHOTOGRAPHIC PHOTOCONDUCTOR, AND IMAGE FORMING PROCESS, IMAGE FORMING APPARATUS AND PROCESS CARTRIDGE FOR AN IMAGE FORMING APPARATUS USING THE SAME

BACKGROUND OF THE INVENTION

1. Field of the Invention

The present invention relates to an electrophotographic photoconductor with high durability which is capable of realizing high quality of images for a long period of time. Also, it relates to an image forming process, an image forming apparatus and a process cartridge for an image forming apparatus using the long life and high performance photoconductor.

2. Description of the Related Art

Recently, the organic photoconductor (OPC) is widely used in a copying machine, facsimile, laser printer and a composite thereof owing to excellent performance and various advantages, instead of the inorganic photoconductor. The reason includes, for example, (1) optical properties such as range of light absorbing wave length and absorption amount, (2) electrical properties such as high sensitivity, stable charging properties, (3) width of selection range of materials, (4) easiness of preparation, (5) low cost, (6) non-toxicity and the like.

Meanwhile, as the image forming apparatus gets smaller, a photoconductor with smaller diameter is also sought. Further, tendency of high speed and maintenance free is added and thus there is great demand for high durability of the photoconductor. In this point of view, the organic photoconductor has a defect in that when it is repeatedly used in the electrophotographic process, it is susceptible to abrasion by mechanical load of a developing system or a cleaning system since the surface layer comprises mainly a low molecular charge transport material and an inactive high molecule (polymer) which are generally soft. Also, due to the demand for high image quality along with small diameter of toner particles, increase in rubber hardness and increase in contact pressure of a cleaning blade to enhance cleaning property are forcedly required, which is another factor to promote the abrasion of the photoconductor. Such abrasion of the photoconductor leads deterioration of electrical properties such as sensitivity and chargeability and thereby, deteriorated image with reduction of image density and contamination of the ground surface. Also, a damaged part with local abrasion produces a contaminated image with a striped pattern by cleaning failure. At this moment, the life span of the photoconductor is determined by the abrasion and damage.

Therefore, it is necessary to reduce the above-described abrasion in order to increase durability of the organic photoconductor and this is the most urged matter to be solved in the art.

The techniques to improve abrasion resistance of the photoconductive layer include (1) using a curable binder in the surface layer (for example, JP-A No. 56-48637), (2) using a high molecular charge transport material (for example, JP-A No. 64-1728), (3) dispersing an inorganic filler in the surface layer (for example, JP-A No. 4-281461) and the like. Among these techniques, the use of a curable binder in (1) tends to cause reduction in image density since the curable binder has poor compatibility with the charge transporting material and impurities such as a polymerization initiator and unreacted residue increases residual potential. Also, the use of a high molecular charge transport material in (2) may somewhat improve the abrasion resistance. However, it is not sufficient for satisfying the durability required in the organic photoconductor. Further, it is difficult to polymerize and purify the high molecular (polymer) charge transporting material. Thus, it is impossible to obtain it at a high purity and to attain stable electrical properties between materials upon using it. In addition, it may cause problems such as high viscosity of the coating solution in terms of the preparation. The dispersion of the inorganic filler in (3) shows high abrasion resistance, as compared to that of the conventional photoconductor comprising a low molecular charge transporting material dispersed in inactive high molecules (polymer). However, traps on the surface of the inorganic filler tends to increase the residual potential, thereby causing reduction in the image density. Also, when unevenness of the inorganic filler and the binder resin on the surface of the photoconductor is severe, cleaning failure may occur, resulting in toner peeling and image deletion. With these techniques of (1), (2) and (3), it is impossible to satisfy the durability required for the organic photoconductor, including electrical durability and mechanical durability.

Also, in order to improve electrical properties of (1), JP-A No. 2002-6526 discloses a technique of a protective layer containing an electroconductive filler. The photoconductor used in this technique may inhibit increase of residual potential by repeated use. However, it has defects in that since resistance of the protective layer decreases in a high humidity circumstance, reduction of resolution and image deletion may occur.

Furthermore, in order to improve the abrasion resistance of (1) and scratch resistance, a photoconductor containing a cured body of a multi-functional acrylate monomer is disclosed (Japanese Patent No. 3262488). In this patent, the purpose of inclusion of a cured body of this multi-functional acrylate monomer in a protective layer on the photoconductive layer is described. However, whether a charge transporting material may be contained in the protective layer is only described without concrete description. Further, when a low molecular charge transport material is simply added to the surface layer, it may cause problems related with the compatibility to the cured body, whereby crystallization of the low molecular charge transporting material and clouding may occur, resulting in reduction in mechanical properties.

In addition, according to this photoconductor, since the monomer is reacted while it contains a high molecular binder, the curing cannot be sufficiently progressed. Also, the cured body is poorly compatible with the binder resin and surface unevenness by phase separation upon curing may occur, causing cleaning failure.

As technique for inhibiting abrasion of the photoconductive layer to substitute the above techniques, a process for forming a charge transporting layer using a coating solution comprising a monomer having carbon-carbon double bond, a charge transport material having a carbon-carbon double bond and a binder resin (for example, Japanese Patent No. 3194392). The binder resin includes a binder reactive with the charge transport material having a carbon-carbon double bond and a binder non-reactive with the charge transport material without having the double bond. This photoconductor has attracted public attention since it shows abrasion resistance along with excellent electrical properties. However, when a non-reactive resin is used as the binder resin, the binder resin is poorly compatible with the cured body produced by the reaction of the monomer and the charge transport material, whereby surface unevenness during cross-linking forms from the phase separation, resulting in cleaning failure. Also, as described above, in addition to the interference of the binder resin with the curing of the monomer, a bi-functional monomer which can be used in the photoconductor has a few functionality and fails to provide a sufficient cross-linkage density, whereby it is possible to obtain a sufficient abrasion resistance. Also, when a reactive binder is used, since the number of functional groups contained in the monomer and the binder resin is small, the bonding of the charge transporting material and the cross-linkage density cannot be satisfied at the same time and the electrical properties and abrasion resistance are not sufficient.

Also, a photoconductive layer containing a hole transporting compound curing a compound having two or more chain polymerizable functional group in a molecule (for example, JP-A No. 2000-66425).

However, according to the photoconductive layer, since a big hole transporting compound has two or more chain polymerizable functional group, distortion may occur in a cured body, causing increase in internal stress, roughness of the surface layer and formation of crack over the time.

Even in a photoconductor having a cross-linked photoconductive layer with a charge transporting structure chemically attached, it cannot be said that general properties are sufficiently attained.

SUMMARY OF THE INVENTION

It is an object of the present invention to provide a electrophotographic photoconductor comprising a photoconductive layer with high abrasion resistance and excellent properties, particularly having high elasticity and uniform cross-linked surface layer, which can prevent local attachment of an external additive or paper fragments on the photoconductive layer to inhibit image deterioration, prevent plastic deformation of the photoconductor upon image forming and improve durability to realize high quality of image for a long period of time.

Also, it is another object of the present invention to provide an image forming process, image forming apparatus and process cartridge for an image forming apparatus using the long-life high performance photoconductor.

The present inventors have conducted much research and as a result, discovered that the above object can be accomplished by a photoconductive layer having a surface layer comprising a cross-linked layer formed by curing at least a tri- or more-functional radical polymerizable monomer without having a charge transporting structure and a mono-functional radical polymerizable compound having a charge transporting structure, wherein the cross-linked surface layer has an elasticity displacement rate $\tau e$ of 35% or more and the standard deviation of the elasticity displacement rate $\tau e$ of 2% or less. Based on this discovery, the present invention has been completed.

Thus, in a first aspect according to the present invention, there is provided an electrophotographic photoconductor containing at least a photoconductive layer on an electroconductive substrate, wherein a surface layer of the photoconductive layer contains a cross-linked surface layer formed by curing at least a tri- or more-functional radical polymerizable monomer without having a charge transporting structure and a mono-functional radical polymerizable compound having a charge transporting structure and the cross-linked surface layer has an elastic displacement rate $\tau e$ of 35% or more and a standard deviation of the elastic displacement rate $\tau e$ of 2% or less.

In a second aspect according to the present invention, there is provided the electrophotographic photoconductor according to first aspect, wherein the tri- or more-functional radical polymerizable monomer without having a charge transporting structure contained in a coating solution of the cross-linked surface layer has a functional group of acryloyloxy group and/or methacryloyloxy group.

In a third aspect according to the present invention, there is provided the electrophotographic photoconductor according to first aspect, wherein the tri- or more-functional radical polymerizable monomer without having a charge transporting structure used in the cross-linked surface layer has a ratio of molecular weight to the number of functional group (molecular weight/number of functional group) of 250 or less.

In a fourth aspect according to the present invention, there is provided the electrophotographic photoconductor according to first aspect, wherein the mono-functional radical polymerizable compound having a charge transporting structure used in the cross-linked surface layer a functional group of acryloyloxy group or methacryloyloxy group.

In a fifth aspect according to the present invention, there is provided the electrophotographic photoconductor according to first aspect, wherein the mono-functional radical polymerizable compound having a charge transporting structure used in the cross-linked surface layer has a charge transporting structure of a triarylamine structure.

In a sixth aspect according to the present invention, there is provided the electrophotographic photoconductor according to first aspect, wherein the mono-functional radical polymerizable compound having a charge transporting structure used in the cross-linked surface layer contains at least one of the formula (1) or (2).

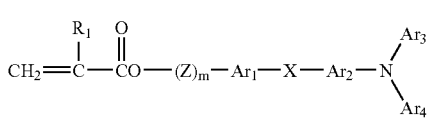

(1)

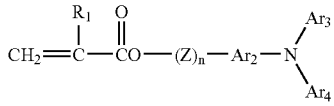

(2)

wherein, $R_1$ represents a hydrogen atom, a halogen atom, an alkyl group which may be substituted, an aralkyl group which may be substituted, an aryl group which may be substituted, a cyano group, a nitro group, an alkoxy group, —$COOR_7$ ($R_7$ represents a hydrogen atom, an alkyl group which may be substituted, an aralkyl group which may be substituted or an aryl group which may be substituted), a halogenated carbonyl group or $CONR_8R_9$ ($R_8$ and $R_9$ represent a hydrogen atom, a halogen atom, an alkyl group which may be substituted, an aralkyl group which may be substituted or an aryl group which may be substituted, which may be identical or different), $Ar_1$ and $Ar_2$ represent a substituted or usubstituted arylene group, which may be identical or different, $Ar_3$ and $Ar_4$ represent a substituted or usubstituted aryl group, which may be identical or different, X represents a single bond, a substituted or usubstituted alkylene group, a substituted or usubstituted cycloalkylene group, a substituted or usubstituted alkylene ether group, a oxygen atom, a sulfur atom or a vinylene group. Z represents a substituted or usubstituted alkylene group, a substituted or usubstituted alkylene ether group or an alkyleneoxycarbonyl group, and "m" and "n" represent an integer of 0 to 3.

In a seventh aspect according to the present invention, there is provided the electrophotographic photoconductor according to first aspect, wherein the mono-functional radical polymerizable compound having a charge transporting structure used in the cross-linked surface layer contains at least one of the formula (3).

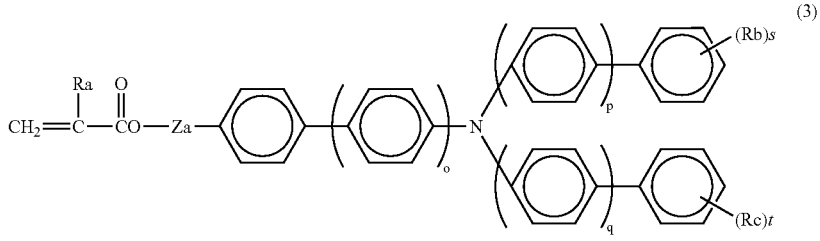

(3)

wherein, "o," "p" and "q" each represent an integer of 0 or 1, Ra represents a hydrogen atom, a methyl group, Rb and Rc represent a substituent other than a hydrogen atom which is a C1-6 alkyl group and may be different when they are two or more, "s" and "t" represent an integer of 0 to 3, and Za represents a single bond, a methylene group, an ethylene group,

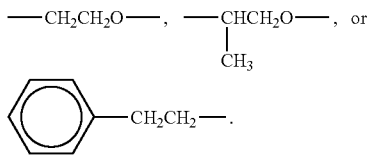

In a eighth aspect according to the present invention, there is provided the electrophotographic photoconductor according to first aspect, wherein the tri- or more-functional radical polymerizable monomer without having a charge transporting structure used in the cross-linked surface layer is 30% to 70% by weight, based on the total amount of the cross-linked surface layer.

In a ninth aspect according to the present invention, there is provided the electrophotographic photoconductor according to first aspect, wherein the mono-functional radical polymerizable compound having a charge transporting structure used in the cross-linked surface layer is 30% to 70% by weight, based on the total amount of the cross-linked surface layer.

In a tenth aspect according to the present invention, there is provided the electrophotographic photoconductor according to first aspect, wherein the photoconductive layer contains at least a charge generation layer, a charge transport layer and a cross-linked surface layer laminated on an electroconductive substrate in this order.

In an 11th aspect according to the present invention, there is provided the electrophotographic photoconductor according to tenth aspect, wherein the charge transport layer of the photoconductive layer contains a high molecular (polymer) charge transport material.

In a 12th aspect according to the present invention, there is provided the electrophotographic photoconductor according to 11th aspect, wherein the high molecular (polymer) charge transport material is a polycarbonate having a triarylamine structure in the main chain or side chain.

In a 13th aspect according to the present invention, there is provided the electrophotographic photoconductor according to first aspect, wherein the cross-linked surface layer is cured by any one of heating or light irradiation.

In a 14th aspect according to the present invention, there is provided the electrophotographic photoconductor according to 11th aspect, wherein the cross-linked surface layer has a thickness of 1 μm or more and 10 μm or less.

In a 15th aspect according to the present invention, there is provided the electrophotographic photoconductor according to 14th aspect, wherein the cross-linked surface layer has a thickness of 2 μm or more and 8 μm or less.

In a 16th aspect according to the present invention, there is provided the electrophotographic photoconductor according to 14th aspect, wherein the cross-linked surface layer is insoluble in an organic solvent.

In a 17th aspect according to the present invention, there is provided an electrophotographic photoconductor containing at least a charge generation layer, a charge transporting layer and a cross-linked surface layer sequentially laminated on an electroconductive substrate, wherein the cross-linked surface layer is formed by cross-linking and curing at least a tri- or more-functional radical polymerizable monomer without having a charge transporting structure and a mono-functional radical polymerizable compound having a charge transporting structure, and the cross-linked surface layer has a thickness of 1 μm or more and 10 μm or less.

In an 18th aspect according to the present invention, there is provided the electrophotographic photoconductor according to 17th aspect, wherein the cross-linked surface layer has a thickness of 2 μm or more and 8 μm or less.

In a 19th aspect according to the present invention, there is provided the electrophotographic photoconductor according to 17th aspect, wherein the cross-linked surface layer is insoluble in an organic solvent.

In a 20th aspect according to the present invention, there is provided the electrophotographic photoconductor according to 17th aspect, wherein the tri- or more-functional radical polymerizable monomer without having a charge transporting structure contained in a coating solution of the cross-linked surface layer has a functional group of acryloyloxy group and/or methacryloyloxy group.

In a 21st aspect according to the present invention, there is provided the electrophotographic photoconductor according to 17th aspect, wherein the tri- or more-functional radical polymerizable monomer without having a charge transporting structure used in the cross-linked surface layer has a ratio of molecular weight to the number of functional group (molecular weight/number of functional group) of 250 or less.

In a 22nd aspect according to the present invention, there is provided the electrophotographic photoconductor according to 17th aspect, wherein the mono-functional radical polymerizable compound having a charge transporting structure used in the cross-linked surface layer has a functional group of acryloyloxy group or methacryloyloxy group.

In a 23rd aspect according to the present invention, there is provided the electrophotographic photoconductor according to 17th aspect, wherein the mono-functional radical polymerizable compound having a charge transporting structure used in the cross-linked surface layer has a charge transporting structure of a triarylamine structure.

In a 24th aspect according to the present invention, there is provided the electrophotographic photoconductor according to 17th aspect, wherein the mono-functional radical polymerizable compound having a charge transporting structure used in the cross-linked surface layer contains at least one of the formula (1) or (2).

(1)

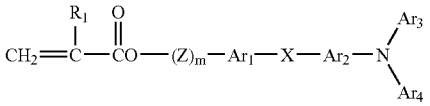

(2)

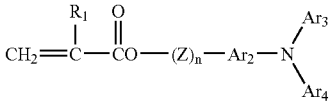

wherein, $R_1$ represents a hydrogen atom, a halogen atom, an alkyl group which may be substituted, an aralkyl group which may be substituted, an aryl group which may be substituted, a cyano group, a nitro group, an alkoxy group, —$COOR_7$ ($R_7$ represents a hydrogen atom, an alkyl group which may be substituted, an aralkyl group which may be substituted or an aryl group which may be substituted), a halogenated carbonyl group or $CONR_8R_9$ ($R_8$ and $R_9$ represent a hydrogen atom, a halogen atom, an alkyl group which may be substituted, an aralkyl group which may be substituted or an aryl group which may be substituted, which may be identical or different), $Ar_1$ and $Ar_2$ represent a substituted or usubstituted arylene group, which may be identical or different, $Ar_3$ and $Ar_4$ represent a substituted or usubstituted aryl group, which may be identical or different, X represents a single bond, a substituted or usubstituted alkylene group, a substituted or usubstituted cycloalkylene group, a substituted or usubstituted alkylene ether group, a oxygen atom, a sulfur atom or a vinylene group. Z represents a substituted or usubstituted alkylene group, a substituted or usubstituted alkylene ether group or an alkyleneoxycarbonyl group, and "m" and "n" represent an integer of 0 to 3.

In a 25th aspect according to the present invention, there is provided the electrophotographic photoconductor according to 17th aspect, wherein the mono-functional radical polymerizable compound having a charge transporting structure used in the cross-linked surface layer contains at least one of the formula (3).

(3)

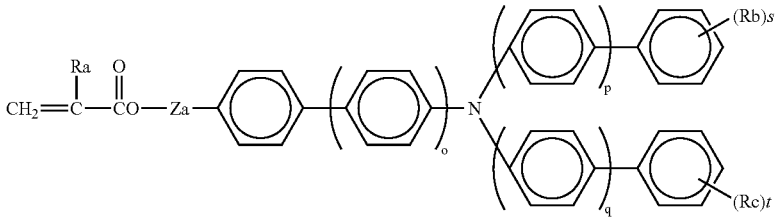

wherein, "o," "p" and "q" each represent an integer of 0 or 1, Ra represents a hydrogen atom, a methyl group, Rb and Rc represent a substituent other than a hydrogen atom which is a C1-6 alkyl group and may be different when they are two or more, "s" and "t" represent an integer of 0 to 3, and Za represents a single bond, a methylene group, an ethylene group,

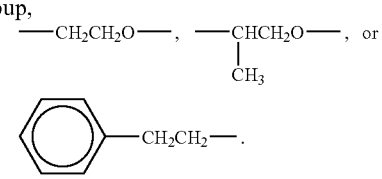

In a 26th aspect according to the present invention, there is provided the electrophotographic photoconductor according to 17th aspect, wherein the tri- or more-functional radical polymerizable monomer without having a charge transporting structure used in the cross-linked surface layer is 30% to 70% by weight, based on the total amount of the cross-linked surface layer.

In a 27th aspect according to the present invention, there is provided the electrophotographic photoconductor according to 17th aspect, wherein the mono-functional radical polymerizable compound having a charge transporting structure used in the cross-linked surface layer is 30% to 70% by weight, based on the total amount of the cross-linked surface layer.

In a 28th aspect according to the present invention, there is provided the electrophotographic photoconductor according to 17th aspect, wherein the charge transporting layer of the photoconductive layer contains a high molecular (polymer) charge transporting material.

In a 29th aspect according to the present invention, there is provided the electrophotographic photoconductor according to 28th aspect, wherein the high molecular (polymer) charge transporting material is a polycarbonate having a triarylamine structure as a main chain or a side chain.

In a 30th aspect according to the present invention, there is provided the electrophotographic photoconductor according to 17th aspect, wherein the cross-linked surface layer is cured by one of heating and light irradiation.

In a 31st aspect according to the present invention, there is provided the electrophotographic photoconductor according to 17th aspect, wherein the cross-linked surface layer has an elastic displacement rate τe of 35% or more and a standard deviation of the elastic displacement rate τe of 2% or less.

In a 32nd aspect according to the present invention, there is provided a process forming an image including at least: a charging step to charge an electrophotographic photoconductor; a light exposure step to exposing the electrophotographic photoconductor charged in the charging step to a recording light to form an electrostatic latent image; a development step to supply a developing agent to the electrostatic latent image to visualize the electrostatic image and form a toner image; and a transferring step to transfer the toner image formed by the development step on a transfer material, wherein the electrophotographic photoconductor contains at least a photoconductive layer on an electroconductive substrate, a surface layer of the photoconductive layer contains a cross-linked surface layer formed by curing at least a tri- or more-functional radical polymerizable monomer without having a charge transporting structure and a mono-functional radical polymerizable compound having a charge transporting structure, and the cross-linked surface layer has an elastic displacement rate τe of 35% or more and a standard deviation of the elastic displacement rate τe of 2% or less.

In a 33rd aspect according to the present invention, there is provided a process forming an image containing at least: a charging step to charge an electrophotographic photoconductor; a light exposure step to exposing the electrophotographic photoconductor charged in the charging step to a recording light to form an electrostatic latent image; a development step to supply a developing agent to the electrostatic latent image to visualize the electrostatic image and form a toner image; and a transferring step to transfer the toner image formed by the development step on a transfer material, wherein the electrophotographic photoconductor contains at least a charge generation layer, a charge transporting layer and a cross-linked surface layer sequentially laminated on an electroconductive substrate, the cross-linked surface layer is formed by cross-linking and curing at least a tri- or more-functional radical polymerizable monomer without having a charge transporting structure and a mono-functional radical polymerizable compound having a charge transporting structure, and the cross-linked surface layer has a thickness of 1 μm or more and 10 μm or less.

In a 34th aspect according to the present invention, there is provided an apparatus for forming an image containing: an electrophotographic photoconductor; and at least a charging unit to charge the electrophotographic photoconductor, a light exposing unit to expose the electrophotographic photoconductor charged by the charging unit to a recording light to form an electrostatic latent image, a development unit to supply a developing agent to the electrostatic latent image to visualize the electrostatic image and form a toner image, and a transferring unit to transfer the toner image formed by the development unit on a transfer material, wherein the electrophotographic photoconductor contains at least a photoconductive layer on an electroconductive substrate, a surface layer of the photoconductive layer contains a cross-linked surface layer formed by curing at least a tri- or more-functional radical polymerizable monomer without having a charge transporting structure and a mono-functional radical polymerizable compound having a charge transporting structure, and the cross-linked surface layer has an elastic displacement rate τe of 35% or more and a standard deviation of the elastic displacement rate τe of 2% or less.

In a 35th aspect according to the present invention, there is provided an apparatus for forming an image containing: an electrophotographic photoconductor; and at least a charging unit to charge the electrophotographic photoconductor, a light exposing unit to expose the electrophotographic photoconductor charged by the charging unit to a recording light to form an electrostatic latent image, a development unit to supply a developing agent to the electrostatic latent image to visualize the electrostatic image and form a toner image, and a transferring unit to transfer the toner image formed by the development unit on a transfer material, wherein the electrophotographic photoconductor contains at least a charge generation layer, a charge transporting layer and a cross-linked surface layer sequentially laminated on an electroconductive substrate, the cross-linked surface layer is formed by cross-linking and curing at least a tri- or more-functional radical polymerizable monomer without having a charge transporting structure and a mono-functional radical polymerizable compound having a charge transporting structure, and the cross-linked surface layer has a thickness of 1 μm or more and 10 μm or less.

In a 36th aspect according to the present invention, there is provided a process cartridge for an image forming apparatus containing: an electrophotographic photoconductor; and at least one selected from the group consisting of a charging unit to charge the electrophotographic photoconductor, a development unit to supply a developing agent to the electrostatic latent image formed by exposure on the electrophotographic photoconductor to visualize the electrostatic image and form a toner image, a transferring unit to transfer the toner image formed by the development unit on a transfer material, a cleaning unit to remove toner remaining on the electrophotographic photoconductor after the transferring, and a discharging unit to remove the latent image on the photoconductor after the transferring, forming a monolithic structure, which cartridge is adapted to be attached to and detached from a main body of the image forming apparatus, wherein the electrophotographic photoconductor contains at least a photoconductive layer on an electroconductive substrate, a surface layer of the photoconductive layer contains a cross-linked surface layer formed by curing at least a tri- or more-functional radical polymerizable monomer without having a charge transporting structure and a mono-functional radical polymerizable compound having a charge transporting structure, and the cross-linked surface layer has an elastic displacement rate τe of 35% or more and a standard deviation of the elastic displacement rate τe of 2% or less.

In a 37th aspect according to the present invention, there is provided a process cartridge for an image forming apparatus containing: an electrophotographic photoconductor; and at least one selected from the group consisting of a charging unit to charge the electrophotographic photoconductor, a development unit to supply a developing agent to the electrostatic latent image formed by exposure on the electrophotographic photoconductor to visualize the electrostatic image and form a toner image, a transferring unit to transfer the toner image formed by the development unit on a transfer material, a cleaning unit to remove toner remaining on the electrophotographic photoconductor after the transferring, and a discharging unit to remove the latent image on the photoconductor after the transferring, forming a monolithic structure with the apparatus, which cartridge is adapted to be attached to and detached from a main body of the image forming apparatus, wherein the electrophotographic photoconductor contains at least a charge generation layer, a charge transporting layer and a cross-linked surface layer sequentially laminated on an electroconductive substrate, the cross-linked surface layer is formed by cross-linking and curing at least a tri- or more-functional radical polymerizable monomer without having a charge transporting structure and a mono-functional radical polymerizable compound having a charge transporting structure, and the cross-linked surface layer has a thickness of 1 μm or more and 10 μm or less.

DESCRIPTION OF THE PREFERRED EMBODIMENTS

Figure 1A:
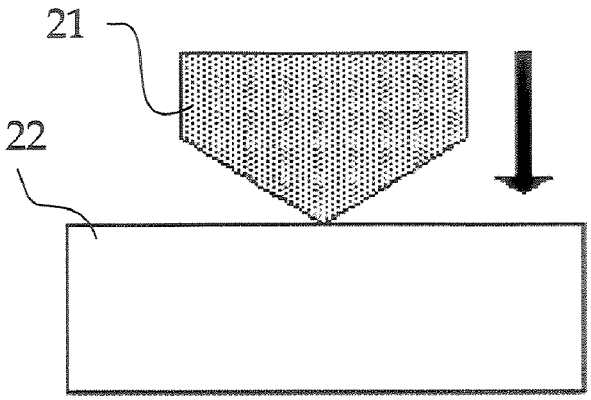
FIGS. 1A, 1B, and 1C show schematic diagrams of a depressor of a microhardness tester for measurement of elasticity displacement rate according to the present invention.

Now, the present invention will be explained in detail.

According to the present invention, the above objects are accomplished by an electrophotographic photoconductor having high durability and being capable of realizing high quality of image, which comprises a photoconductive layer, the surface layer of which comprises a cross-linked layer formed by curing at least a tri- or more-functional radical polymerizable monomer without having a charge transporting structure and a mono-functional radical polymerizable compound having a charge transporting structure, wherein the cross-linked surface layer has an elasticity displacement rate τe of 35% or more and the standard deviation of the elasticity displacement rate τe of 2% or less.

In the photoconductor according to the present invention, tri- or more-functional radical polymerizable monomer is used in the surface layer, whereby a 3-dimensional mesh structure is developed thereon to form a high hardness surface layer with high cross-linkage and thereby, high abrasion resistance. On the contrary, when only a mono-functional or bi-functional radical polymerizable monomer is used, the cross-linkage in the cross-linked surface layer is weakened and it is thus impossible to accomplish a greatly improved abrasion resistance. When a high molecular material is contained in the cross-linked surface layer, the development of the 3-dimensional mesh structure is impeded and the cross-linkage is reduced, whereby it is impossible to obtain sufficient abrasion resistance. Further, since the high molecular material is poorly compatible to the cured body formed by the reaction of the radical polymerizable composition (a radical polymerizable monomer and a compound having a charge transporting structure), local abrasion may occur from the phase separation, leading scratch on the surface. In addition, the coating solution of the cross-linked layer according to the present invention contains a mono-functional radical polymerizable compound having a charge transporting structure, which is inserted in the cross-linkage during curing of the tri- or more functional radical polymerizable monomer. On the other hand, when a low molecular charge transporting material without functional group is contained in the cross-linked surface layer, due to its low compatibility, it tends to be crystallized or clouding may occur, whereby mechanical properties of the cross-linked surface layer are deteriorated. When a bi- or more-functional charge transporting compound is used as a main component, it may be fixed in the cross-linked structure by a plurality of bondings. However, since the charge transporting structure has a big size, distortion is generated in the cured resin, which increases internal stress in the cross-linked surface layer. As a result, crack or scratch often forms by attachment of a carrier.

Further, the photoconductor according to the present invention has excellent electrical properties, whereby it is possible to produce a high quality image for a long period of time. This is because the mono-functional radical polymerizable compound having a charge transporting structure is fixed in a pendant type during cross-linking reaction. As described above, the charge transporting material without a functional group causes deterioration in repeated uses such as crystallization and clouding, reduction of sensitivity and increase of residual potential. When a bi- or more-functional charge transport compound is used as a main component, it is fixed in the structure by a plurality of bondings. As a result, it is impossible for an intermediate structure (cationic radical) to maintain a stable state during charge transport, which causes reduction in sensitivity and increase of residual potential by charge trapping. The above-described deterioration of electrical properties results in reduction in image density, character thinning and the like.

Further, the photoconductor according to the present invention can provide the above described effects when the cross-linked surface layer has an elasticity displacement rate τe of 35% or more and the standard deviation of the elasticity displacement rate τe of 2% or less. When the elasticity displacement rate τe is less than 35%, the stress applied to a development part or a cleaning part is accumulated, for example, as heat energy, causing plastic deformation. The plastic deformation is shown as abrasion of the photoconductor, resulting in reduction of durability. Also, when the standard deviation of the elasticity displacement rate τe is greater than 2%, though the entire surface layer has a high elasticity and high abrasion resistance, there is a local part having a low elasticity displacement rate, to which an external additive or paper fragments in a toner is attached, causing image deterioration. When this phenomenon further progresses, toner filming occurs, whereby an image with white spot or an image with non-uniform density may be produced due to non-uniform light permeability.

Next, the component materials of the coating solution of the outermost surface layer according to the present invention are described.

The tri- or more-functional radical polymerizable monomer without having charge transporting ability structure which is used in the present invention refers to a monomer which does not contain a hole transporting structure, such as, for example, triarylamine, hydrazone, pyrazoline, carbazole and the like, and an electron transporting structure such as for example fused polycyclic quinone, diphenoquinone and an electron pulling aromatic ring having cyano group or nitro group, but has a three or more of radical polymerizable functional groups. The radical polymerizable functional group may be any one which has a carbon-carbon double bonds and is a radical polymerizable group.

Examples of the radical polymerizable functional group include a 1-substituted ethylene functional group and a 1,1-substituted ethylene functional groups.

(1) Examples of the 1-substituted ethylene functional group include a functional group represented by the following formula:

$$CH_2{=}CH{-}X_1{-} \qquad \text{equation 10}$$

wherein, $X_1$ represents arylene group such as phenylene group, naphthylene group and the like, which may be substituted, alkynylene group which may be substituted, —CO— group, —COO— group, —CON($R_{10}$)— group ($R_{10}$ represents an alkyl group such as hydrogen, methyl group and ethyl group, aralkyl group such as benzyl group, naphthylmethyl group and phenethyl group, aryl group such as phenyl group and naphthyl group), or —S— group.

Concrete examples of these substituents include vinyl group, styryl group, 2-methyl-1,3-butadienyl group, vinylcarbonyl group, acryloyloxy group, acryloylamino group, vinylthioether group and the like.

(2) Examples of the 1,1-substituted ethylene functional group include a functional group represented by the following formula:

$$CH_2{=}C(Y){-}X_2{-} \qquad \text{equation 11}$$

wherein, Y represents an alkyl group which may be substituted, an aralkyl group which may be substituted, an aryl group such as phenyl group, naphthyl group which may be substituted, a halogen atom, a cyano group, a nitro group, an alkoxy group such as methoxy group or ethoxy group, —$COOR_{11}$ group ($R_{11}$ represents a hydrogen atom, an alkyl group such as methyl group, ethyl group and the like which may be substituted, an aralkyl group such as benzyl and phenethyl group which may be substituted, an aryl group such as phenyl group and naphthyl group which may be substituted), or —$CONR_{12}R_{13}$ ($R_{12}$ and $R_{13}$ represent a hydrogen atom, an alkyl group such as methyl group, ethyl group and the like which may be substituted, an aralkyl group such as benzyl group, naphthylmethyl group or phenethyl group which may be substituted, or an aryl group such as phenyl group and naphthyl group which may be substituted and may be identical or different), $X_2$ represents a substituent as defined for $X_1$ of the formula 10 and a single bond, an alkylene group, provided that at least any one of Y and $X_2$ is an oxycarbonyl group, a cyano group, alkenylene group, and an aromatic ring).

Concrete examples of these substituents include α-chloro acryloyloxy group, methacryloyloxy group, α-cyanoethylene group, α-cyanoacryloyloxy group, α-cyanophenylene group, methacryloylamino group and the like.

Examples of the substituent which is additionally substituted to the substituents of $X_1$, $X_2$ and Y include a halogen atom, a nitro group, a cyano group, an alkyl group such as methyl group, ethyl group and the like, an alkoxy group such as methoxy group, ethoxy group and the like, an aryloxy group such as phenoxy group and the like, an aryl group such as phenyl group, naphthyl group and the like, and an aralkyl group such as benzyl group, phenethyl group and the like.

Among these radical polymerizable functional groups, acryloyloxy group and methacryloyloxy group are particularly useful and compounds having 3 or more of acryloyloxy groups may be prepared, for example, by esterification or transesterification of a compound having 3 or more hydroxy groups in the molecule with acrylic acid (salt), acrylic acid halide, acrylic acid ester. Also, a compound having 3 or more methacryloyloxy groups may be similarly prepared. The radical polymerizable functional groups in a monomer having 3 or more radical polymerizable functional groups may be identical or different.

Concrete examples of the tri- or more-functional radical polymerizable monomer without having a charge transporting structure are illustrated below but are not limited thereto.

That is, the radical polymerizable monomer which can be used in the present invention includes trimethylolpropanetriacrylate (TMPTA), trimethylolpropanetrimethacrylate, HPA-modified trimethylolpropanetriacrylate, EO-modified trimethylolpropane triacrylate, PO-modified trimethylolpropane triacrylate, caprolactone-modified trimethylolpropane triacrylate, HPA-modified trimethylolpropane trimethacrylate, pentaerythritol triacrylate, pentaerythritol tetraacrylate (PETTA), glycerol triacrylate, ECH-modified glycerol triacrylate, EO-modified glycerol triacrylate, PO-modified glycerol triacrylate, tris(acryloxyethyl)isocyanurate, dipentaerythritol hexacrylate (DPHA), caprolactone-modified dipentaerythritol hexacrylate, dipentaerythritolhydroxy pentaacrylate, alkyl-modified dipentaerythritol pentaacrylate, alkyl-modified dipentaerythritol tetraacrylate, alkyl-modified dipentaerythritol triacrylate, dimethylolpropane tetraacrylate (DTMPTA), pentaerythritolethoxy tetraacrylate, EO-modified phosphonic acid triacrylate, 2,2,5,5,-tetrahydroxymethylcyclopentanone tetraacrylate and the like, which may be used alone or in combination of two or more thereof.

Also, the tri- or more-functional radical polymerizable monomer without having a charge transporting structure which can be used in the present invention a ratio (molecular weight/number of functional group) of molecular weight to the number of functional group in the monomer is preferably 250 or less to form a dense cross-linkage in the cross-linked surface layer. If the ratio is greater than 250, the cross-linked surface layer becomes soft, which may cause somewhat reduction in abrasion resistance. Therefore, in case of using a monomer having a modifying group such as HPA, EO and PO, it is not preferable to use a monomer having an excessively long modifying group alone. The compositional ratio of the tri- or more-functional radical polymerizable monomer without having a charge transporting structure used in the surface layer is 20% to 80% by weight, preferably 30% to 70% by weight relative to the total amount of the cross-linked surface layer and substantially depends on a ratio of the tri- or more-radical polymerizable monomer in the solid content of the coating solution. If the monomer component is less than 20% by weight, 3-dimensional cross-linkage density of the cross-linked surface layer is reduced and thus it cannot accomplish a significant improvement in abrasion resistance as compared to the conventional thermoplastic binder resins. Also, if it exceeds 80% by weight, the content of the charge transport compound is reduced, causing deterioration in electrical properties. Though it is impossible to define a generally preferable range since the required abrasion resistance or electrical properties vary according to a used process, the content is most preferably is in the range of 30% to 70% by weight, considering the balance between both properties.

The mono-functional radical polymerizable compound having a charge transporting structure which is used in the present invention refers to a compound which contains a hole transporting structure, such as, for example, triarylamine, hydrazone, pyrazoline, carbazole and the like, and an electron transporting structure such as for example fused polycyclic quinone, diphenoquinone and an electron pulling aromatic ring having cyano group or nitro group, and has one radical polymerizable functional groups. The radical polymerizable functional group includes functional groups represented by the formulae 10 and 11 above. More concretely, it can be ones as defined for the radical polymerizable monomer, particularly acryloyloxy group, methacyloyloxy group. Also, as the charge transporting structure a triarylamine structure is highly effective, and particularly, a compound represented by the following formulae (1) or (2) can be used to maintain good electrical properties such as sensitivity and residual potential.

(1)

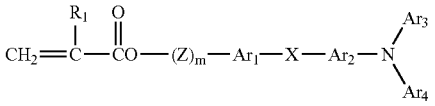

(2)

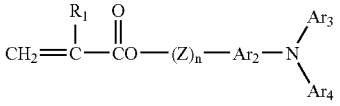

wherein, $R_1$ represents a hydrogen atom, a halogen atom, an alkyl group which may be substituted, an aralkyl group which may be substituted, an aryl group which may be substituted, a cyano group, a nitro group, an alkoxy group, —$COOR_7$ ($R_7$ represents a hydrogen atom, an alkyl group which may be substituted, an aralkyl group which may be substituted or an aryl group which may be substituted), a halogenated carbonyl group or $CONR_8R_9$ ($R_8$ and $R_9$ represent a hydrogen atom, a halogen atom, an alkyl group which may be substituted, an aralkyl group which may be substituted or an aryl group which may be substituted, which may be identical or different), $Ar_1$ and $Ar_2$ represent a substituted or usubstituted arylene group, which may be identical or different, $Ar_3$ and $Ar_4$ represent a substituted or usubstituted aryl group, which may be identical or different, X represents a single bond, a substituted or usubstituted alkylene group, a substituted or usubstituted cycloalkylene group, a substituted or usubstituted alkylene ether group, a oxygen atom, a sulfur atom or a vinylene group. Z represents a substituted or usubstituted alkylene group, a substituted or usubstituted alkylene ether group or an alkyleneoxycarbonyl group, and "m" and "n" represent an integer of 0 to 3.

Concrete examples of the formulae (1) and (2) are as follows.

In the formulae (1) and (2), the alkyl group as a substituent of $R_1$ includes, for example, methyl group, ethyl group, propyl group, butyl group and the like, the aryl group includes phenyl group, naphthyl group and the like, the aralkyl group includes benzyl group, phenethyl group, naphthylmethyl group and the like, the alkoxy group includes methoxy group, ethoxy group, propoxy group the like, which may be substituted by a halogen atom, a nitro group, a cyano group, an alkyl group such as methyl group, ethyl group and the like, an alkoxy group such as methoxy group, ethoxy group and the like, an aryloxy group such as phenoxy group and the like, an aryl group such as phenyl group, naphthyl group and the like, an aralkyl group such as benzyl group, phenethyl group and the like.

Particularly preferred examples of the substituents of $R_1$ are a hydrogen atom and methyl group.

The substituted or usubstituted $Ar_3$ and $Ar_4$ are an aryl group and the examples of the aryl group include fused polycyclic hydrocarbon groups non-fused cyclic hydrocarbon groups and polycyclic groups.

The fused polycyclic hydrocarbon group is preferably one having 18 or less carbon atoms to form a ring, including, for example, pentanyl group, indenyl group, naphthyl group, azulenyl group, heptaprenyl group, biphenylenyl group, a s-indacenyl group, s-indacenyl group, fluorenyl group, acenaphthylenyl group, pleiadene adenyl group, acenaphthenyl group, phenalenyl group, phenathryl group, antholyl group, fluorandenyl group, acephenanthrylenyl group, aceanthrylenyl group, triphenylenyl group, pyrenyl group, chrysene, and naphthacenyl group.

The non-fused hydrocarbon group includes an univalent group of a monocyclic hydrocarbon compound such as benzene, diphenyl ether, polyethylenediphenyl ether, diphenylthioether and diphenylsulphone, an univalent group of a non-fused polycyclic hydrocarbon compound, such as biphenyl, polyphenyl, diphenylalkane, diphenylalkene, diphenylalkyne, triphenylmethane, distyrylbenzene, 1,1-diphenylcycloalkane, polyphenylalkane and polyphenylalkene, or an univalent group of a cyclic hydrocarbon compound such as 9,9-diphenylfluorene.

The polycylic group includes a univalent group of carbazole, dibenzofuran, dibenzothiphene, oxadiazole, and thiadiazole.

Also, the aryl group represented by $Ar_3$ and $Ar_4$ may be substituted by a substituent, for example, as follows.

(1) a halogen atom, a cyano group, a nitro group and the like.

(2) an alkyl group, preferably a $C_1$ to $C_{12}$, particularly a $C_1$ to $C_8$, more preferably a $C_1$ to $C_4$ straight-chained or branched alkyl group, wherein the alkyl group may be further substituted by a fluorine atom, a hydroxy group, a cyano group, a $C_1$ to $C_4$ alkoxy group, phenyl group, or a phenyl group substituted by a halogen atom, a $C_1$ to $C_4$ alkyl group or a $C_1$ to $C_4$ alkoxy group. Concretely, it includes methyl group, ethyl group, n-butyl group, i-propyl group, t-butyl group, s-butyl group, n-propyl group, tri-fluoromethyl group, 2-hydroxyethyl group, 2-ethoxyethyl group, 2-cyanoethyl group, 2-methoxyethyl group, benzyl group, 4-chlorobenzyl group, 4-methylbenzyl group, 4-phenylbenzyl group and the like.

(3) an alkoxy group (—$OR_2$), wherein $R_2$ represents an alkyl group as defined in (2). Concretely, it includes methoxy group, ethoxy group, n-propoxy group, i-propoxy group, t-butoxy group, n-butoxy group, s-butoxy group, i-butoxy group, 2-hydroxyethoxy group, benzyloxy group, trifluoromethoxy group and the like.

(4) an aryloxy group, wherein the aryl group may be phenyl group and naphthyl group, which may be substituted by a $C_1$ to $C_4$ alkoxy group, a $C_1$ to $C_4$ alkyl group or a halogen atom. Concretely, it includes phenoxy group, 1-naphthyloxy group, 2-naphthyloxy group, 4-methoxyphenoxy group, 4-methylphenoxy group and the like.

(5) an alkylmercapto group or arylmercapto group. Concretely, it includes methylthio group, ethylthio group, phenylthio group, p-methylphenylthio group and the like.

(6)

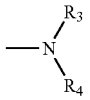

wherein, $R_3$ and $R_4$ represent each independently a hydrogen atom, an alkyl group as defined in (2), or aryl group. The aryl group includes, for example, phenyl group, biphenyl group or naphthyl group, which may be substituted by a $C_1$ to $C_4$ alkoxy group, a $C_1$ to $C_4$ alkyl group or a halogen atom, or $R_3$ and $R_4$ may form a ring together.

Concretely, it includes amino group, diethylamino group, N-methyl-N-phenylamino group, N,N-diphenylamino group, N, N-di(tryl)amino group, dibenzylamino group, piperidino group, morpholino group, pyrrolidono group and the like.

(7) an alkylenedioxy group or alkylenedithio group such as methylenedioxy group or methylenedithio group.

(8) a substituted or usubstituted styryl group, a substituted or usubstituted β-phenylstyryl group, a diphenylaminophenyl group, ditolylaminophenyl group and the like.

The arylene group represented by $Ar_1$ and $Ar_2$ includes a divalent group derived from an aryl group represented by $Ar_3$ and $Ar_4$.

X represents a single bond, a substituted or usubstituted alkylene group, a substituted or usubstituted cycloalkylene group, a substituted or usubstituted alkylene ether group, an oxygen atom, a sulfur atom, or vinylene group.

The substituted or usubstituted alkylene group is a $C_1$ to $C_{12}$, preferably $C_1$ to $C_8$, more preferably $C_1$ to $C_4$ straight chained or branched alkylene group, wherein the alkylene group may be further substituted by a fluorine, a hydroxy group, a cyano group, an $C_1$ to $C_4$ alkoxy group, a phenyl group, or a phenyl group substituted by a halogen atom, a $C_1$ to $C_4$ alkyl group or a $C_1$ to $C_4$ alkoxy group. Concretely, it includes methylene group, ethylene group, n-butylene group, i-propylene group, t-butylene group, s-butylene group, n-propylene group, trifluoromethylene group, 2-hydroxyethylene group, 2-ethoxyethylene group, 2-cyanoethylene group, 2-methoxyethylene group, benzylidene group, phenylethylene group, 4-chlorophenylethylene group, 4-methylphenylethylene group, 4-biphenylethylene group and the like.

The substituted or usubstituted cycloalkylene group is a $C_5$ to $C_7$ cyclic alkylene group, wherein the cyclic alkylene group may be substituted by a fluorine atom, a $C_1$ to $C_4$ alkyl group or a $C_1$ to $C_4$ alkoxy group. Concretely, it includes cyclohexylidene group, cyclohexylene group, 3,3-dimethylcyclohexylidene group and the like.

The substituted or usubstituted alkylene ether group represents ethyleneoxy, propyleneoxy, ethylene glycol, propyleneglycol, diethyleneglycol, tetraethylene glycol or tripropyleneglycol, wherein the alkylene group may be substituted by a hydroxyl group, methyl group, ethyl group and the like.

The vinylene group is represented by the following formula.

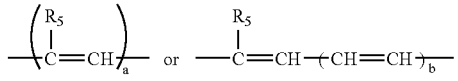

wherein $R_5$ represents hydrogen, an alkyl group (which is the same as defined in (2)) or an aryl group (which is the same with the aryl group represented by $Ar_3$ and $Ar_4$), "a" represents 1 or 2, and "b" represents 1 to 3.

Z represents a substituted or usubstituted alkylene group, a substituted or usubstituted alkylene ether group, or an alkyleneoxycarbonyl group.

The substituted or usubstituted alkylene group includes the alkylene groups as defined for X.

The substituted or usubstituted alkylene ether group includes the alkylene ether groups as defined for X.

The alkyleneoxycarbonyl group includes caprolactone-modified groups.

The mono-functional radical polymerizable compound having a charge transporting structure is more preferably a compound having a structure of formula (3).

(3)

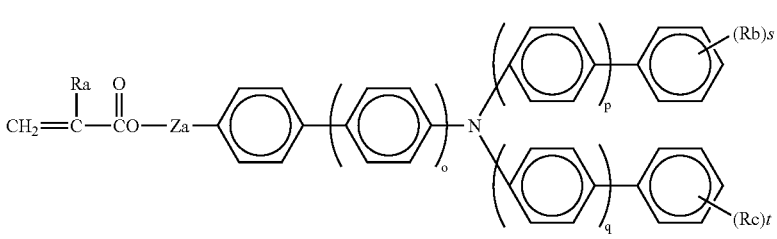

wherein, "o," "p" and "q" each represent an integer of 0 or 1, Ra represents a hydrogen atom, a methyl group, Rb and Rc represent a substituent other than a hydrogen atom which is a C1-6 alkyl group and may be different when they are two or more, "s" and "t" represent an integer of 0 to 3, and Za represents a single bond, a methylene group, an ethylene group,

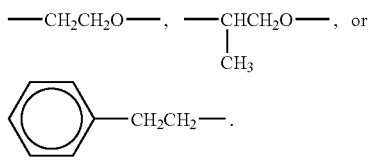

The compound represented by the above formula is preferably a compound wherein Rb and Rc are methyl group or ethyl group.

The radical polymerizable compound having a mono-functional charge transporting structure of the formulae (1) and (2), particularly the formula (3) radical polymerizable compound, which is used in the present invention cannot be a terminal structure, sine the polymerization is accomplished by opening of the carbon-carbon double bond at both sides, but is inserted interposed in a continuous polymer chain. In a polymer cross-linked by polymerization with tri- or more-functional radical polymerizable monomer, it exists in the main chain of the polymer and in the cross-linkage between a main chain and a main chain (the cross-linkage includes a intermolecular cross-linkage between one polymer and the other polymer and an intramolecular cross-linkage between one site where a folded main chain is present in a polymer and the other site which is derived from a monomer polymerized at a position remote from the one site in the main chain). However, even when it is present in the main chain or it is present in the cross-linkage, it has at least three aryl groups radially oriented from a nitrogen atom in the triarylamine structure suspended from the chain and, though being bulky, is not directly bonded to the chain but suspended from the chain, for example, by a carbonyl group, whereby it is versatilely fixed for three dimensional orientation. Therefore, since the triarylamine structures can be properly oriented spatially adjacent to each other in a polymer, they do not lead to large structural distortion in a molecule, and it can be expected that when applied in a surface layer of an electrophotographic photoconductor, it may provide an intramolecular structure relatively avoiding interruption of a charge transport passage.

Concrete examples of the mono-functional radical polymerizable compound having a charge transporting structure according to the present invention are illustrated below (No. 1 to No. 160), but are not limited to compounds of these structures.

No. 1

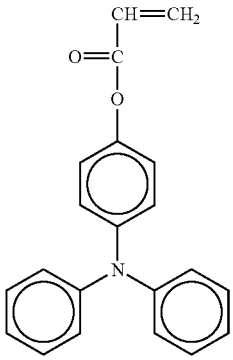

No. 2

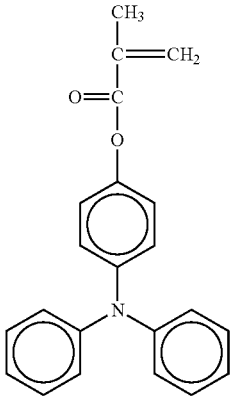

-continued

No. 3

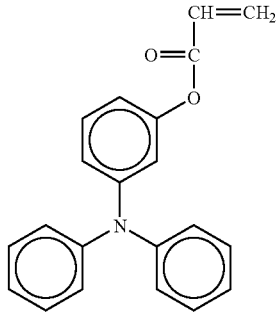

No. 4

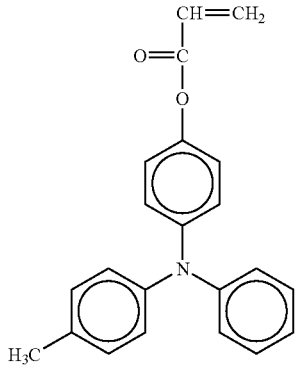

No. 5

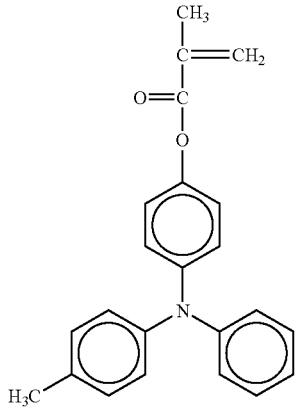

No. 6

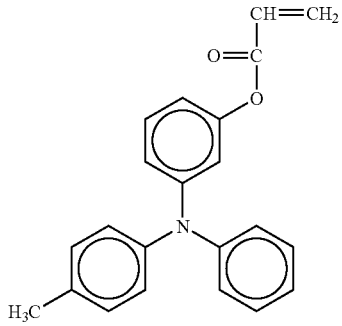

-continued
No. 7
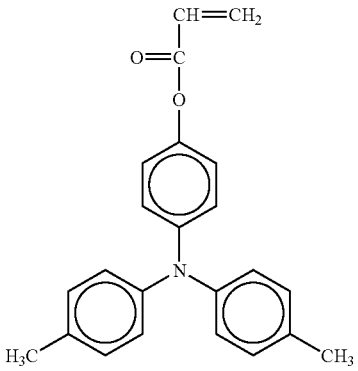
No. 8
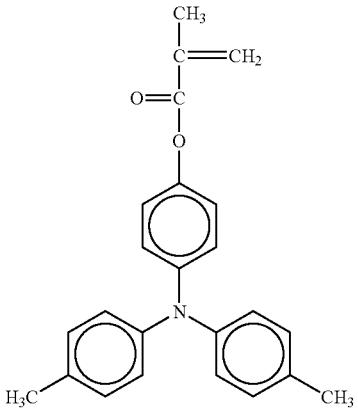
No. 9
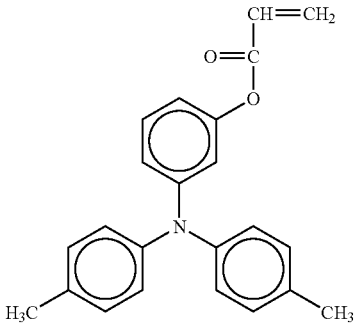
No. 10
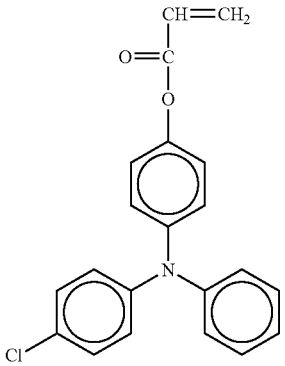
-continued
No. 11
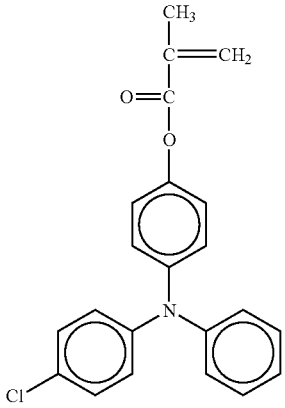
No. 12
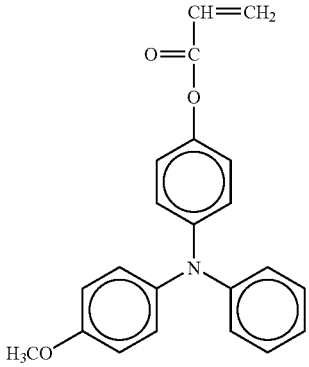
No. 13
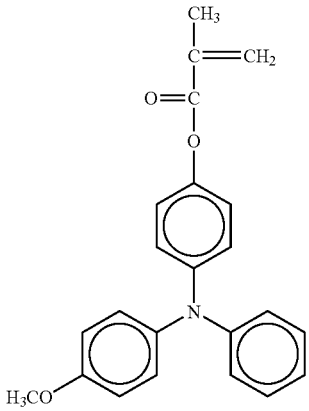
No. 14
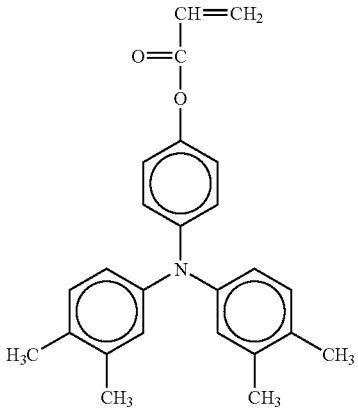

-continued
No. 15
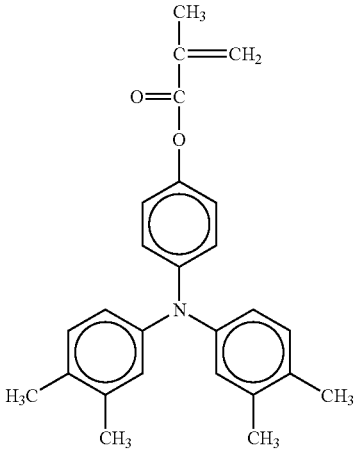
No. 16
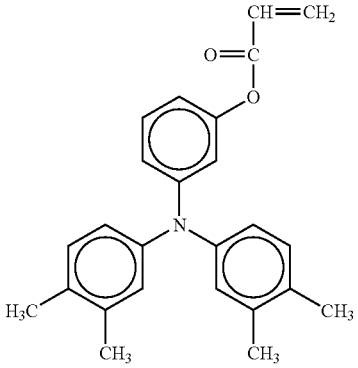
No. 17
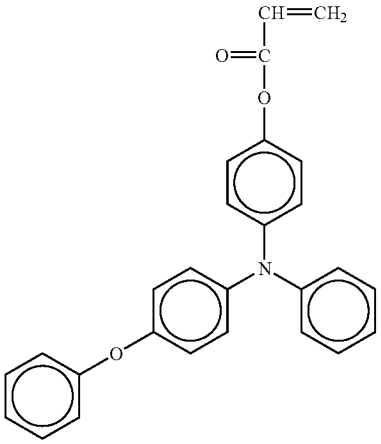
-continued
No. 18
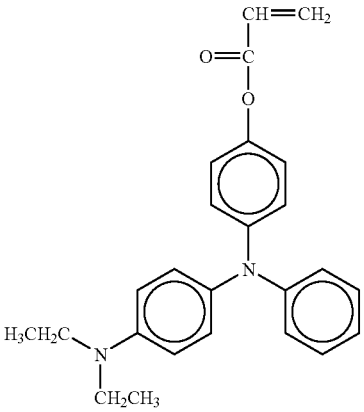
No. 19
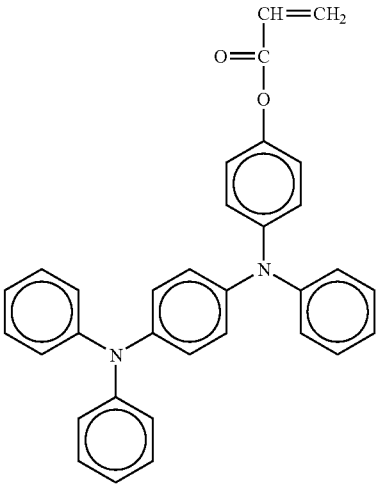
No. 20
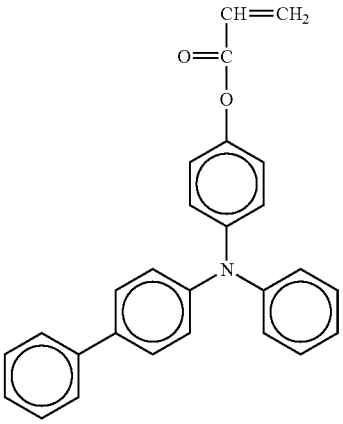

-continued
No. 21
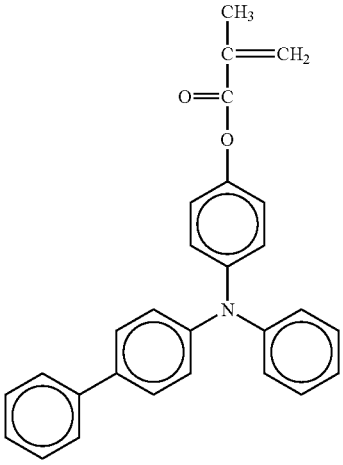
No. 22
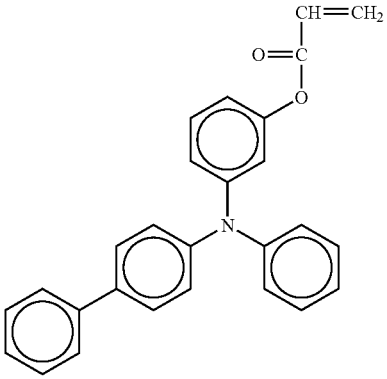
No. 23
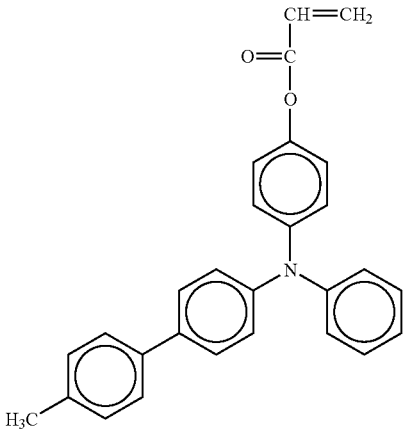
-continued
No. 24
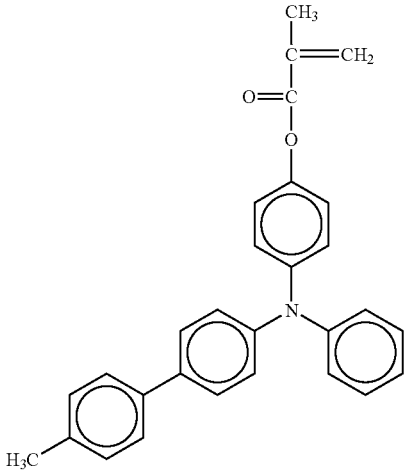
No. 25
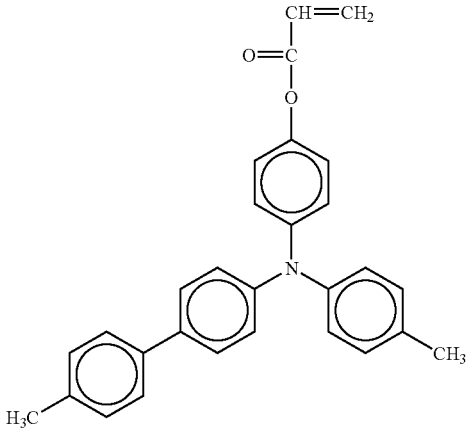
No. 26
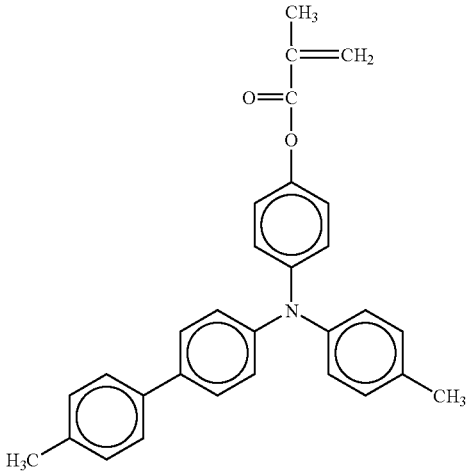

-continued
No. 27
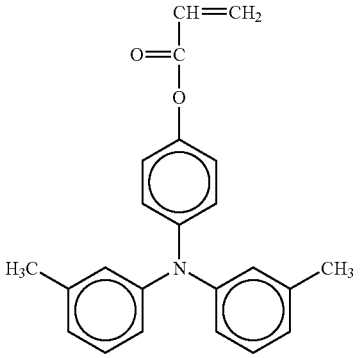
No. 28
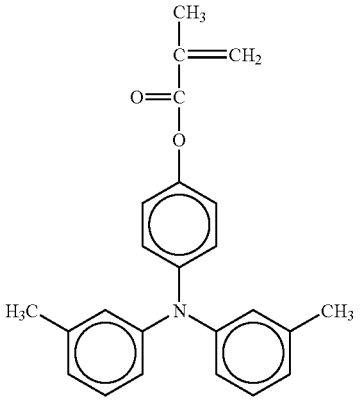
No. 29
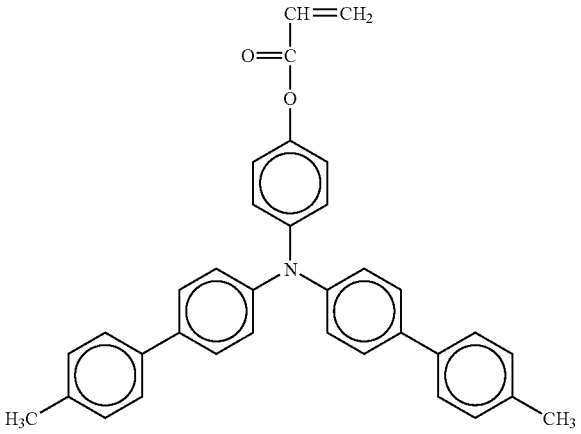
No. 30
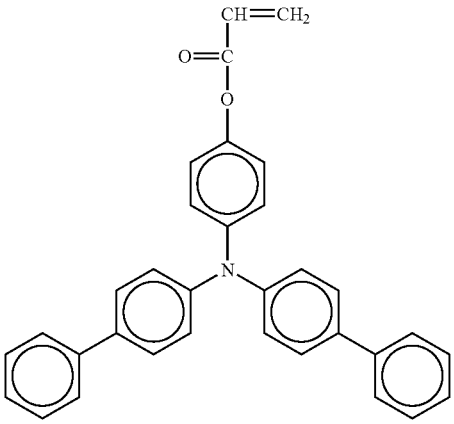
-continued
No. 31
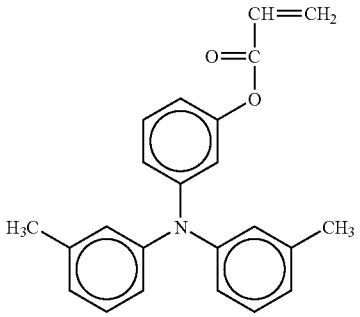
No. 32
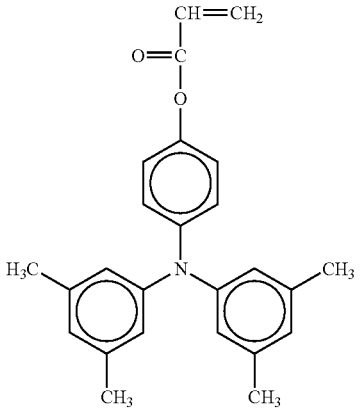
No. 33
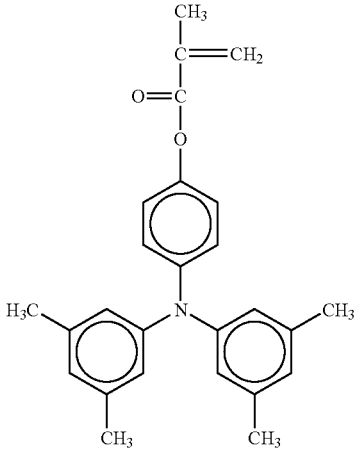
No. 34
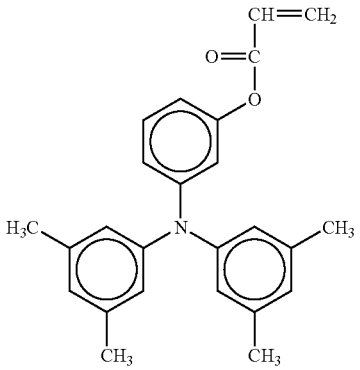

-continued
No. 35
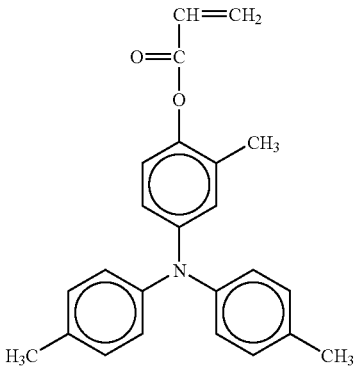
No. 36
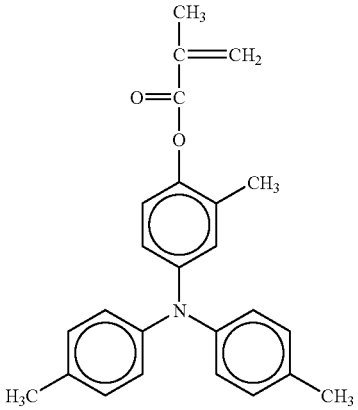
No.37
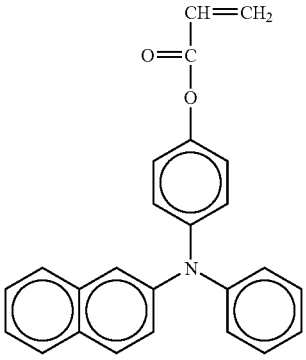
No. 38
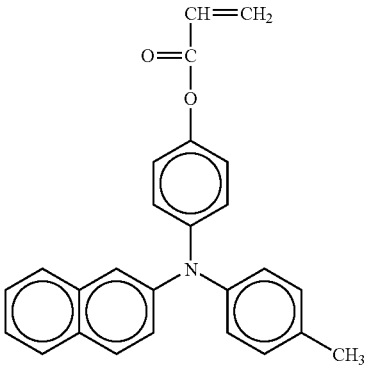
-continued
No. 39
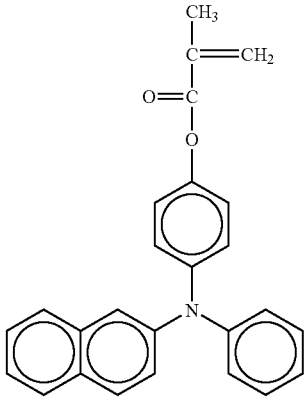
No. 40
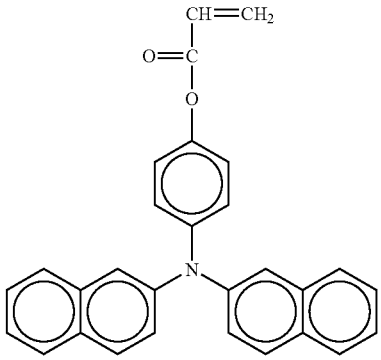
No. 41
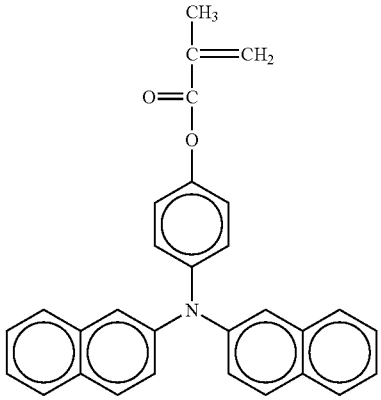

-continued
No. 42
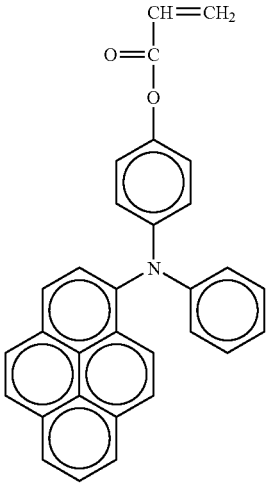
No. 43
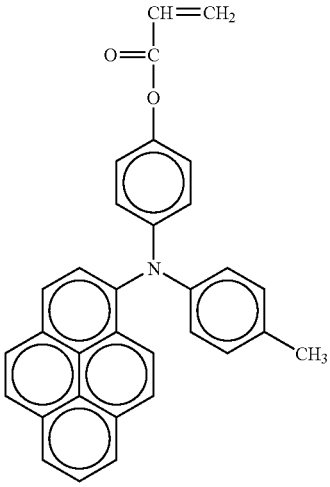
No. 44
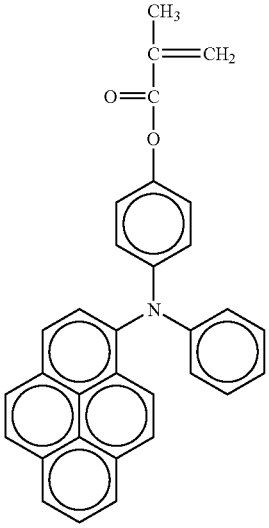
-continued
No. 45
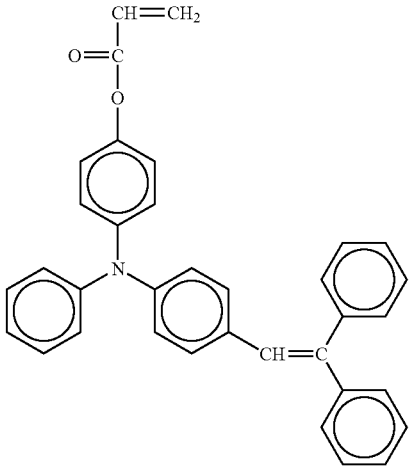
No. 46
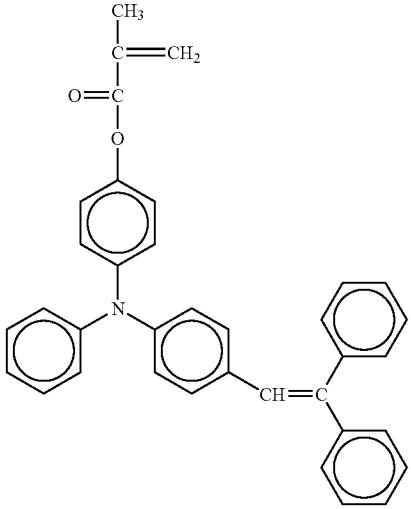
No. 47
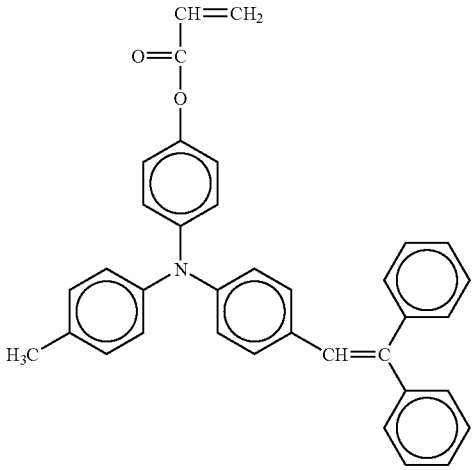

-continued
No. 48
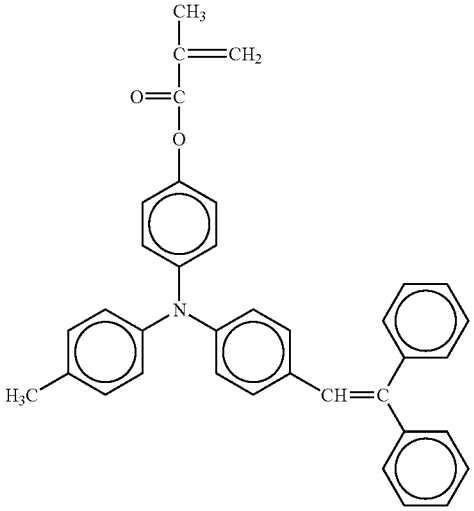
No. 49
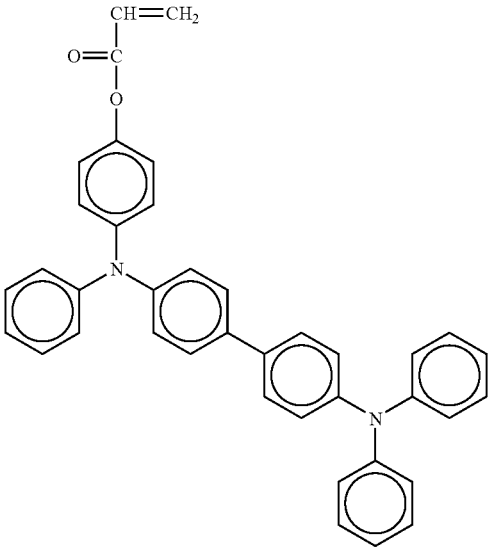
-continued
No. 50
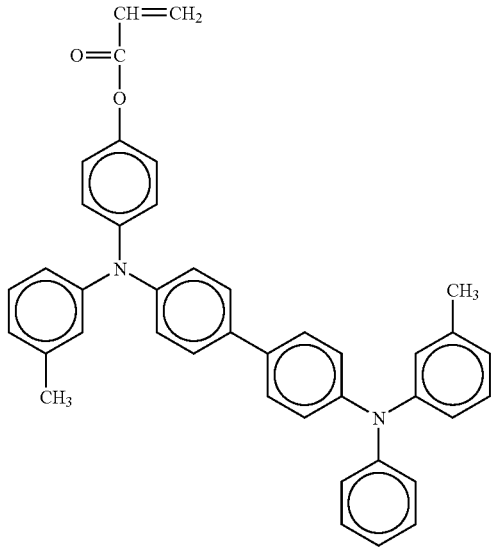
No. 51
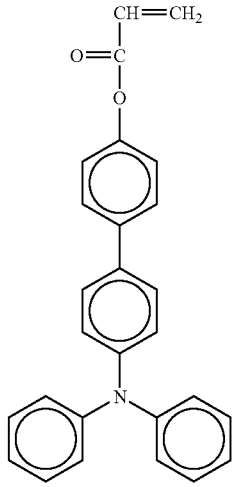
No. 52
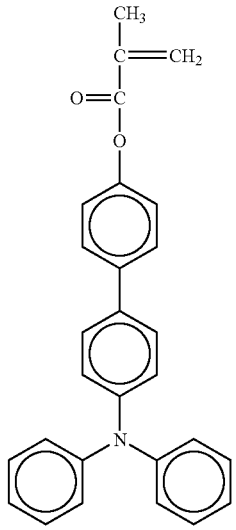

-continued
No. 53
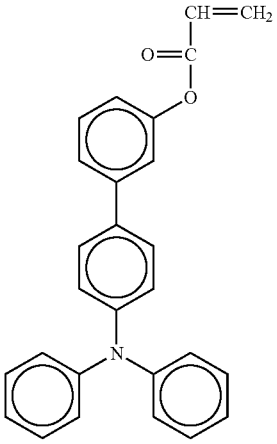
No. 54
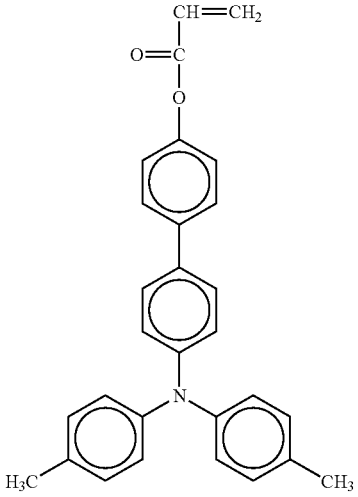
No. 55
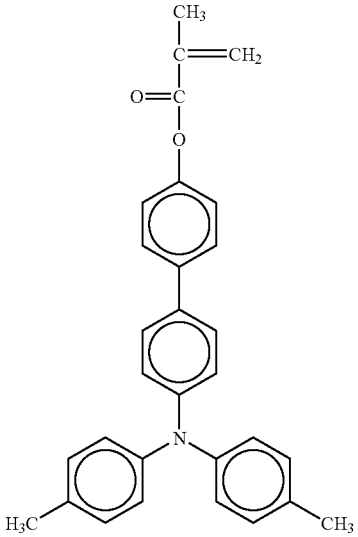
-continued
No. 56
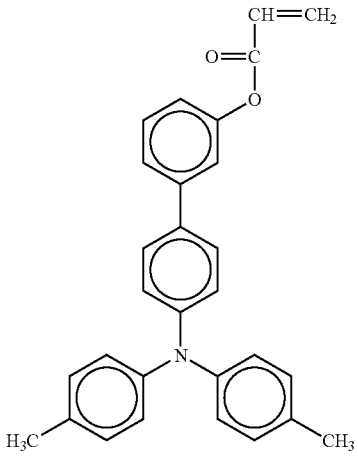
No. 57
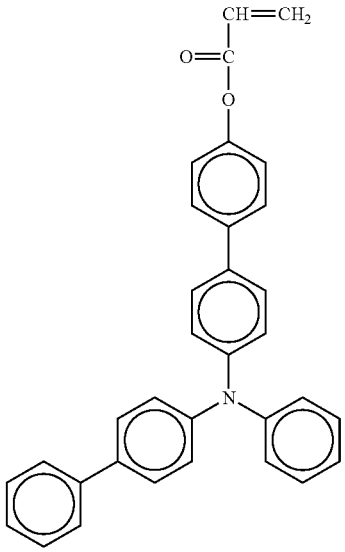
No. 58
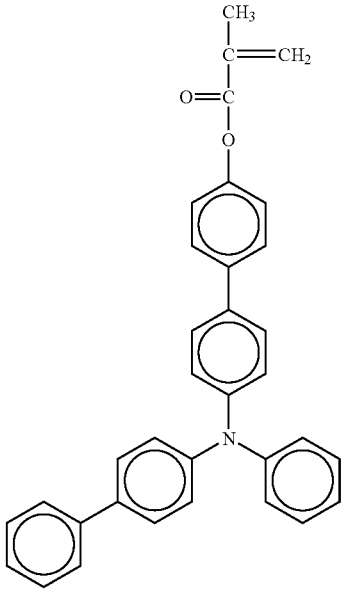

-continued
No. 59
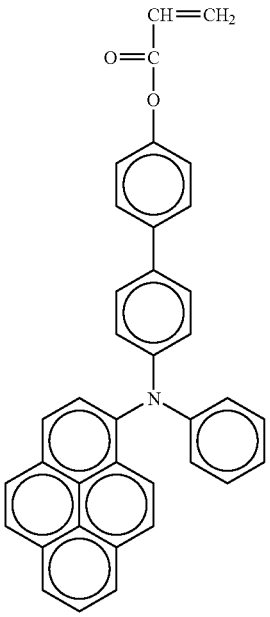
No. 60
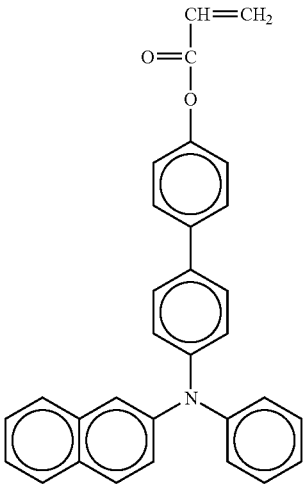
No. 61
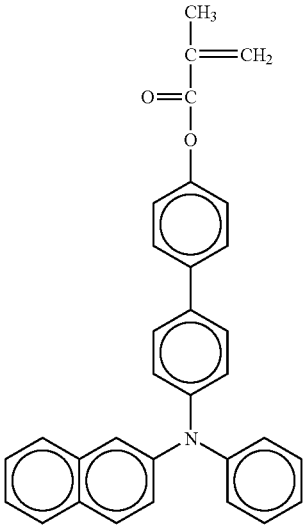
-continued
No. 62
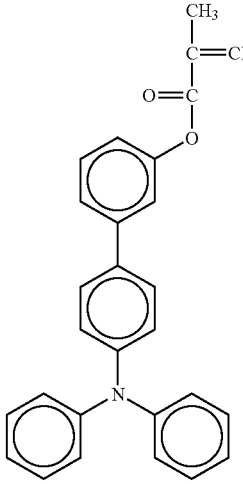
No. 63
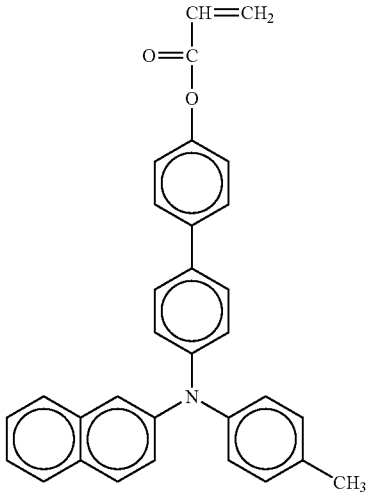
No. 64
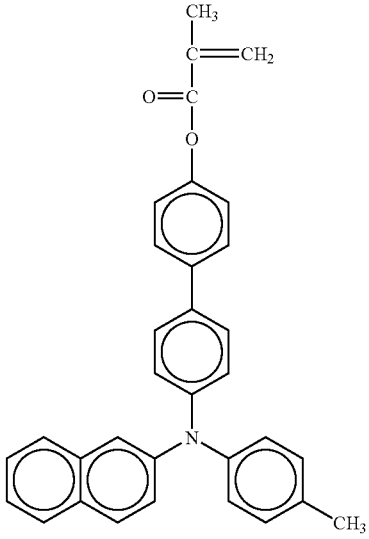

-continued
No. 65
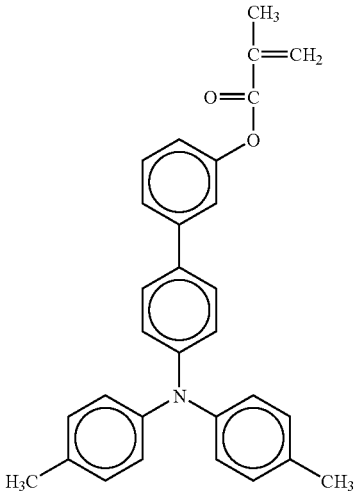
No. 66
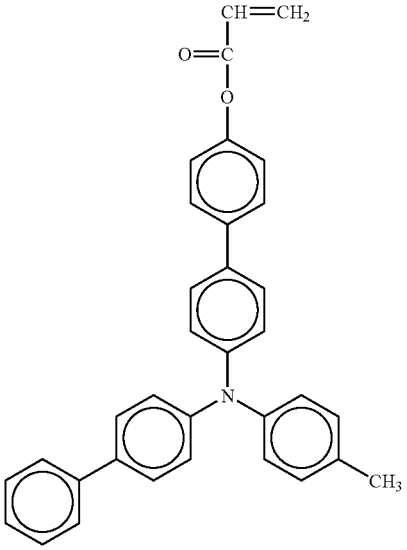
No. 67
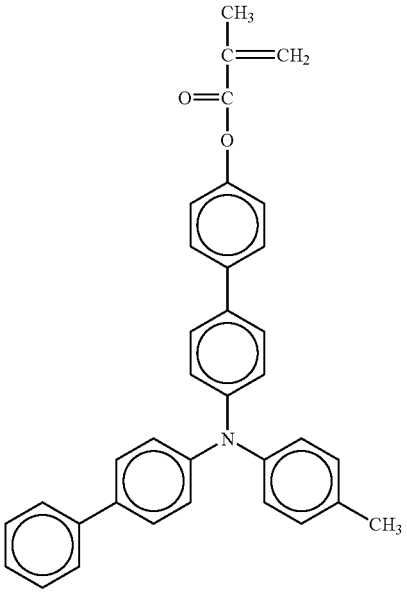
-continued
No. 68
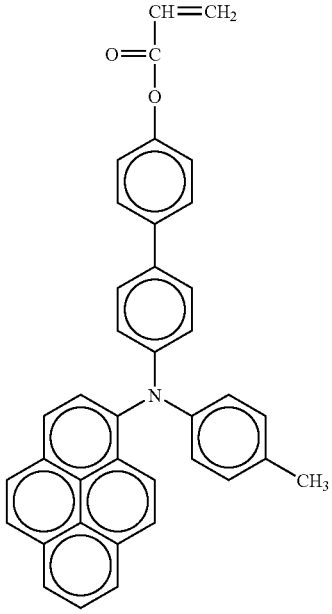
No. 69
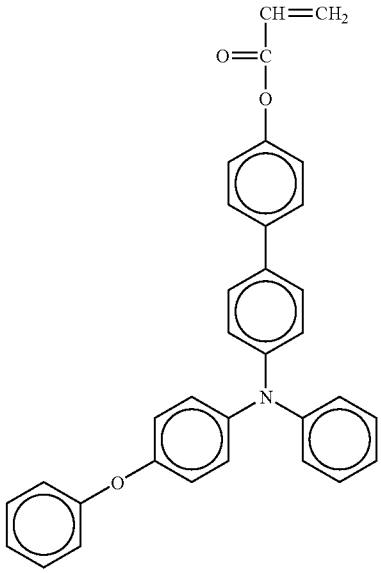

-continued
No. 70
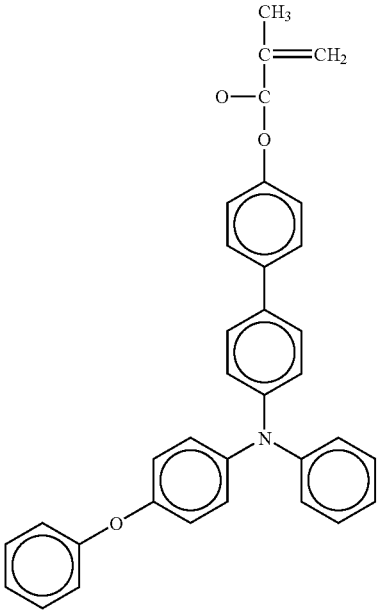
No. 71
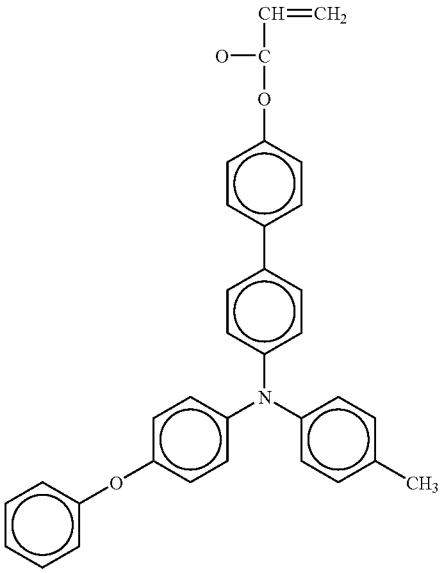
-continued
No. 72
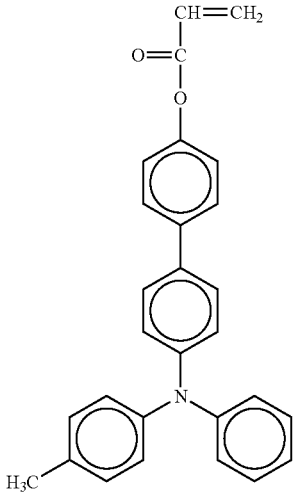
No. 73
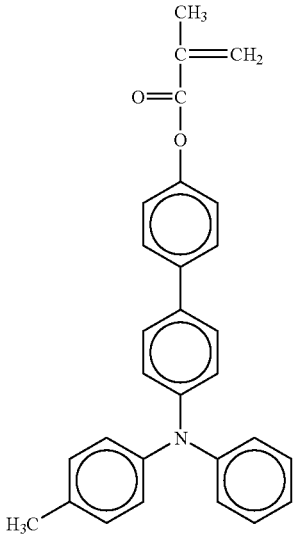
No. 74
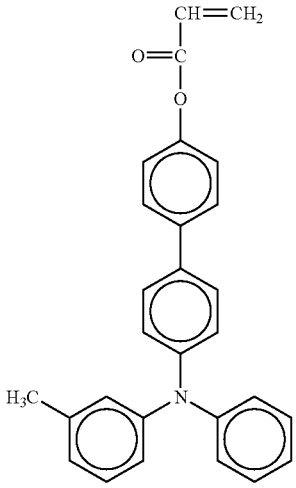

-continued
No. 75
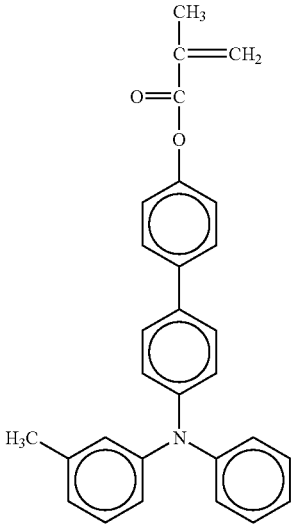
No. 76
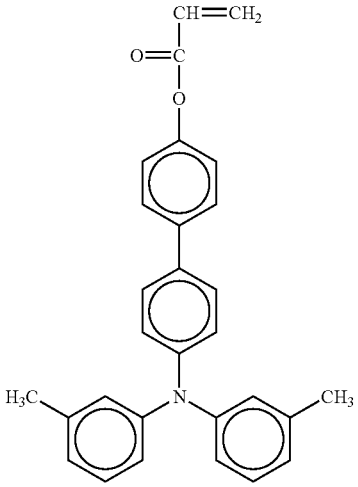
No. 77
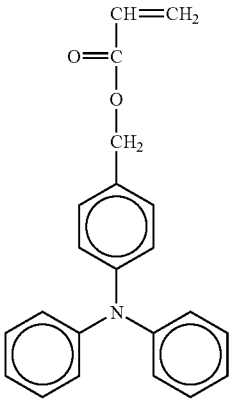
-continued
No. 78
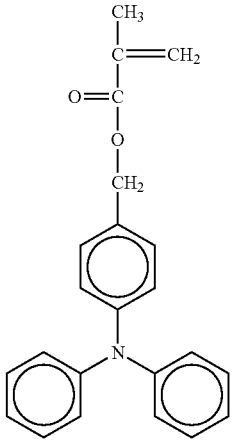
No. 79
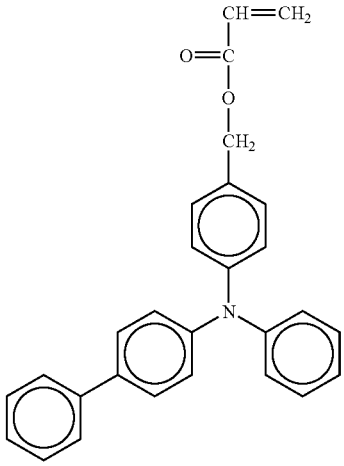
No. 80
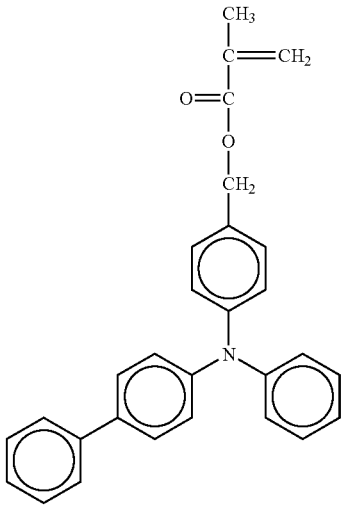

-continued
No. 81
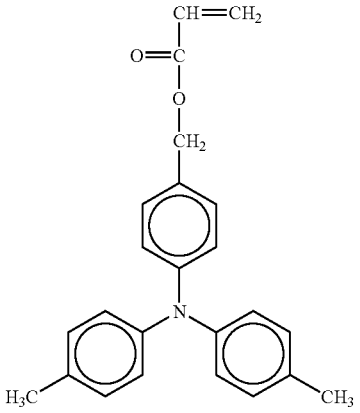
No. 82
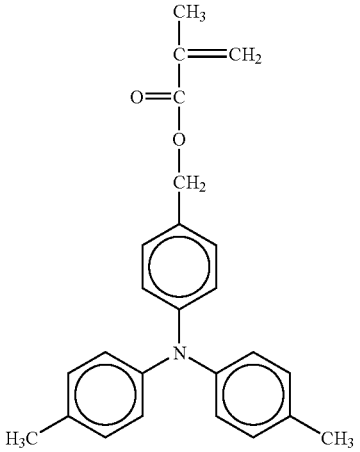
No. 83
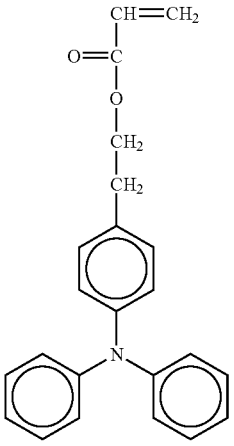
-continued
No. 84
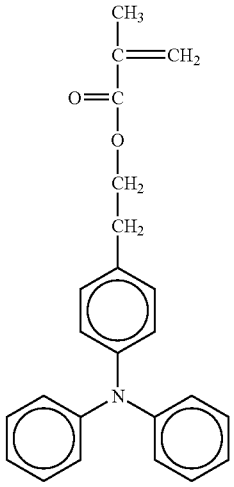
No. 85
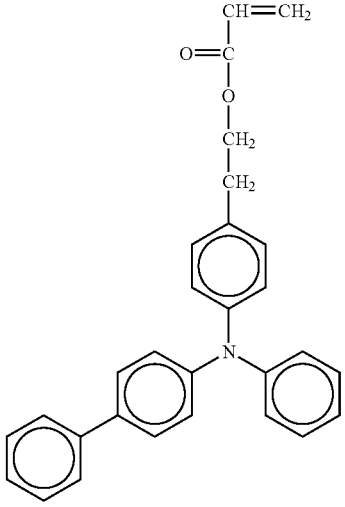
No. 86
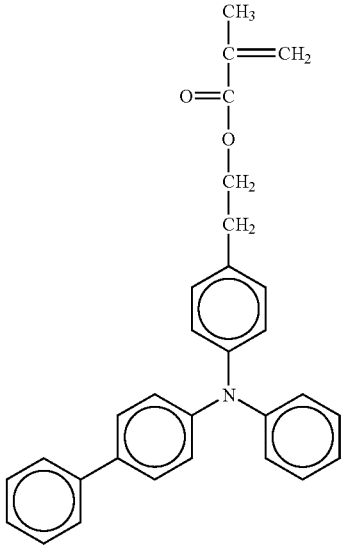

-continued
No. 87
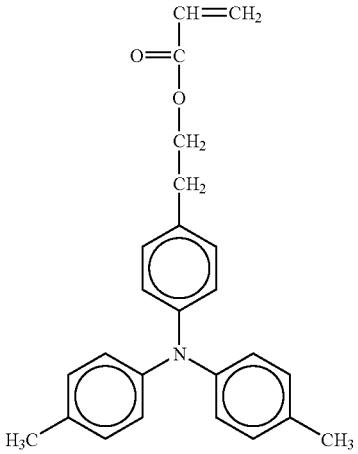
No. 88
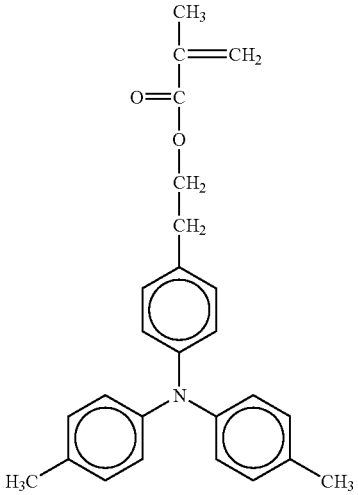
No. 89
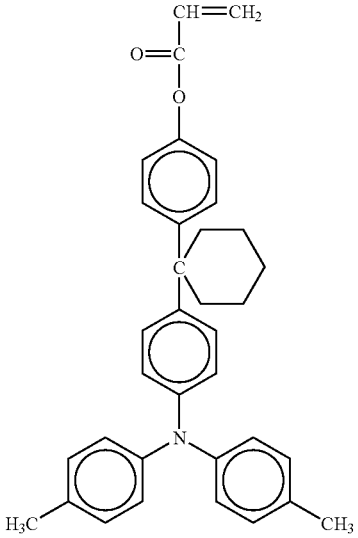
-continued
No. 90
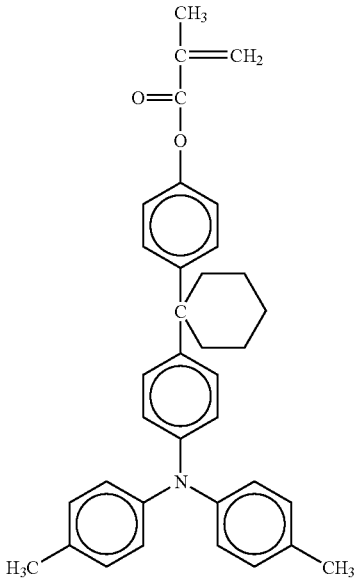
No. 91
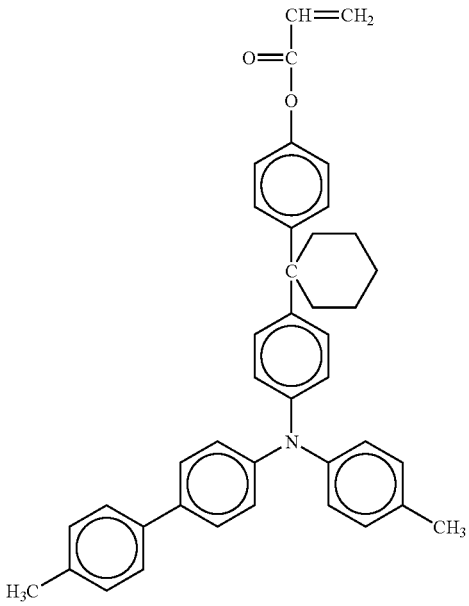

-continued
No. 92
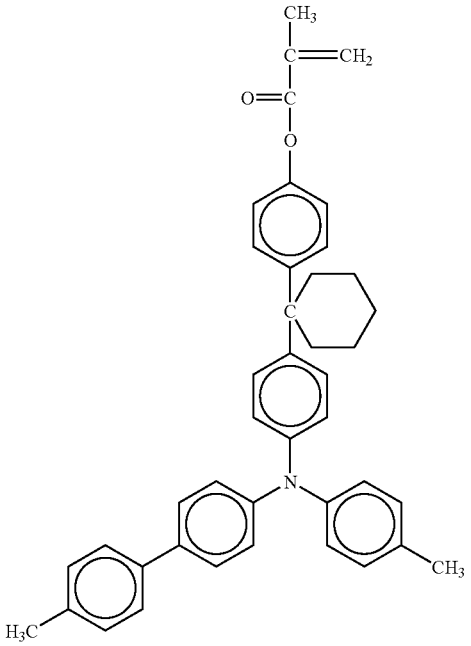
-continued
No. 94
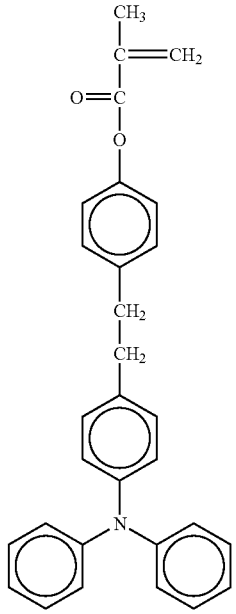
No. 93
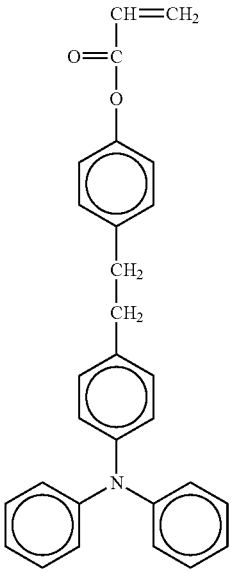
No. 95
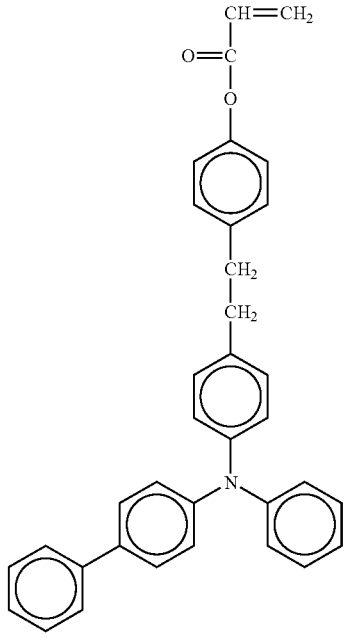

-continued
No. 96
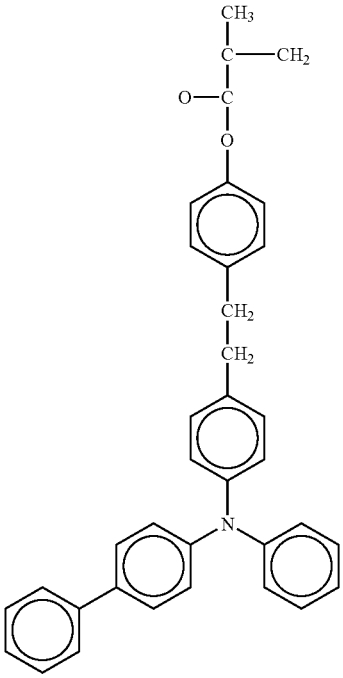
-continued
No. 98
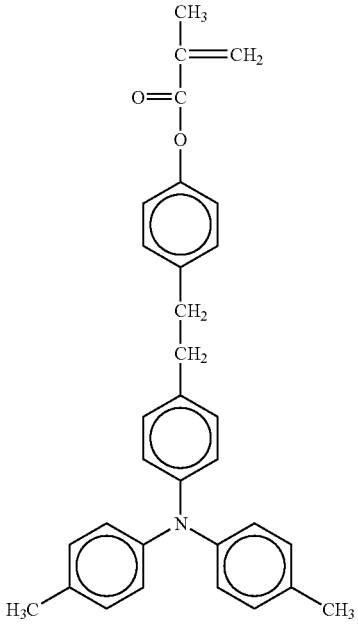
No. 97
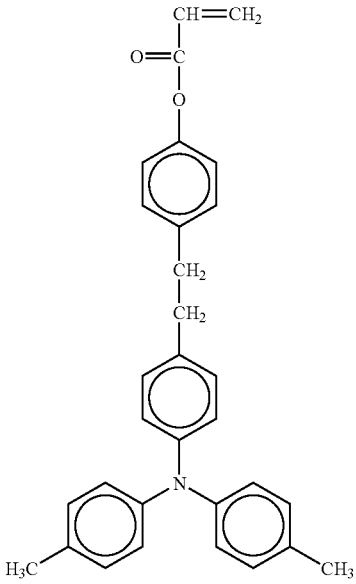
No. 99
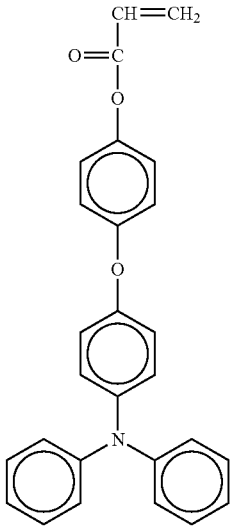

-continued
No. 100
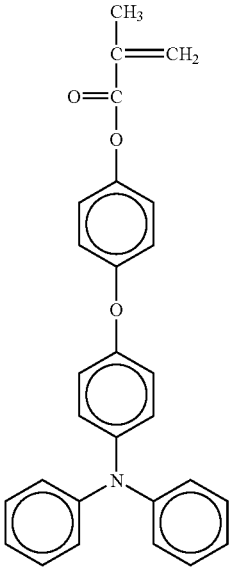
-continued
No. 102
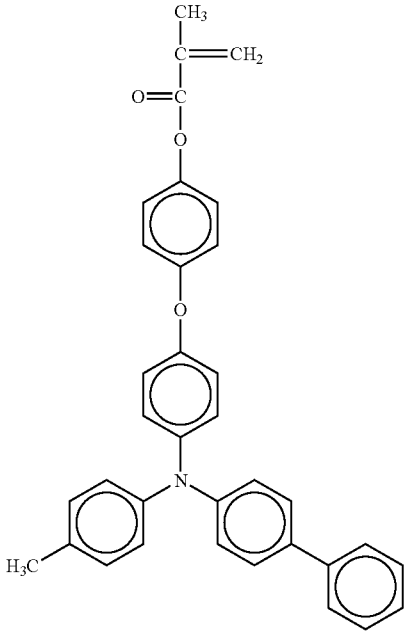
No. 101
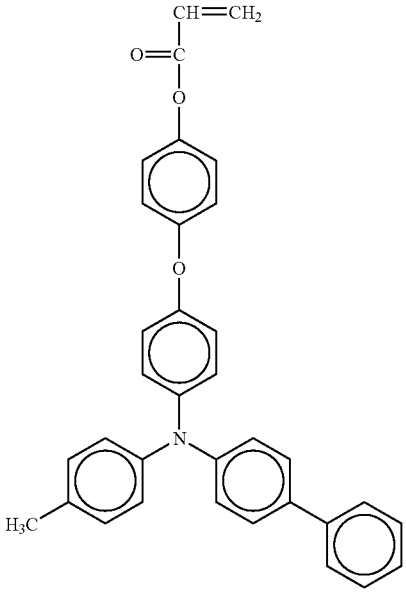
No. 103
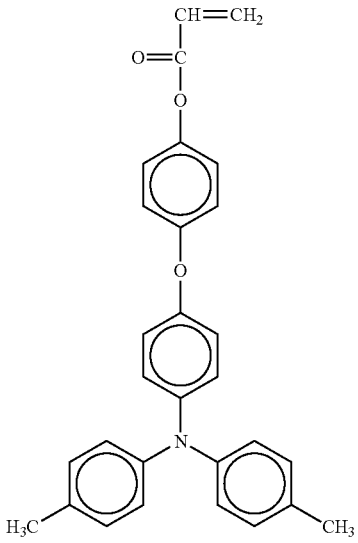

-continued
No. 104
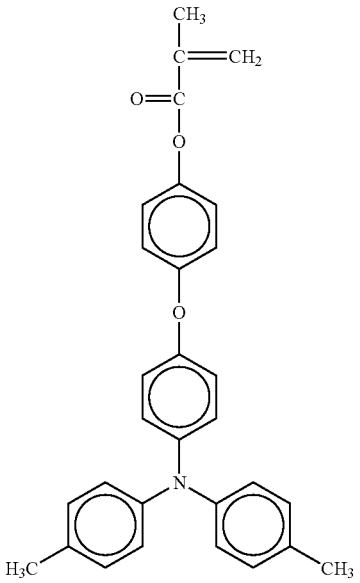
No. 105
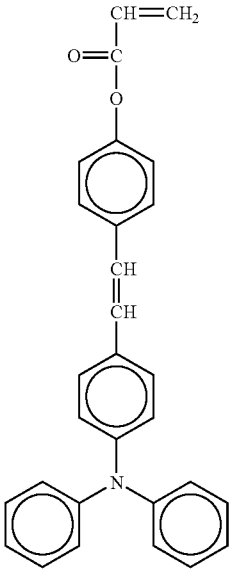
-continued
No. 106
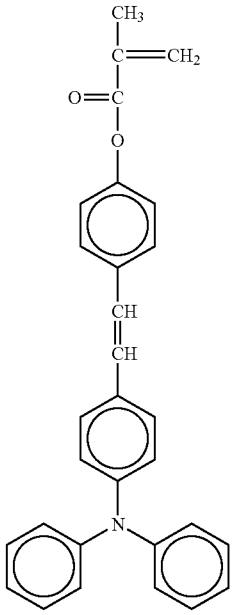
No. 107
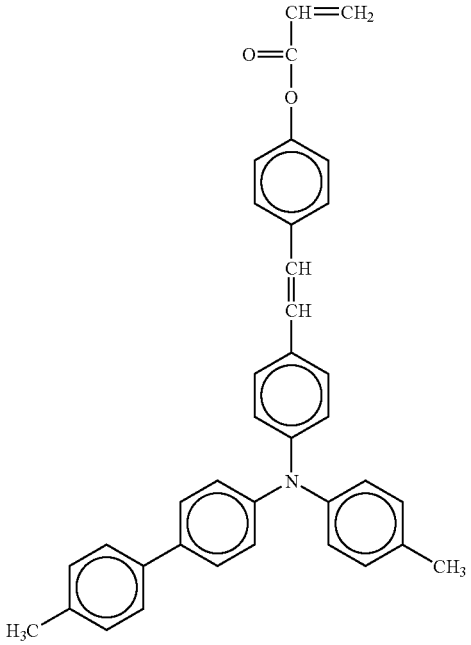

-continued
No. 108
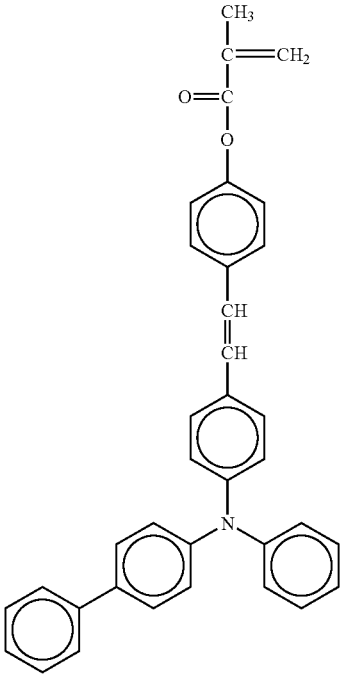
No. 109
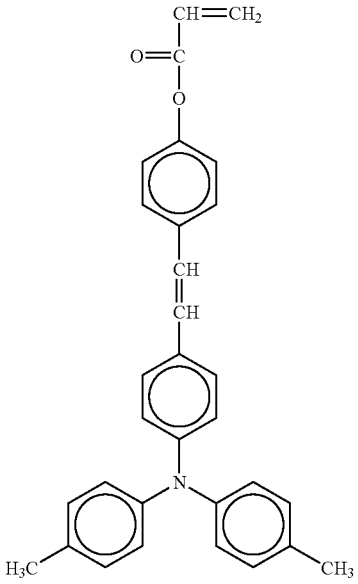
-continued
No. 110
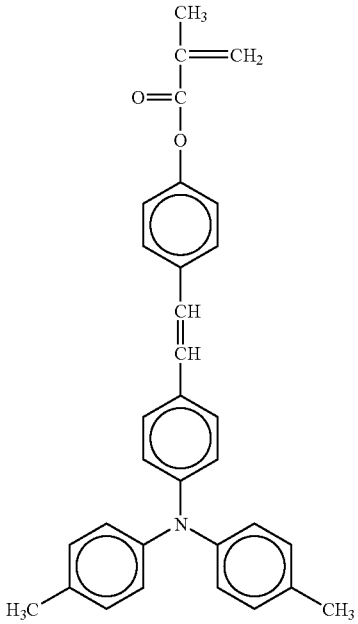
No. 111
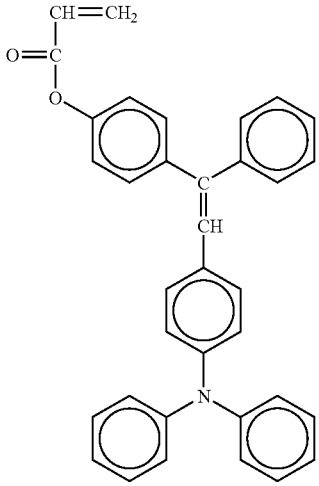
No. 112
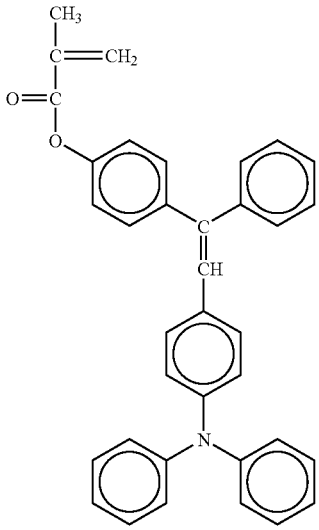

-continued
No. 113
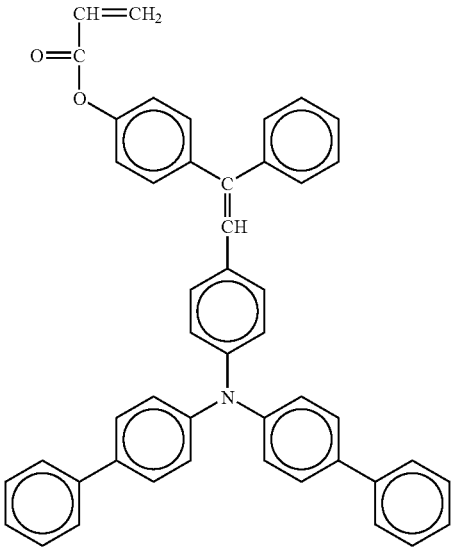
No. 114
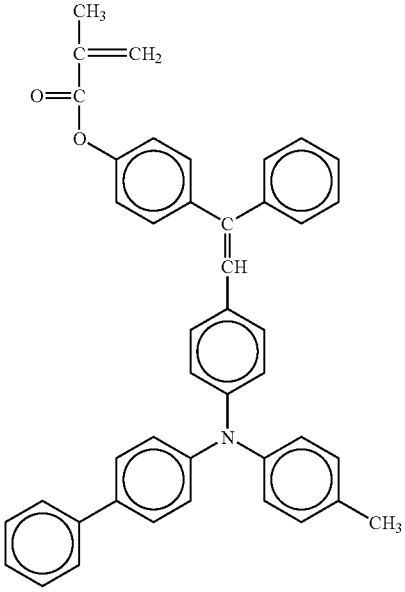
No. 115
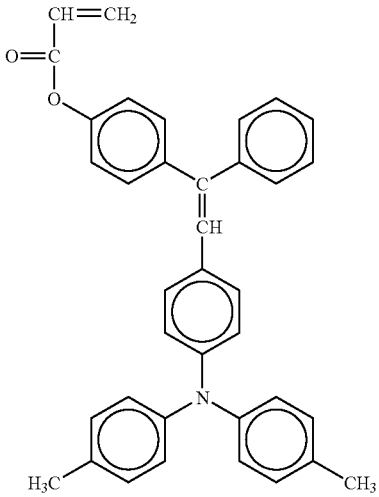
-continued
No. 116
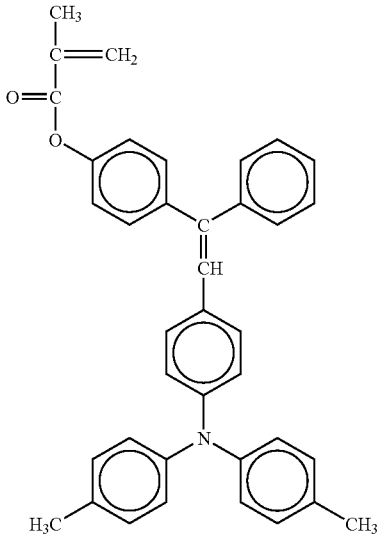
No. 117
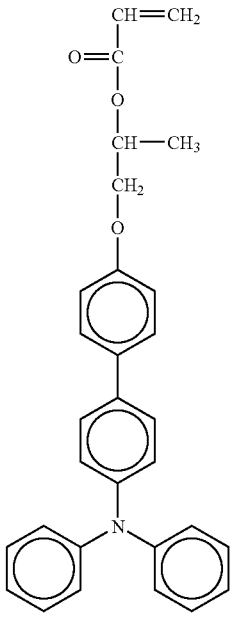

-continued
No. 118
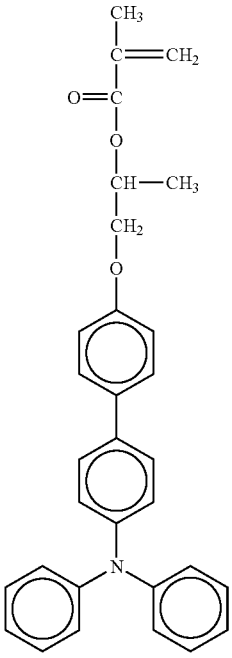
-continued
No. 120
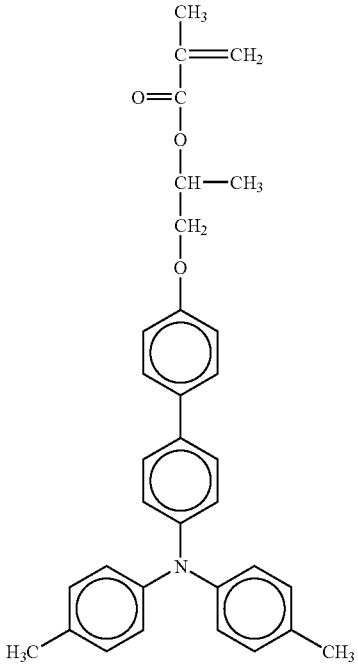
No. 119
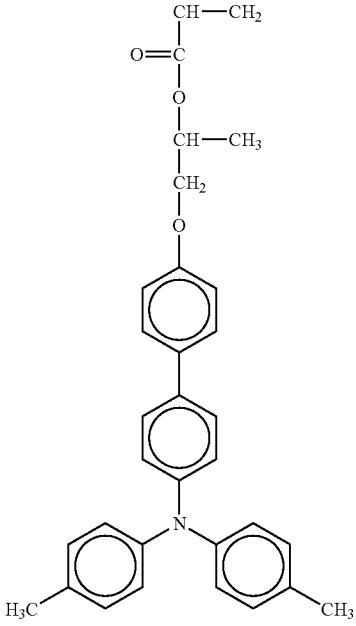
No.121
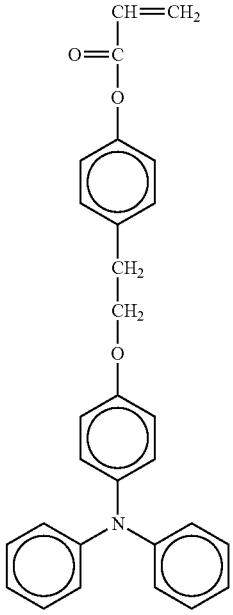

-continued
No. 122
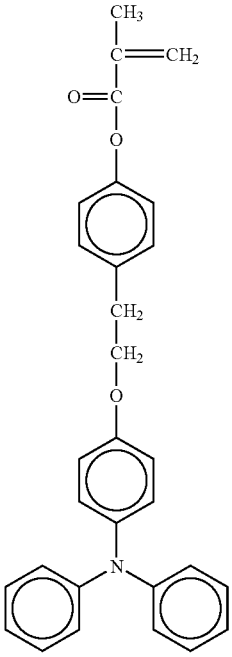
No. 123
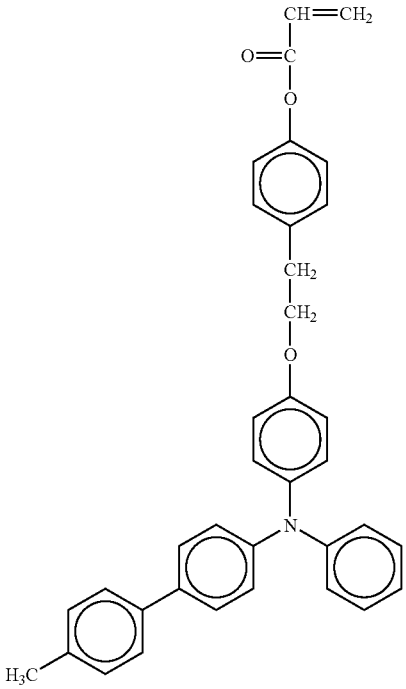
-continued
No. 124
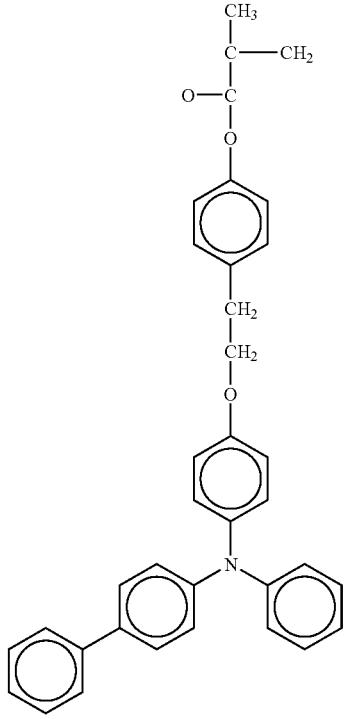
No. 125
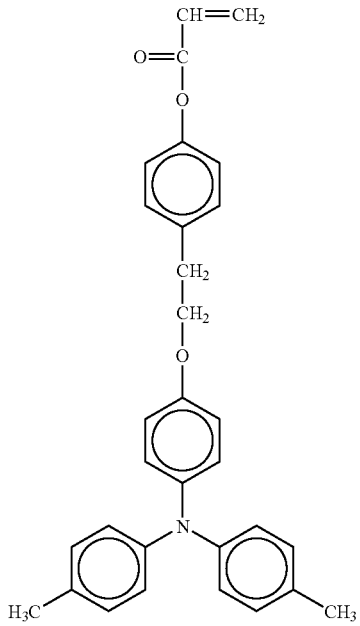

-continued
No. 126
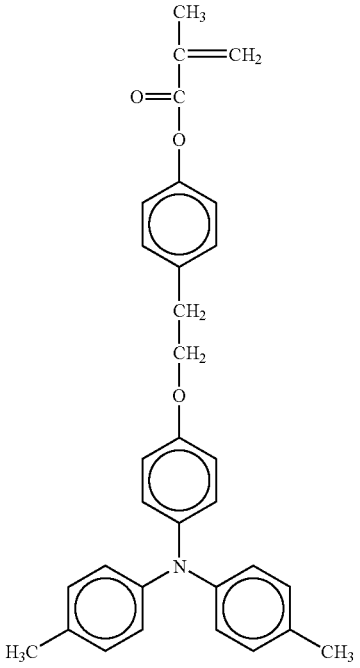
No. 127
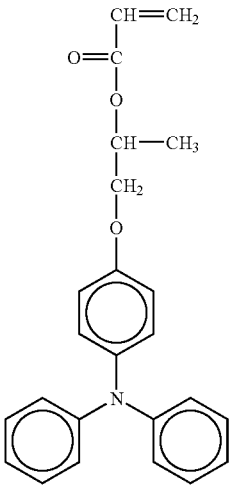
-continued
No. 128
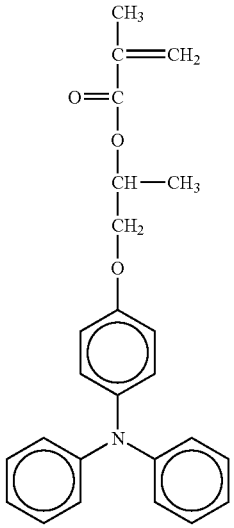
No. 129
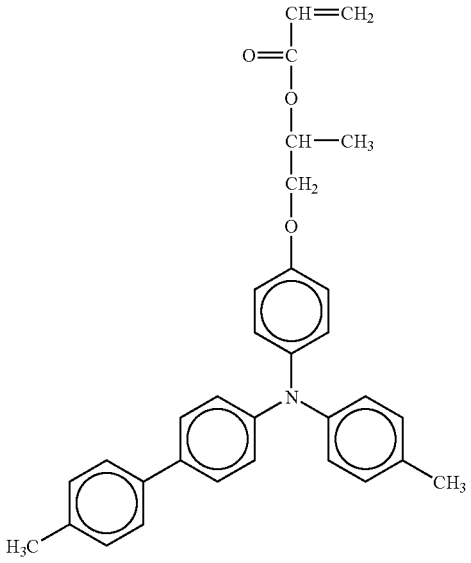

-continued
No.130
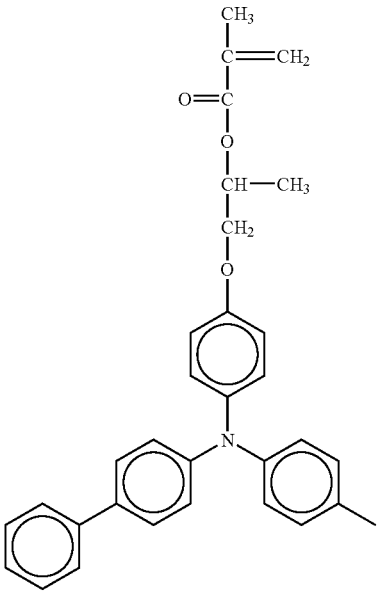
No. 131
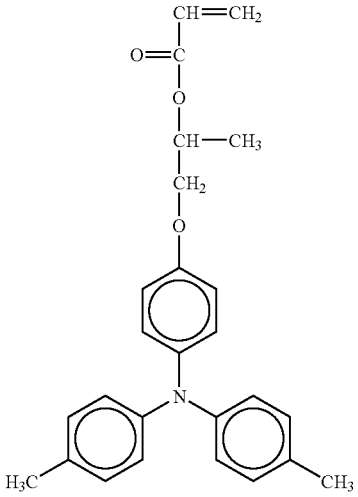
No. 132
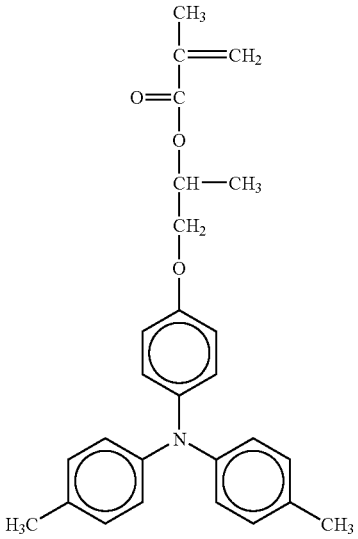
-continued
No. 133
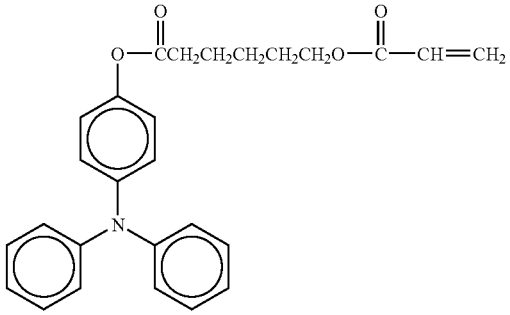
No. 134
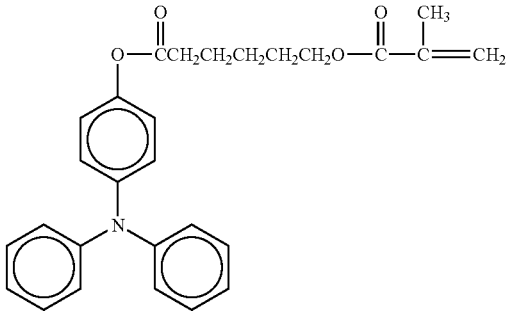
No. 135
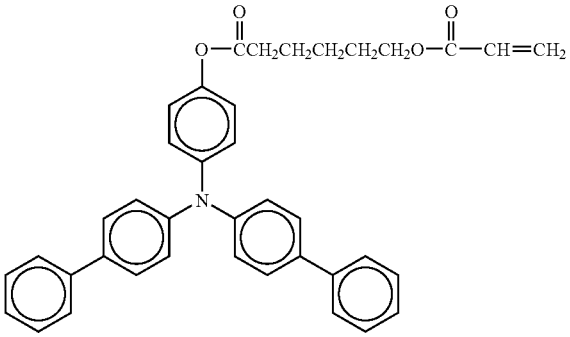
No.136
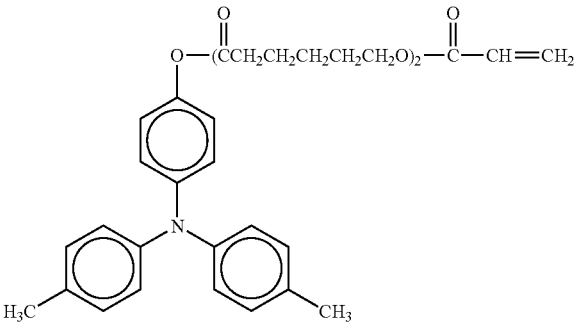

-continued
No. 137
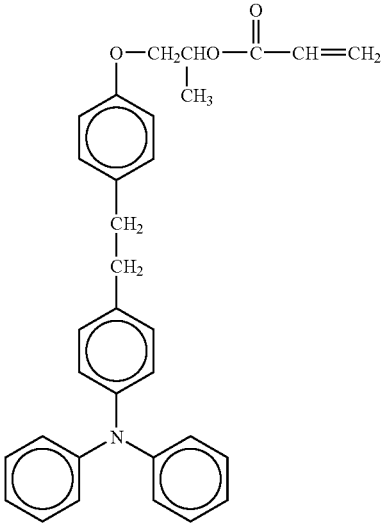
No. 138
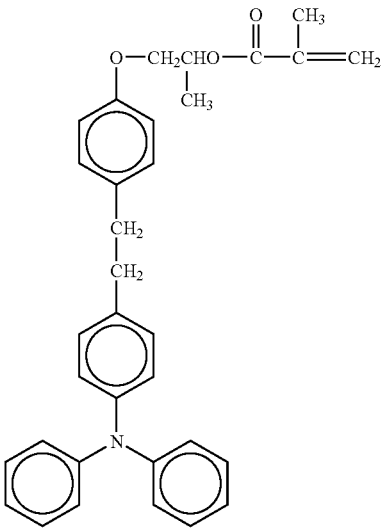
-continued
No. 139
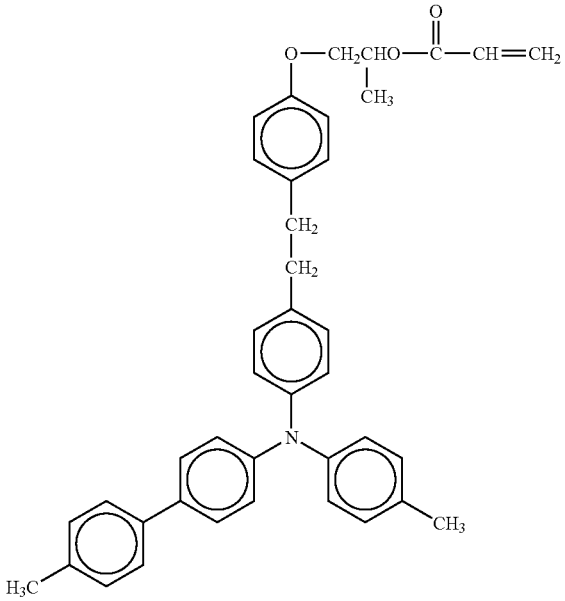
No. 140
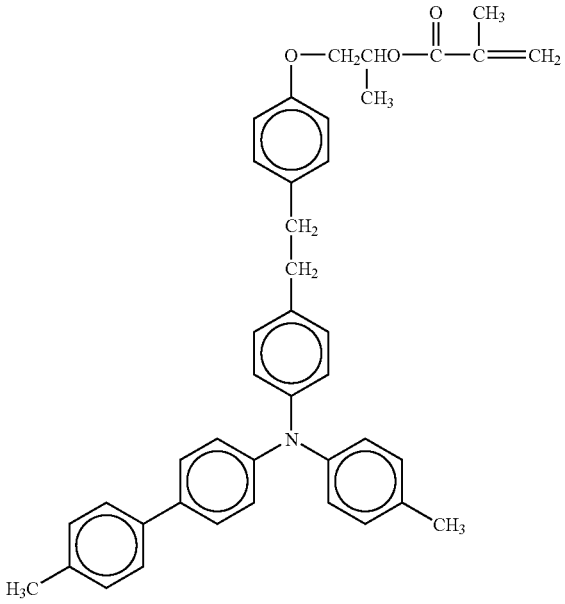

-continued
No. 141
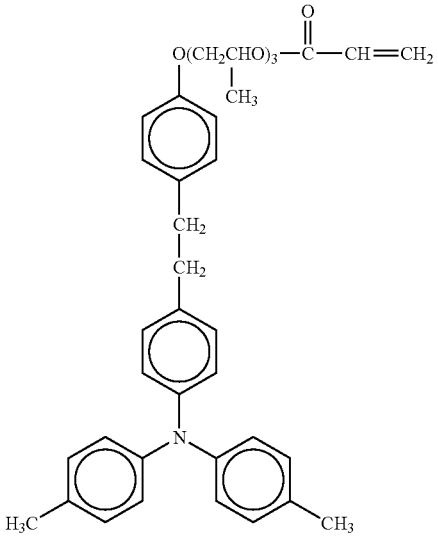
No. 142
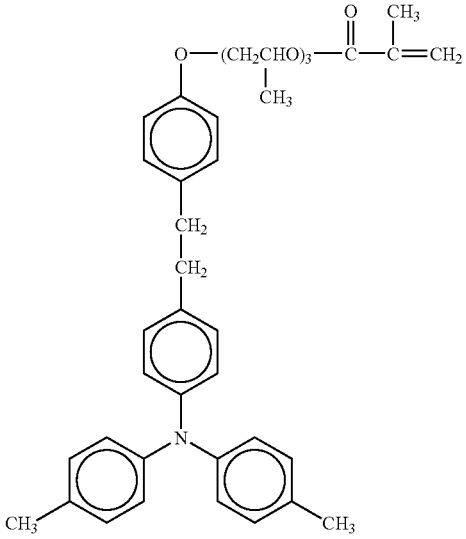
No. 143
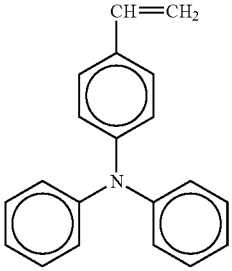
-continued
No. 144
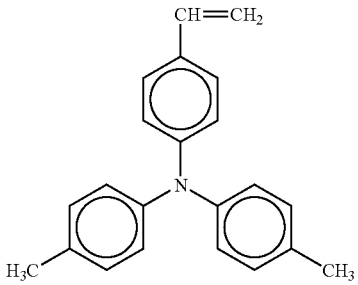
No. 145
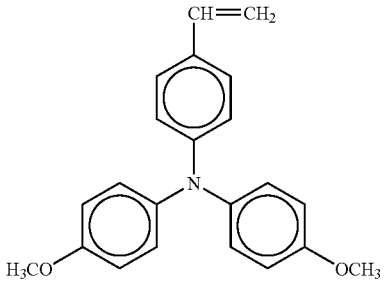
No. 146
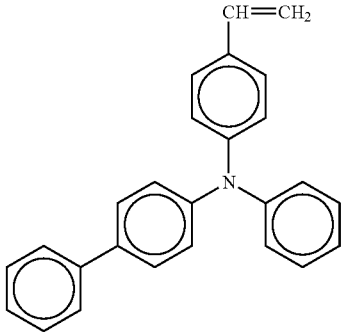
No. 147
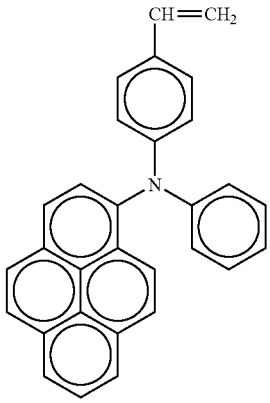
No. 148
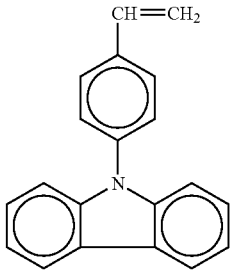

-continued
No. 149
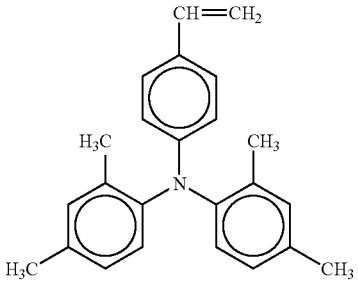
No. 150
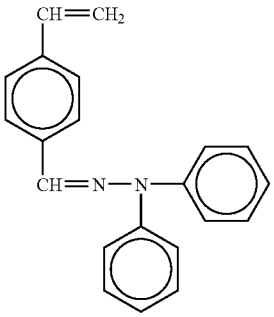
No.151
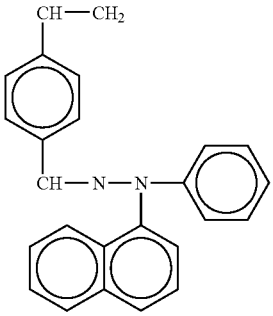
No. 152
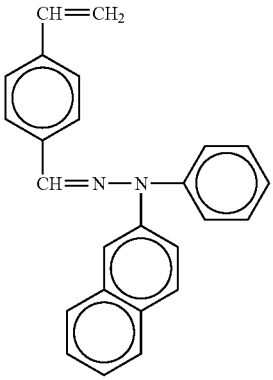
No. 153
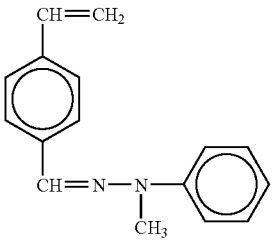
-continued
No. 154
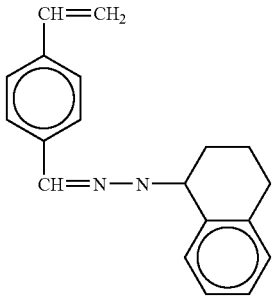
No. 155
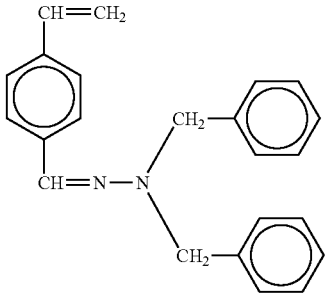
No. 156
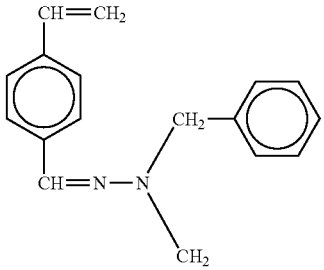
No. 157
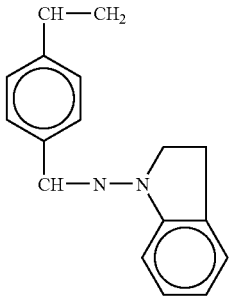
No. 158
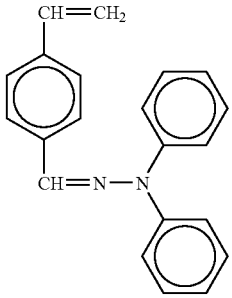

-continued

No. 159

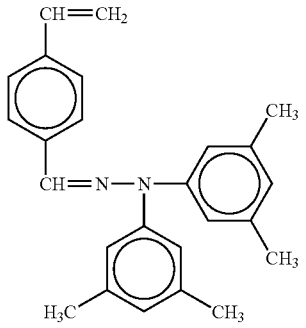

No. 160

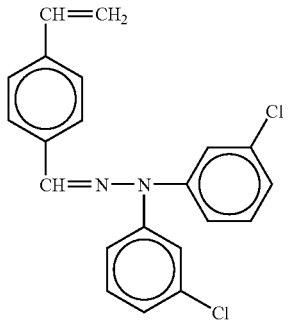

Also, the mono-functional radical polymerizable compound having a charge transporting structure used in the present invention is important, since it provides for the cross-linked surface layer with charge transporting ability. This ingredient is 20% to 80% by weight, preferably 30% to 70% by weight, based on the total amount of the cross-linked surface layer. If this ingredient is less than 20% by weight, the charge transporting ability of the cross-linked surface layer can not be sufficiently maintained, thereby causing deterioration of electrical properties such as reduction of sensitivity, increase of residual potential and the like owing to repeated use. If it exceeds 80% by weight, the content of tri-functional monomer without having a charge transporting structure is reduced, whereby the cross-linked density is reduced and high abrasion resistance cannot be attained. Though it is impossible to uniformly mention the added amount of this ingredient since the required electrical properties and abrasion resistance vary according to processes to be used, the amount is most preferably in the range of 30 to 70% by weight considering balance between two properties.

The surface layer according to the present invention is formed by curing at least a tri- or more-functional radical polymerizable monomer without having a charge transporting structure and a mono-functional radical polymerizable compound having a charge transporting structure. However, in order to control viscosity during coating, to relieve stress of the cross-linked surface layer, to lower the surface energy or to reduce friction coefficient, a mono-functional and bi-functional radical polymerizable monomer or radical polymerizable oligomer may be combinedly used. As the radical polymerizable monomer and the oligomer, known substances can be used.

Examples of the mono-functional radical monomer include 2-ethylhexyl acrylate, 2-hydroxyethyl acrylate, 2-hydroxypropyl acrylate, tetrahydrofurfuryl acrylate, 2-ethylhexylcarbitol acrylate, 3-methoxybutyl acrylate, benzyl acrylate, cyclohexyl acrylate, isoamyl acrylate, isobutyl acrylate, methoxytriethyleneglycol acrylate, phenoxytetraethyleneglycol acrylate, cetyl acrylate, isotearyl acrylate, stearyl acrylate, styrenemonomer and the like Examples of the bi-functional radical polymerizable monomer include 1,3-butanediol diacrylate, 1,4-butanediol diacrylate, 1,4-butanediol dimethacrylate, 1,6-hexanediol diacrylate, 1,6-hexanediol dimethacrylate, diethyleneglycol diacrylate, neopentylglycol diacrylate, EO-modified bisphenol A diacrylate, EO-modified bisphenol F diacrylate, neopentylglycoldiacrylate and the like.

Examples of the functional monomer include a fluorinated monomer such as octafluoropentylacrylate, 2-perfluorooctylethyl acrylate, 2-perfluorooctylethyl methacrylate, 2-perfluoroisononylethyl acrylate and the like, a vinyl monomer, acrylate and methacrylate having a polysiloxane group such as acryloylpolydimethylsiloxaneethyl, methacryloylpolydimethylsiloxaneethyl, acryloylpolydimethylsiloxanepropyl, acryloylpolydimethylsiloxanebutyl, diacryloylpolydimethylsiloxanediethyl and the like, which have 20 to 70 siloxane repeating units, as described in JP-B No. 5-60503, JP-B No. 6-45770.

The radical polymerizable oligomer include, for example, epoxy acrylate, urethane acrylate and polyester acrylate oligomers. However, when a large amount of a mono- and bi-functional radical polymerizable monomer or radical polymerizable oligomer is added, the 3-dimensional cross-linkage density of the cross-linked surface layer is substantially reduced, causing reduction of abrasion resistance. Therefore, the content of these monomers or oligomers is limited 50 parts by weight or less, preferably 30 parts by weight or less, relative to 100 parts by weight of the tri- or more-functional radical polymerizable monomer.

Also, the surface layer according to the present invention is formed by curing at least a tri- or more-functional radical polymerizable monomer without having a charge transporting structure and a mono-functional radical polymerizable compound having a charge transporting structure but may further comprise a polymerization initiator in the surface layer, as needed, to effectively perform the cross-linking reaction.

Examples of the thermal polymerization initiator include a peroxide type initiators such as 2,5-dimethylhexane-2,5-dihydroperoxide, diqumyl peroxide, benzoylperoxide, t-butylqumyl peroxide, 2,5-dimethyl-2,5-di (peroxybenzoyl) hexene-3, di-t-butylperoxide, t-butylhydroperoxide, qumene hydroperoxide, lauroyl peroxide and the like, and an azo type initiator such as azobisisobutylnitrile, azobiscyclohexanecarbonitrile, methyl azobisisobutyrate, azobisisobutylamidine hydrochloride, 4,4'-azobis-4-cyanovaleroic acid and the like.

Examples of the photopolymerization initiator include an acetophenone type initiator such as diethoxyacetophenone, 2,2-dimethoxy-1,2-diphenylethan-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1, 2-hydroxy-2-methyl-1-phenylpropane-1-one, 2-methyl-2-morpholino(4-methylthiophenyl)propane-1-one, 1-phenyl-1,2-propanedione-2-(o-ethoxycarbonyl)oxime and the like or a ketal type photopolymerization initiator, a benzoinether type photopolymerization initiator such as benzoin, benzoinmethyl ether, benzoinethylether, benzoinisobutylether, benzoinisopropyl ether and the like, a benzophenone type photopolymerization initiator such as benzophenone, 4-hydroxybenzophenone, methyl o-benzoylbenzoate, 2-benzoylnaphthalene, 4-benzoylbiphenyl, 4-benzoylphenylether, acrylated benzophenone, 1,4-benzoylbenzene and the like, a thioxanthone type photopolymerization initiator such as 2-isopropylthioxanthone, 2-chlorothioxanthone, 2,4-dimethylthioxanthone, 2,4-diethylthioxanthone, 2,4-dichlorothioxanthone and the like, and other examples of the photopolymerization initiator include such as ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide, bis(2,4-dimethoxybenzoyl)-2,4,4-trimethylpentylphosphine oxide, methylphenylglyoxyester, 9,10-phenanthrene compounds, acridine compounds, triazine compounds, imidazole compounds and the like. Also, it is possible to use a compound capable of promoting photopolymerization alone or in combination with the photopolymerization initiator, which, for example, includes triethanolamine, methyldiethanolamine, ethyl 4-dimethylaminobenzoate, isoamyl 4-dimethylaminobenzoate, (2-dimethylamino)ethylbenzoate, 4,4'-dimethylaminobenzophenone and the like.

The foregoing polymerization initiators may be used as a mixture of one or more thereof. The content of the polymerization initiator is 0.5 to 40 parts by weight, preferably 1 to 20 parts by weight relative to 100 parts by weight of the total amount of the radical polymerizable component.

Also, the coating solution according to the present invention may contain various additives such as a plasticizer (for the purpose of relieving stress and improving adhesion), a leveling agent, a low molecular charge transporting material non-reactive with radical and the like, as needed. These additives may be any of those known to the art. The plasticizer which can be used in the present invention includes those commonly used in a resin, such as dibutylphthalate, dioctylphthalate and the like, and its added amount is limited to 20% by weight or less, preferably 10% by weight or less, relative to the total solid content of the coating solution. Also, the leveling agent which can be used in the present invention include silicone oils such as dimethyl silicone oil, methylphenyl silicone oil and the like, or polymers or oligomers having a perfluoroalkyl group in a side chain and its added amount is suitably 3% by weight or less, relative to the total solid content of the coating solution.

The cross-linked surface layer according to the present invention is formed by applying a coating solution comprising at least a tri- or more-functional radical polymerizable monomer without having a charge transporting structure and a mono-functional radical polymerizable compound having a charge transporting structure, followed by curing. When the radical polymerizable monomer is a liquid, the coating solution may be applied with another ingredient dissolved therein. Also, it may be diluted in a solvent before application, as needed. Here, examples of the usable solvent include alcohols such as methanol, ethanol, propanol, butanol and the like, ketones such as acetone, methylethylketone, methyl isobutylketone, cyclohexanone and the like, esters such as ethyl acetate, butyl acetate and the like, ethers such as tetrahydrofuran, dioxane, propylether and the like, halogenated compounds such as dichloromethane, dichloroethane, tolly chloroethane, chlorobenzene and the like, aromatics such as benzene, toluene, xylene and the like, and cellosolves such as methylcellosolve, ethylcellosolve, cellosolve acetate and the like. These solvents may be used alone or as a mixture of two or more thereof. The dilution in the solvent varies according to solubility of the composition, coating process and desired membrane thickness and is not particularly limited. The coating is performed by dipping coating, spray coating, bead coating, ring coating and the like.

According to the present invention, after the coating solution is applied, curing is carried out by applying an external energy to form a cross-linked surface layer. Here, examples of the external energy which can be used include heat, light and radiation. The process for applying heat energy is carried out by heating from the coating surface side or substrate side using air, gas of for example nitrogen, vapor, or various heating media, far infrared rays, electronic wave. The heating temperature is preferably between 100° C. and 170° C. When it is less than 100° C., reaction rate is slow and not completely finished. When it is higher than 170° C., the reaction progresses nonuniformly, causing a large distortion in the cross-linked surface layer. In order to uniformly progress the curing, it is an effective way to complete the reaction by heating at a relatively low temperature of less than 100° C. and further heating at 100° C. or higher. The light energy which can be used includes UV irradiating source such as a high pressure mercury lamp and metal halide lamp having a light emitting wavelength mainly in the UV region. Also, it is possible to select a visible light source in accordance with the absorption wave length of the radical polymerizable components or photopolymerization initiators. The irradiation amount is preferably from 50 $mW/cm^2$ to, 1000 $mW/cm^2$. If it is less than 50 $mW/cm^2$, the curing takes much time. If it is stronger than 1000 $mW/cm^2$, the reaction nonuniformly progresses, whereby the roughness of the cross-linked surface layer becomes severe. The irradiation energy includes those using electronic rays. Among the foregoing energies, owing to easiness of controlling the reaction rate and convenience of the apparatus, heat and light energy may be effectively used.

A suitable thickness of the surface crosslinked layer should be set depending on the layer structure of the photoconductor and will be described later with reference to the layer structure.

Another feature of the present invention is that the surface crosslinked layer has an elastic displacement $\tau e$ of 35% or more with a standard deviation of 2% or less.

Figure 1B:
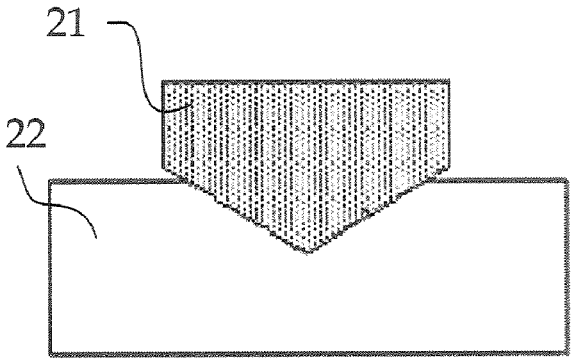
Figure 1C:
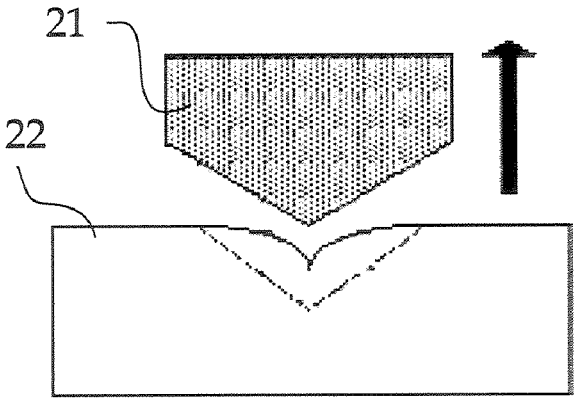
Figure 2:
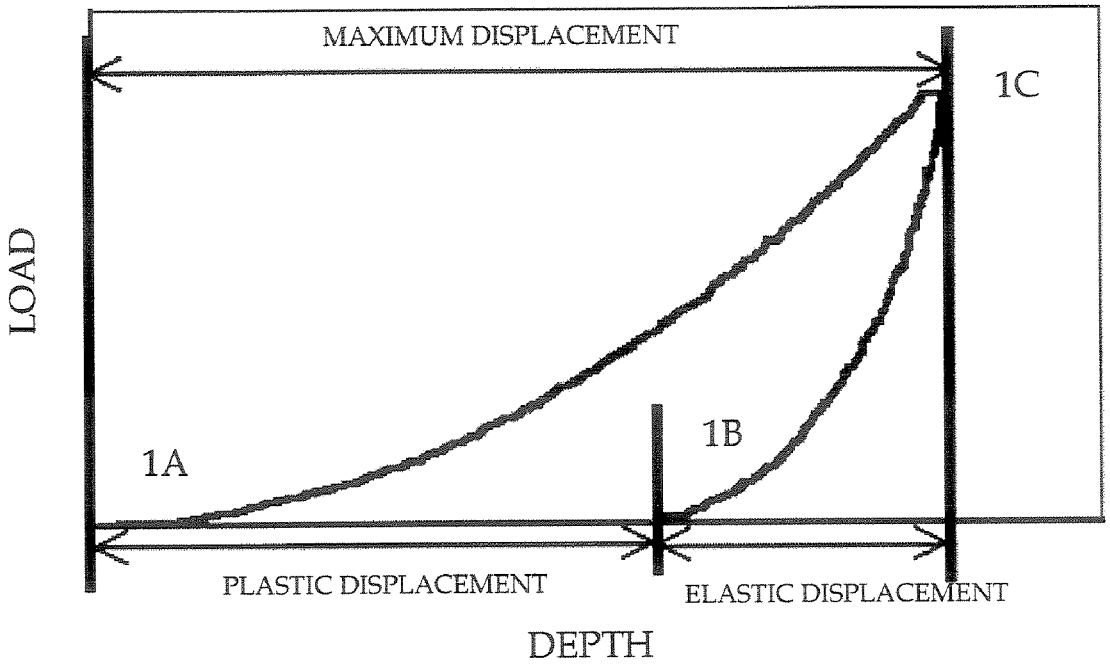
FIG. 2 shows schematic graph of a depressed depth-load curve for measurement of elasticity displacement rate according to the present invention.

The elastic displacement $\tau e$ herein can be determined in a test using a micro surface hardness tester with a diamond indenter in which a load is applied and then removed. With reference to FIGS. 1A, 1B, and 1C, the indenter 21 is pressed into a sample 22 at a predetermined loading rate from the point (FIG. 1A) at which the indenter 21 comes in contact with the sample 22 (loading process), the indenter 21 is posed for a predetermined time at a maximum displacement (FIG. 1B) at which the load reaches the predetermined value, the indenter 21 is then pulled out at a predetermined removing rate (load removing process), and the point at which no load is applied to the indenter 21 is defined as a plastic displacement (FIG. 1C). A curve between the depth of the indenter and the load is plotted as in FIG. 2, and the elastic displacement $\tau e$ (%) is determined by calculation according to the following equation from the maximum displacement (1B) and the plastic displacement (1C).

$$\text{Elastic displacement } \tau e(\%)=[(\text{Maximum displacement})-(\text{Plastic displacement})]/(\text{Maximum displacement})\times 100$$

The measurement of the elastic displacement is performed at a predetermined temperature and humidity. The "elastic displacement $\tau e$" as used in the present invention means a measurement in the above test at a temperature of 22° C. and relative humidity of 55%.

A Dynamic Ultra Micro Hardness Tester DUH-201 (trade name, a product of Shimadzu Corp.) and a triangular pyramid indenter (115 degrees) are used herein, but the elastic displacement $\tau e$ can be determined by using any apparatus which have the equivalent performance thereto. The standard deviation of the elastic displacement τe is determined by measuring an elastic displacement τe at arbitrary ten points of a sample and calculating from the ten measurements. In the measurement, a photoconductor having the surface crosslinked layer is formed on an aluminum cylinder, and the resulting article is suitably cut to yield a test piece. The elastic displacement τe is affected by the spring properties of a substrate, and a rigid metal plate or slide glass is preferred as the substrate used in the test. The elastic displacement τe of the surface crosslinked layer is also affected by the hardness and elasticity of lower layers (e.g., the charge transporting layer and the charge generation layer), and the load is set so that the maximum displacement is one-tenths of the thickness of the surface crosslinked layer to thereby reduce such influence. If a surface crosslinked layer alone is formed on the substrate, the conditions in migration of components in the lower layer and adhesion with the lower layer change, and the conditions of the surface crosslinked layer in the photoconductor are not always precisely reproduced.

As is described above, a surface crosslinked layer having an elastic displacement τe less than 35% shows insufficient abrasion resistance. A surface crosslinked layer having an elastic displacement τe with a standard deviation exceeding 2% invites toner filming, since the external additive in the toner or paper dust adheres to a locally weak portion of the surface crosslinked layer. The elastic displacement τe and its standard deviation of the surface crosslinked layer are affected by various factors in a complicated manner, and means for yielding a specific elastic displacement τe cannot be determined univocally. However, it has been clarified that the elastic displacement τe and its standard deviation are affected, for example, by (1) the components and proportions thereof in the coating composition for surface crosslinked layer, (2) the diluent solvent and solid concentration of the coating composition, (3) application procedure, (4) curing procedure and conditions, and (5) solubility of the lower layer.

The coating composition for surface crosslinked layer may comprise a bifunctional or higher radically polymerizable compound having a charge transporting structure and/or a binder resin within ranges not deteriorating the surface smoothness, electric properties and durability of the photoconductor. If the composition contains a bifunctional or higher-functional radically polymerizable compound having a charge transporting structure, the surface crosslinked layer has a relatively high elastic displacement τe due to an increased density of crosslinks. However, bulky hole transporting compound is entangled at a multiplicity of bonds to cause strain in the surface crosslinked layer, and the curing reaction occurs unevenly. Thus, the recuperability to external stress decreases locally, thus inviting an increased standard deviation of the elastic displacement τe. If the coating composition comprises a polymeric material such as a binder resin, the polymeric material has insufficient miscibility with a polymer formed as a result of curing reaction of the radically polymerizable components (trifunctional or higher-functional radically polymerizable monomer and the monofunctional compound having a charge transporting structure) to cause phase separation, thus inviting an increased standard deviation of the elastic displacement τe. In addition, the use of such a polymeric material in a large amount leads to a decreased curing reaction rate and decreased density of crosslinks, and the elastic displacement τe does not reach 35%. Accordingly, the coating composition should preferably not comprise a bifunctional or higher radically polymerizable compound having a charge transporting structure and a binder resin.

If a large amount of a diluent solvent that easily dissolve the lower layer is used in the coating composition, the components of the resin binder and the low-molecular-weight charge transporting material in the lower layer migrate into the surface crosslinked layer to thereby inhibit the curing reaction and invite uneven curing of the surface crosslinked layer as in the use of a large amount of non-curable material in the coating composition. In contrast, if a diluent solvent that does not dissolve the lower layer is used, adhesion between the surface crosslinked layer and the lower layer decreases. Thus, crater-shaped cissing occurs in the surface crosslinked layer due to volume shrinkage during the curing reaction, and the lower layer having a low elastic displacement is partially exposed from the surface. This problem can be solved typically by using a solvent mixture to control the solubility of the lower layer, by setting the composition and coating procedure so as to reduce the amount of the solvent in the applied surface crosslinked layer, by using a polymeric charge transport material in the lower layer so as to prevent the migration of the components of the lower layer, and/or by forming an interlayer having low solubility or having high adhesion between the lower layer and the surface crosslinked layer.

The surface crosslinked layer must have a bulky charge transporting structure for better electric properties and must have crosslinks with an increased density for higher strength. If the applied coating composition is cured by externally applying very high energy to thereby produce the reaction rapidly, the curing reaction proceeds unevenly to invite an increased standard deviation of the elastic displacement τe. Accordingly, the applied film of the coating composition is preferably cured by the use of heat, light or another external energy in which the reaction rate can be controlled by setting the heating conditions, irradiation intensity of light or the amount of the polymerization initiator.

In the present invention, such a surface crosslinked layer having an elastic displacement τe of 35% or more with a standard deviation of 2% or less can be prepared for example in the following manner. When an acrylate monomer having three acryloyloxy groups and a triarylamine compound having one acryloyloxy group are used in a coating composition, 3% by weight to 10% by weight of a polymerization initiator to the total weight of these acrylate compounds, and a solvent are added to the above components to yield the coating composition. When the charge transporting layer underlying the surface crosslinked layer comprises a triarylamine donor as a charge transport material, and a polycarbonate as a binder resin, and the surface crosslinked layer is formed by spray coating, the solvent in the coating composition is preferably tetrahydrofuran, 2-butanone or ethyl acetate. The amount of the solvent is preferably from 2 times to 8 times the total amount of the acrylate compounds.

Next, an underlayer, a charge generation layer and the charge transporting layer are sequentially formed on a substrate such as an aluminum cylinder, and the above-prepared coating composition is applied to the charge transporting layer typically by spraying. The applied film is then dried at a relatively low temperature in a short time (at 25° C. to 80° C. for 1 to 10 minutes) by ultraviolet irradiation or heating.

In ultraviolet irradiation, a metal halide lamp may be used at an illuminance of preferably 50 $mW/cm^2$ to 1000 $mW/cm^2$. For example, when ultraviolet rays at 500 $mW/cm^2$ are applied, the rays are applied from different directions uniformly for about 20 seconds. The temperature of the photoconductor should be controlled so as not to exceed 50° C.

When the composition is cured by heating, the heating temperature is preferably from 100° C. to 170° C. When a blast oven is used as a heater and the heating temperature is set at 150° C., the heating time is from about 20 minutes to about 3 hours.

After the completion of curing, the article is heated at 100° C. to 150° C. for 10 to 30 minutes to reduce residual solvent. Thus, an electrophotographic photoconductor of the present invention is prepared.

Now, the structure of the present invention will be explained.

<Layer Structure of Electrophotographic Photoconductor>

The electrophotographic photoconductor used in the present invention is explained with reference to the drawings.

Figure 3A:
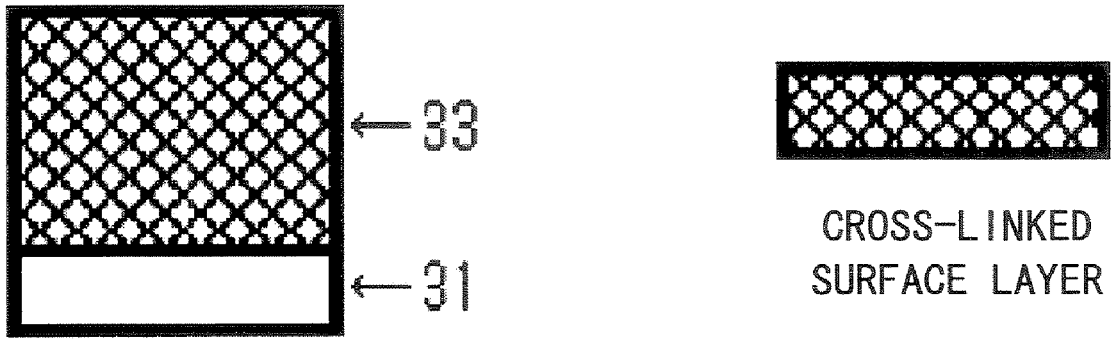
FIGS. 3A and 3B are each a cross-section of an example of the electrophotographic photoconductor according to the present invention.
Figure 3B:
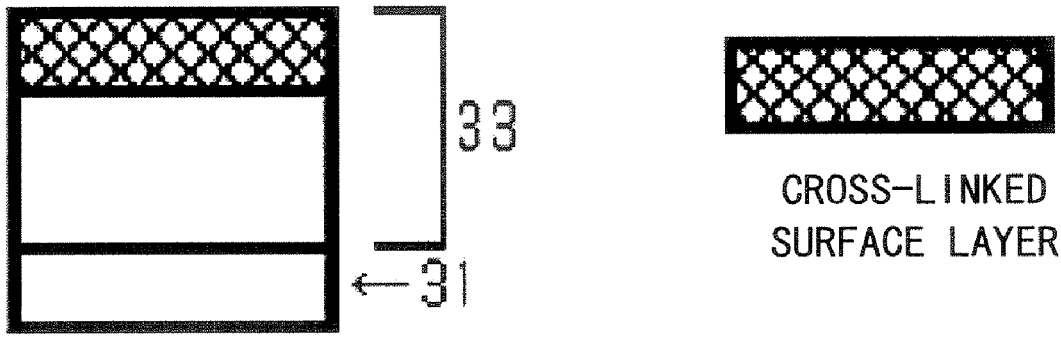

FIGS. 3A and 3B each show a cross-section of the electrophotographic photoconductor according to the present invention, which has a single-layered structure comprising a photoconductive layer 33 having both charge generating ability and charge transporting ability on a conductive substrate 31. FIG. 3A shows the case when the surface crosslinked layer is the whole of the photoconductive layer and FIG. 3B shows the case when the surface crosslinked layer is a surface part of the photoconductive layer.

Figure 4A:
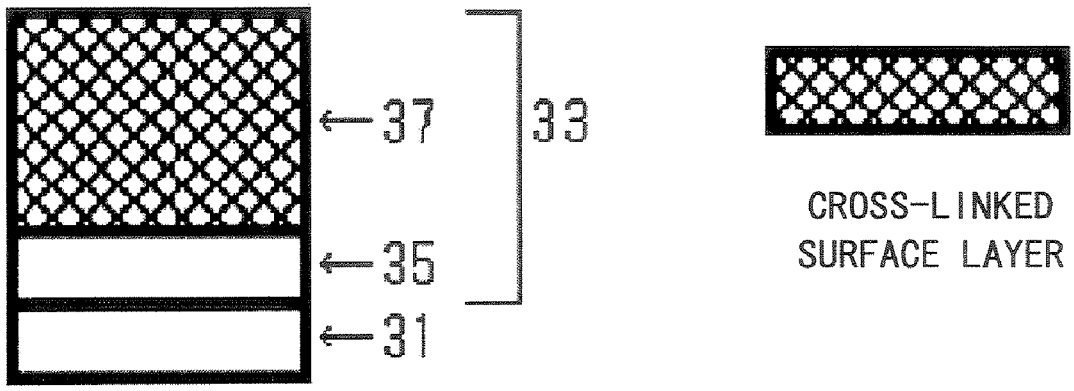
FIGS. 4A and 4B are each a cross-section of another example of the electrophotographic photoconductor according to the present invention.
Figure 4B:
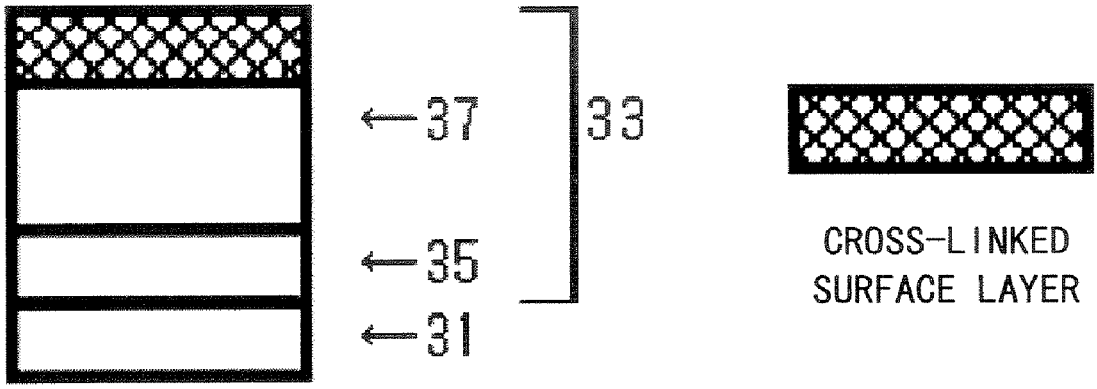

FIGS. 4A and 4B each show a photoconductor having a laminated structure comprising a charge generating layer 35 having charge generating ability and a charge transporting layer 37 having charge transporting ability on a conductive substrate 31. FIG. 4A shows the case when the surface crosslinked layer is the whole of the charge transporting layer and the FIG. 4B shows the case when the surface crosslinked layer is a part of the charge transporting layer.

<Conductive Substrate>

The conductive substrate 31 may be a film-shaped or cylindrically-shaped plastic or paper covered with a conducting material having a volume resistivity of $10^{10}$ Ω·cm, e.g., a metal such as aluminum, nickel, chromium, nichrome, copper, gold, silver or platinum, or a metal oxide such as tin oxide or indium oxide, by vapor deposition or sputtering, or it may be a plate of aluminum, aluminum alloy, nickel or stainless steel, and this may be formed into a tube by extrusion or drawing, cut, polished and surface-treated. The endless nickel belt and endless stainless steel belt disclosed in JP-A No. 52-36016 can also be used as the conductive substrate 31.

In addition, a conductive powder may also be dispersed in the binder resin and coated on the substrate, and used as the conductive substrate 31 of the present invention.

Examples of this conductive powder are carbon black and acetylene black, metal powders such as aluminum, nickel, iron, nichrome, copper, zinc and silver, conductive tin oxide and ITO or the like. The binder resin used together may also comprise a thermoplastic resin, thermosetting resin or photosetting resin such as polystyrene, styrene-acrylonitrile copolymer, styrene-butadiene copolymer, styrene-maleic anhydride copolymer, polyester, polyvinyl chloride, vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin or alkyd resin. Such a conductive layer can be provided by dispersing and applying these conductive powders and binder resin in a suitable solvent, for example, tetrahydrofuran, dichloromethane, methyl ethyl ketone or toluene.

A construction apparatus wherein a conductive layer is provided on a suitable cylindrical substrate by a heat-shrinkable tubing containing these conductive powders in a material such as polyvinyl chloride, polypropylene, polyester, polystyrene, polyvinylidene chloride, polyethylene, chlorinated rubber or polytetrafluoroethylene fluoro-resin, can also be used as the conductive substrate 31 of the present invention.

<Photoconductive Layer>

Next, the photoconductive layer is explained. The photoconductive layer may be a laminated structure or a single-layered structure.

When it is a laminated structure, the photoconductive layer comprises a charge generating layer having a charge generating ability and a charge transporting layer having a charge transporting ability. When it is a single-layered structure, the photoconductive layer is a layer having both charge generating ability and charge transporting ability.

Now, the photoconductive layer of the laminated structure and the photoconductive layer of the single-layered structure are explained, respectively.

<Photoconductive Layer Comprising a Charge Generating Layer and a Charge Transporting Layer>

(Charge Generating Layer)

The charge generating layer 35 is a layer comprising mainly a charge generating material having charge generating ability and may be used in combination with a binder resin, as needed. Usable charge generating material includes an inorganic material and an organic material.

Examples of inorganic materials are crystalline selenium, amorphous selenium, selenium-tellurium, selenium-tellurium-halogen, selenium-arsenic compound and amorphous silicon. The amorphous silicon may have dangling bonds terminated with hydrogen atoms or halogen atoms, or it may be doped with boron atoms or phosphorus atoms.

The organic material can be any of the known materials. It includes, for example, phthalocyanine pigments such as metal phthalocyanine, non-metal phthalocyanine and the like, azulenium salt pigments, squaric acid methine pigment, azo pigments having a carbazole skeleton, azo pigments having a triphenylamine skeleton, azo pigments having a diphenylamine skeleton, dibenzothiophene skeleton, azo pigments having a fluorenone skeleton, azo pigments having a oxadiazole skeleton, azo pigments having a bisstylbene skeleton, azo pigments having a distyryoxide azole skeleton, azo pigments having a distyrylcarbazole skeleton, pherylene pigments, anthraquinone or polycyclic quinone pigments, quinone imine pigments, diphenylmethane and triphenylmethane pigments, benzoquinone and haphtoquinone pigments, cyanine and azomethine pigments, indigoido pigments, bisbenzimidazole pigments and the like. These charge generating materials can be used alone or as a mixture of two or more thereof.

The binder resins which can be used in the charge generating layer 35, as needed, include a polyamide, polyurethane, epoxy resin, polyketone, polycarbonate, silicone resin, acrylic resin, polyvinyl butyral, polyvinyl formal, polyvinyl ketone, polystyrene, poly-N-vinyl carbazole and polyacrylamide. These binder resins can be used alone, or two or more may be used in admixture. Also, in addition to the binder resin of the charge generating layer, as described above, it includes a high molecular (polymer) charge transporting material having charge transporting ability, for example, a polycarbonate, a polyester, a polyurethane, a polyether, a polysiloxane, an acrylic resin and the like, which have a arylamine skeleton, a benzidine skeleton, a hydrazone skeleton, a carbazole skeleton, a stylbene skeleton, a pyrazoline skeleton and the like or a high molecular material having a polysilane skeleton.

Concrete examples of the former are a high molecular charge transport material described in JP-A No. 01-001728, JP-A No. 01-009964, JP-A No. 01-013061, JP-A No. 01-019049, JP-A No. 01-241559, JP-A No. 04-011627, JP-A No. 04-175337, JP-A No. 04-183719, JP-A No. 04-225014, JP-A No. 04-230767, JP-A No. 04-320420, JP-A No. 05-232727, JP-A No. 05-310904, JP-A No. 06-234836, JP-A No. 06-234837, JP-A No. 06-234838, JP-A No. 06-234839, JP-A No. 06-234840, JP-A No. 06-234841, JP-A No. 06-239049, JP-A No. 06-236050, JP-A No. 06-236051, JP-A No. 06-295077, JP-A No. 07-056374, JP-A No. 08-176293, JP-A No. 08-208820, JP-A No. 08-211640, JP-A No. 08-253568, JP-A No. 08-269183, JP-A No. 09-062019, JP-A No. 09-043883, JP-A No. 09-71642, JP-A No. 09-87376, JP-A No. 09-104746, JP-A No. 09-110974, JP-A No. 09-110976, JP-A No. 09-157378, JP-A No. 09-221544, JP-A No. 09-227669, JP-A No. 09-235367, JP-A No. 09-241369, JP-A No. 09-268226, JP-A No. 09-272735, JP-A No. 09-302084, JP-A No. 09-302085, JP-A No. 09-328539 and the like.

Also, the concrete examples of the latter are polysilylene polymers illustrated in, for example, JP-A No. 63-285552, JP-A No. 05-19497, JP-A No. 05-70595 and JP-A No. 10-73944.

Also, the charge generating layer 35 may further contain a low molecular charge transporting material.

The low molecular charge transporting material which can be combined in the charge generating layer 35 includes a hole transporting material and an electron transporting material.

Examples of the electron transporting material are electron acceptors such as chloranyl, bromanyl, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide and diphenoquinone derivatives. These charge transporting materials can be used alone, or two or more may be used in admixture.

The hole transporting material may be any of the electron donor materials represented below which may be used without problem. Examples of the hole transporting material are oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triaryl methane derivatives, 9-stylanthracene derivatives, pyrazoline derivatives, divinylbenzene derivatives, hydrazone derivatives, indene derivatives, butadiene derivatives and pyrene derivatives, and other known materials may be used. These hole transporting materials can be used alone, or two or more can be used in admixture.

Broadly speaking, the charge generating layer 35 may be formed by vacuum thin film manufacturing processes or by the process of casting from a solution dispersion.

The former process includes the vacuum deposition process, glow discharge electrolysis, ion plating process, sputtering process, reactive-sputtering process and CVD process, which form a satisfactory inorganic material or organic material.

To provide the charge generating layer by the casting process, an inorganic or organic charge-generating material is dispersed, together with a binder resin if necessary, by a ball mill, attriter, sand mill or bead mill using an organic solvent such as tetrahydrofuran, dioxane, dioxolane, toluene, dichloromethane, monochlorobenzene, dichloroethane, cyclohexanone, cyclopentanone, anisole, xylene, methyl ethyl ketone, acetone, ethyl acetate or butyl acetate, moderately diluting the dispersion liquid, and applying it. Also, as needed, a leveling agent such as dimethyl silicone oil, methylphenyl silicone oil and the like may be added. Its application is carried out by dip coating, spray coating, bead coating, ring coating and the like.

The thickness of the charge generating layer provided as mentioned above may conveniently be approximately 0.01 to 5 μm, but is preferably 0.05 to 2 μm.

(Charge Transporting Layer)

The charge transport layer 37 is a layer having the charge transporting ability. The surface crosslinked layer having a charge transporting structure according to the present invention can be usefully used as the charge transport layer. When surface crosslinked layer is the whole charge transport layer 37, as described in the process for preparing the surface crosslinked layer, a coating solution containing the radical polymerizable composition according to the present invention (this includes a tri- or more-functional radical polymerizable monomer without having a charge transporting structure and a mono-functional radical polymerizable compound having a charge transporting structure; hereinafter the same) is applied on the charge generating layer 35, followed by drying, as needed and cured by an external energy to form a surface crosslinked layer. Here, the surface crosslinked layer has a thickness of 10 to 30 μm, preferably 10 to 25 μm. If it is thinner than 10 μm, it is impossible to maintain a sufficient charge potential. If it is thicker than 30 μm, separation of undercoating layer may occur owing to volume contraction upon curing.

Also, when the charge transport layer 37 has a laminated structure comprising the surface crosslinked layer formed on the surface of the charge transport layer 37, the sublayer part of the charge transport layer is formed by dissolving or dispersing a charge transport material having charge transporting ability and a binder resin in a proper solvent and applying the resulting solution or dispersion on the charge generating layer 35, followed by drying. Subsequently, a coating solution containing the radical polymerizable composition according to the present invention is applied and cross-linked cured by an external energy.

As the charge transport material, an electron transporting material, a hole transporting material and a high molecular charge transport material described for the charge generating layer 35 may be used. As described above, the high molecular charge transport material is particularly useful, since it can reduce the solubility of the sublayer upon coating of the surface layer.

Examples of the binder resin are thermoplastic or thermosetting resins such as polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenol resin and alkyd resin.

The amount of charge transport material is 20-300 parts by weight, but preferably 40-150 parts by weight to 100 parts by weight of the binder resin. However, when a high molecular charge transporting material is used, it can be used alone or in combination with a binder resin.

The solvent which can be used in the coating of a sublayer part of the charge transport layer may be the same as for the charge generating layer and suitably those which can well dissolve the charge transporting material and a binder resin. The solvents may be used alone or as a mixture of two or more thereof. Also, the formation of the sublayer part of the charge transport layer may use the same coating process as for the charge generating layer 35.

A plasticizer or leveling agent may also be added if necessary.

The plasticizer which can be used together in the sublayer part of the charge transport layer may be any common resin plasticizer such as dibutyl phthalate and dioctyl phthalate which can be used without modification, the usage amount being approximately 0 to 30 parts by weight relative to 100 parts by weight of binder resin.

Examples of leveling agents which can be used together in the sublayer part of the charge transport layer are silicone oils such as dimethyl silicone oil and methylphenyl oil, or polymers and oligomers having a perfluoralkyl group in the side chain. They may be used in a proportion of approximately 0 to 1 part by weight relative to 100 parts by weight of binder resin.

The sublayer part of the charge transport layer properly has a thickness of 5 to 40 μm, preferably 10 to 30 μm.

When the surface crosslinked layer is formed on the surface of the charge transport layer 37, the surface crosslinked layer has a thickness of 1 μm or more and 10 μm or less, more preferably, 2 μm or more and 8 μm or less so that the produced photoconductor has high abrasion resistance and scratch resistance and excellent electrical properties without crack and layer separation. Also, in case when the surface crosslinked layer is in soluble in an organic solvent, more excellent properties can be obtained, whereby it is possible to produce a photoconductor with a long life span.

As reasons for the foregoing effects, the following factors are related.

An electrophotographic photoconductor is used in a circumstance where a series of steps by a charging unit, development unit, transferring unit, cleaning unit and discharge unit are repeated, wherein the photoconductor can be abraded or get scratched, leading deterioration of a produced image and consuming of its life span. Factors causing abrasion and scratch include (1) decomposition on the surface of the photoconductor by charging and discharging and chemical deterioration by oxidizing gases, (2) attachment of a carrier upon development, (3) friction with paper during transferring, (4) friction with a cleaning brush a cleaning blade during cleaning and the toner or carrier attached thereto and the like. In order to design a photoconductor strong against such hazard, it is important for the surface layer to have high and uniform hardness and elasticity. Also, in terms of the membrane structure, the surface layer preferably has a dense and homogeneous 3-dimensional mesh structure. The cross-linked charge transport layer forming the surface layer according to the present invention has a cross-linked structure obtained by curing tri- or more-functional radical polymerizable monomer and thereby, 3-dimensional mesh structure. Consequently, it is possible to obtain a surface layer with a high hardness and a high elasticity, satisfying excellent abrasion resistance and scratch resistance. Like this, though it is important to increase the density of cross-linkage, that is the number of cross-linkage per unit volume, on the surface of the photoconductor, it may cause internal stress by volume contraction since a large number of bondings are formed in a moment during the curing. Such internal stress increases as the thickness of the cross-linked layer increases. Therefore, upon curing of the entire charge transport layer, crack or membrane separation may occur. Though this phenomenon may not initially occur, it may occur over the time, as the photoconductive boy is repeatedly used in an electrophotographic process and affected by the hazard and thermal fluctuation by charging, development, transferring and cleaning. The process to solve this problem includes (1) to introduce a high molecular ingredient to the cross-linked layer and cross-linked structure, (2) to use a large amount of mono-functional and bi-functional radical polymerizable monomer and (3) to use a multi-functional monomer having a flexible group to softening the cured resin layer. However, all of these processes lead to reduction of the cross-linkage density of the cross-linked layer, and therefore it is impossible to attain progressively improved abrasion resistance. On the other hand, the photoconductor according to the present invention is provided with a surface crosslinked layer having a high cross-linkage density with a 3-dimensional mesh structure on the charge transport layer in a thickness of 1 μm or more and 10 μm or less. As a result, it is possible to prevent crack or membrane separation and provide high abrasion resistance. By providing a surface crosslinked layer having a thickness of 2 μm or more and 8 μm or less, it is possible to increase allowance against the foregoing problem and to select materials for the formation of the cross-linkage leading improvement of abrasion resistance. The reasons the photoconductor can inhibit crack or membrane separation is because the surface crosslinked layer can be formed in a thin layer, thereby reducing internal stress, and has the charge transport layer in the sublayer which can relieve the internal stress of the surface crosslinked layer on the surface. Thus, there is no need for the surface crosslinked layer to contain a high molecular material in a large amount, whereby scratch or toner pilling which may caused by incompatibility with a cured body formed by the reaction of the high molecular material and a radical polymerizable composition (radical polymerizable monomer or radical polymerizable compound having a charge transporting structure) seldom occurs. Also, when the thick layer provided over the entire charge transport layer is cured by light irradiation, light transmission to the inside may be restricted by the adsorption of the charge transporting structure and consequently, the curing may not be sufficiently carried out. In the surface crosslinked layer according to the present invention, the curing is uniformly carried out from the thin layer of 10 μm or less to the inside, whereby the inside can maintain high abrasion resistance like the surface. Also, in the formation of the outermost surface layer according to the present invention, in addition to the 3- or more-functional radical polymerizable monomer, a mono-functional radical polymerizable compound having a charge transporting structure is further contained, which is inserted in the cross-linkage upon curing of the 3- or more-functional radical polymerizable monomer. On the other hand, when a low molecular charge transporting material without functional groups is contained in the surface crosslinked layer, since its compatibility is low, crystallization of the low molecular charge transporting material or clouding may occur, causing deterioration in mechanical strength of the surface crosslinked layer. Meanwhile, when a bi or more-functional charge transport compound is used as a main component, it can be fixed in the cross-linked structure by a plurality of bondings to increase the cross-linkage density. However, since the volume of the charge transporting structure is increased, the cured resin structure shows significant distortion, which contributes to increase of the internal stress in the surface crosslinked layer.

Also, according to the photoconductor of the present invention, it is possible to apply a design having a high mobility with a few charge trap of the conventional photoconductor as the charge transport layer in the sublayer and thereby, to minimize the electrical side effects of the cross-linked charge transport layer.

Further, the cross-linked surface layer which is insoluble in an organic solvent according to the present invention has greatly improved abrasion resistance. The cross-linked surface layer according to the present invention is formed by curing a tri- or more-functional radical polymerizable monomer without having a charge transporting structure and a mono-functional radical polymerizable compound having a charge transporting structure and thereby, has a 3-dimensional mesh structure all over the layer. If a component other than the above-described component (for example, an additive such as a 1 or 2-functional monomer, a polymer binder, an antioxidant, a leveling agent, a plasticizer and the like, and a component extracted from the sublayer) is added or curing conditions are different, the cross-linkage density is locally reduced or aggregates of cured bodies at a high cross-linkage density may be formed. This cross-linked surface layer has a weak bonding power between cured bodies, is soluble in an organic solvent and will cause local abrasion and separation of fine cured body units as it is repeatedly used in the electrophotographic process. According to the present invention, by making the cross-linked surface layer insoluble in an organic solvent, it is possible to provide an improved 3-dimensional structure to increase the cross-linkage and further to provided considerably improved abrasion resistance since the chain reaction is carried out over a large area, whereby the cured body has a high molecular weight.

<Single-Layered Photoconductive Layer>

The photoconductive layer having a single-layered structure is a layer having both charge generating function and charge transport function and the cross-linked surface layer containing the charge transporting structure according to the present invention can be usefully used as a photoconductive layer having a single-layered structure by containing a charge generating material showing charge generating function. As described in the casting process of the charge generating layer, a charge generating material is dispersed in a coating solution containing a radical polymerizable composition, applied on a charge generating layer 35, followed by drying, as needed, and subjected to the curing reaction by an external energy to form a cross-linked surface layer. Also, the charge generating material which has previously dispersed in a solvent may be added to the coating solution for the cross-linked surface layer. Here, the cross-linked surface layer has a thickness of 10 to 30 μm, preferably 10 to 25 μm. If it is less than 10 μm, it is impossible to maintain a sufficient charge potential while if it exceeds 30 μm, generation of conductive gases or separation of undercoating layer may occur owing to volume contraction upon curing.

Also, when the cross-linked surface layer is a surface part having a single-layered structure of the photoconductive layer, the sublayer of the photoconductive layer is formed by dissolving or dispersing a charge generating material having charge generating ability, a charge transporting material having charge transferring ability and a binder resin in a proper solvent and applying it, followed by drying. Also, a plasticizer, a leveling agent and the like may be added, as needed. The dispersion process of the charge generating material, the charge generating material, the charge transporting material, the plasticizer, the leveling agent may be the same as described for the charge generating layer 35 and the charge transport layer 37. As the binder resin, in addition to the binder resins described for the charge transport layer 37, the binder resins described for the charge generating layer 35 may be used in combination. Also, the above-described high molecular charge transport material may be used, which is useful in that they can reduce the introduction of the composition of the lower photoconductive layer composition to the cross-linked surface layer. The sublayer of the photoconductive layer has a thickness of 5 to 30 μm, preferably 10 to 25 μm.

When the surface part of the photoconductive layer is the cross-linked surface layer having a single-layered structure, the cross-linked surface layer is formed applying a coating solution containing the radical polymerizable composition and a charge generating material on the sublayer part of the photoconductive layer, followed by drying, as needed and curing the coating by an external energy such as heat or light, as described above. Here, the cross-linked surface layer has a thickness of, 1 to 20 μm, preferably 2 to 10 μm. If it is thinner than 1 μm, the durability may vary owing to the deviation of the thickness.

The charge generating material contained in the photoconductive layer having a single-layered structure is preferably 1 to 30% by weight relative to the total amount of the photoconductive layer and the binder resin contained in the photoconductive layer is 20 to 80% by weight, and the charge transport material is 10 to 70 parts by weight.

<Middle Layer>

In the photoconductor according to the present invention, when the surface crosslinked layer is the surface part of the photoconductive layer, a middle layer may be provided to inhibit introduction of the sublayer component to the surface crosslinked layer or improve the adhesion with the sublayer.

Generally, a binder resin is used as the principal component of the middle layer. Examples of these resins are polyamide, alcohol-soluble nylon, water-soluble polyvinyl butyral, polyvinyl butyral and polyvinyl alcohol. To form the middle layer, the usual coating processes can be used as described above. The thickness of the middle layer may be approximately 0.05 to 2 μm.

<Base Layer>

In the photoconductor of the present invention, a base layer can be provided between the conductive substrate 31 and the photosensitive layer. Although the base layer generally uses a resin as principal component, considering that a photosensitive layer will be applied onto it with a solvent, it is preferred that it is a resin with high solvent resistance rather than a common organic solvent. Examples of such resins are water-soluble resins such as polyvinyl alcohol, casein, sodium polyacrylate, alcohol-soluble resins such as copolymer nylon and methoxymethylated nylon, and curing resins which form a three-dimensional network such as polyurethane, melamine resin, phenol resin, alkyde-melamine resin and epoxy resin. Also, metal oxide fine powder pigments such as titanium oxide, silica, alumina, zirconium oxide, tin oxide or indium oxide may also be added to the base layer to prevent Moire patterns, and to reduce residual potential.

These base layers can be formed using a suitable solvent and coating process as for the above-mentioned photosensitive layer. A silane coupling agent, titanium coupling agent or chromium coupling agent, etc. can be used as the base layer of the present invention. $Al_2O_3$ prepared by anodic oxidation, organic materials such as polyparaxylylene (parylene) and inorganic materials such as $SiO_2$, $SnO_2$, $TiO_2$, ITO, $CeO_2$ prepared by the vacuum thin film-forming process, can be used for the base layer of the present invention. Other materials known in the art may also be used. The film thickness of the base layer is in the range of 0 to 5 μm.

<Addition of Antioxidant to Respective Layers>

Also, according to the present invention, an antioxidant may be added to the surface cross-linked layer, the photoconductive layer, the charge generating layer, the charge transport layer, the base layer and the middle layer to improve environmental resistance and particularly, to prevent reduction of sensitivity and increase of residual potential.

Examples of the antioxidant which can be used in the present invention are as follows.

(Phenol Compounds)

2,6-di-t-butyl-p-cresol, butylated hydroxyanisole, 2 6-di-t-butyl-4-ethylphenol, stearyl β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidene bis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butylic acid]crecol ester, and tocopherols.

(Paraphenylenediamines)

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine.

(Hydroquinones)

2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone, 2-(2-octadecenyl-5-methyl hydroquinone.

(Organosulfur Compounds)

dilauryl-3,3'-thiodipropionate, distearyl-3,3'-thiodipropionate, ditetradecyl-3,3'-thiodipropionate.

(Organophosphorus Compounds)

Triphenylphosphine, tri(nonylphenyl)phosphine, tri(dinonylphenyl)phosphine, tricresylphosphine, tri(2, 4-dibutylphenoxy)phosphine.

These compounds are known as antioxidants of rubber, plastics, oils and fats and are commercially available.

The added amount of the antioxidant according to the present invention is 0.01 to 10% by weight relative to the total amount of the layer.

The electrophotographic photoconductor in another embodiment comprises an electroconductive substrate, and at least a charge generation layer, a charge transporting layer and a surface crosslinked layer arranged in this order on the electroconductive substrate, in which the surface crosslinked layer is a cured product of a tri- or more-functional radically polymerizable monomer having no charge transporting structure and a monofunctional radically-polymerizable compound having a charge transporting structure and has a thickness of 1 μm to 10 μm, preferably of 2 μm to 8 μm.

The electrophotographic photoconductor having this configuration is highly resistant to abrasion and scratch, has good electric properties and is impervious to cracking and flaking off. By employing a layer insoluble in organic solvents as the surface crosslinked layer, the electrophotographic photoconductor has further excellent properties and a longer life.

<Image Forming Process and Apparatus>

Now, the image forming process and image forming apparatus are described in detail with reference to the drawings.

The image forming process and image forming apparatus according to the present invention use a photoconductor having a smooth charge transport surface cross-linked layer and involves a process of at least, for example, subjecting the photoconductor to charging, image exposure, development, transferring a toner image on an image keeper (transfer paper), fixation and cleaning of the surface of the photoconductor.

In an image forming process including directly transferring an electrostatic latent image to a transfer material for development, the process is not necessary, where appropriate.

Figure 5:
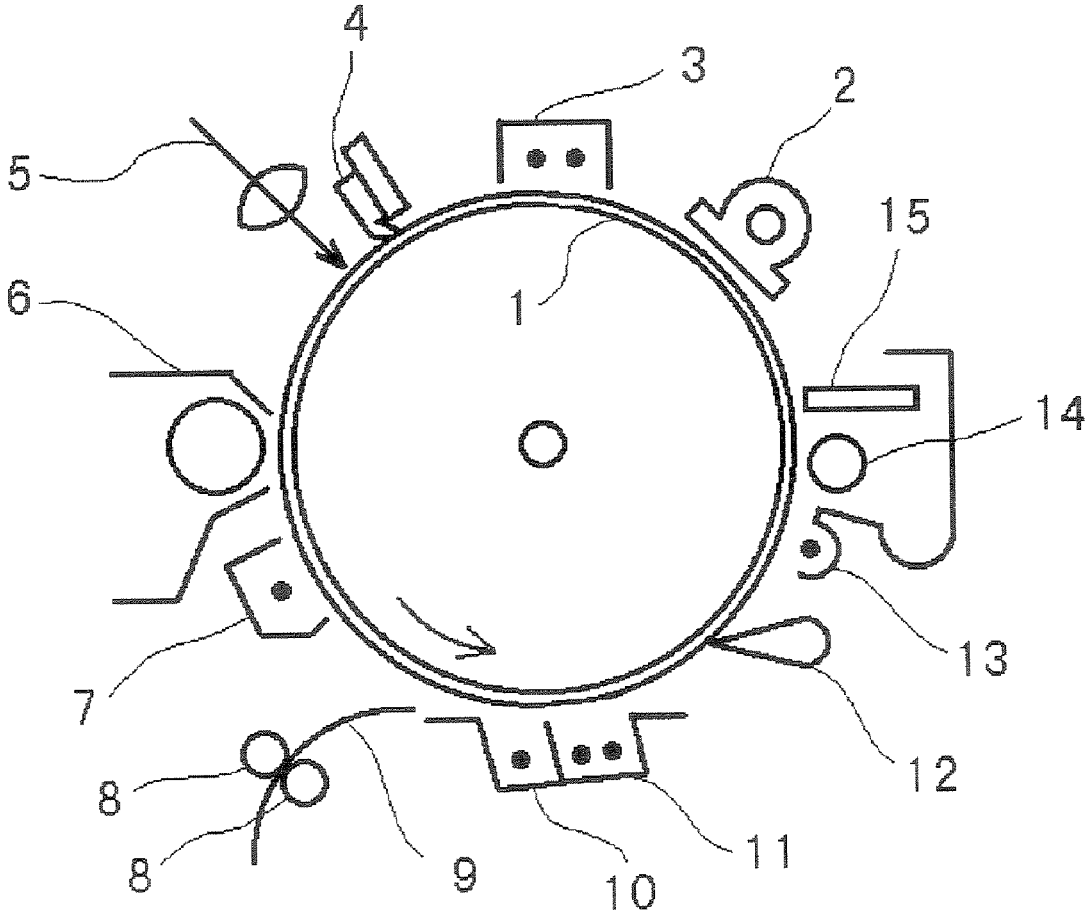
FIG. 5 is a schematic view showing an example of the image forming apparatus according to the present invention.

FIG. 5 is a schematic view illustrating an example of the image forming apparatus. A charger 3 is used as a charging unit for evenly charging a photoconductor. Examples of the charging unit include a corotron device, a scorotron device, a solid discharging device, a pin electrode device, a roller charging device, a conductive brush device and the like and employed according to a known process.

Particularly, the construction of the present invention is effectively carried by using a charging unit, by which the photoconductor composition is composed by close discharge by the charging unit of a contact charging type or non-contact close charging type. Here, the contact charging type refers to a charging process carried out by directly contacting a charging roller, charging brush or charging blade to the photoconductor. The close charging type refers to a charging process, wherein, for example, a charging roller is located in non-contact state at distance of 200 μm or less from the surface of the photoconductor. When the distance is excessively great, the charging may be unstable while when it is excessively small, the surface of the charging member may be stained by toner remaining on the photoconductor. Therefore, the distance is suitably in the range of 10 to 200 μm, preferably 10 to 100 μm.

Next, an image exposure part 5 is used to form an electrostatic latent image on the uniformly-charged photoconductor 1. The light source may be any luminous body such as a fluorescent lamp, tungsten lamp, halogen lamp, mercury-vapor lamp, sodium-vapor lamp, light emitting diode (LED), semiconductor laser (LD) and electroluminescence (EL). To irradiate only with light of a desired wavelength band, various filters, such as a sharp cut filter, band pass filter, near-infrared cut-off-filter, dichroic filter, interference filter and color conversion filter can also be used.

Next, a developing unit 6 is used to render the electrostatic latent image formed on the photoconductor 1, visible. The developing process may be a one-component developing process or a two-component developing process using a dry toner, or a wet developing process using a wet toner.

When a positive (negative) charge is given to the photoconductor and image exposure is performed, a positive (negative) electrostatic latent image will be formed on the photoconductor surface. If this is developed with a toner (charge detecting particles) of negative (positive) polarity, a positive image will be obtained, and a negative image will be obtained if the image is developed with a toner of positive (negative) polarity.

Next, a transferring charger 10 is used to transfer the visualized toner image from the photoconductor to a transfer material 9. Also, in order to more effectively carry out the transferring, a pre-transfer charger 7 may be used. For the transferring, the electrostatic transferring using a transfer charger and a bias roller, the mechanical transferring process such as adhesion transfer, pressure transfer and the like, or the magnetic transferring process can be used. By the electrostatic transferring process, the foregoing charging unit can be used.

Next, a separation charger 11 or a separation claw 12 is used as a means to separate the transfer material 9 from the photoconductor 1. Other separations which can be used include stripping by electrostatic adsorption-induction, stripping using a side belt, stripping by tip grip transportation, self stripping and the like. As the separation charger 11, the foregoing charging units can be used.

Next, a fur brush 14 and a cleaning blade 15 are used to remove the toner remaining on the photoconductor after the transferring. Also, in order to more effectively carry out the cleaning, a pre-cleaning charger 13 may be used. Other cleaning units include the wave process, magnet brush process and the like, which may be used alone or in combination.

Next, as needed, a discharging unit can be used to remove the latent image on the photoconductor. The discharging unit which can be used includes a discharging lamp 2 and a discharging charger, which use the light source for light exposure and the charging units, respectively.

In FIG. 5, 4 is an eraser and 8 is a resist roller.

In addition, processes for script reading, paper supplying, fixing, paper releasing and the like are those known to the art.

The present invention is directed to an image forming process using an electrophotographic photoconductor in an image forming unit and an image forming apparatus.

Figure 6:
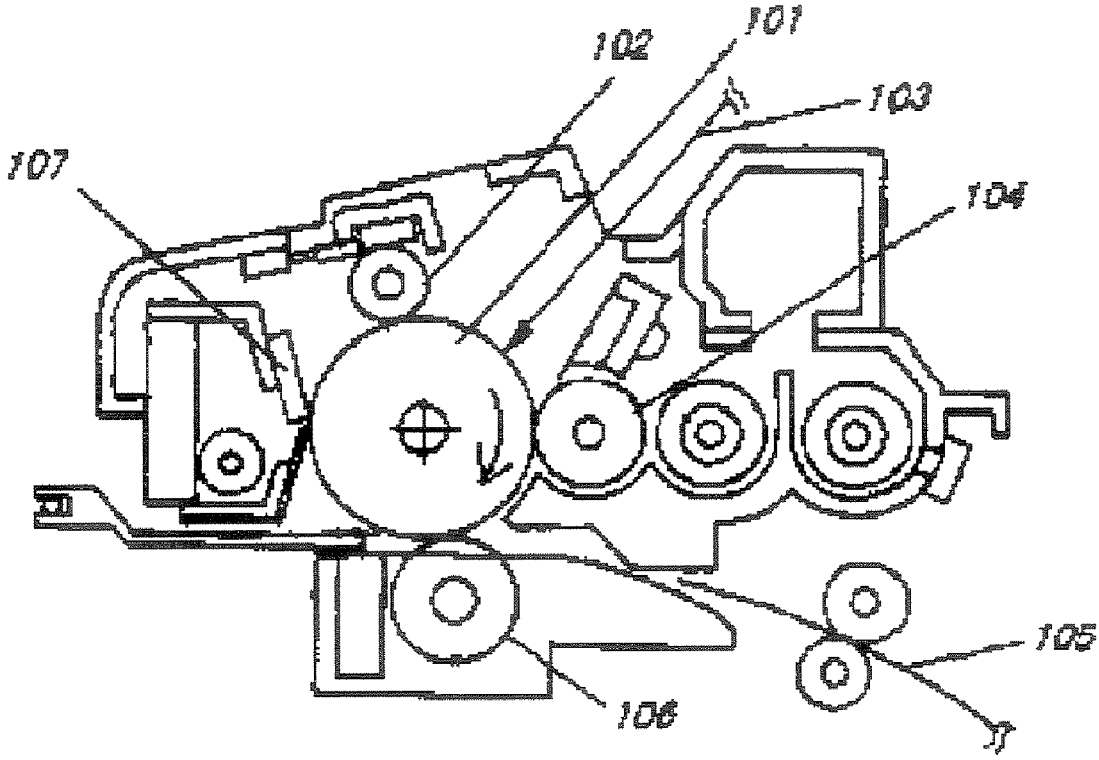
FIG. 6 is a schematic view showing an example of the process cartridge for an image forming apparatus.

The image forming unit may be incorporated into copying devices, fax machines and printers, or they may be built into these devices in the form of a process cartridge which can be freely attached or removed. FIG. 6 shows an example of a process cartridge.

The process cartridge for an image forming apparatus comprises a photoconductor 101, and at least one of a charging unit 102, a development unit 104, a transferring unit 106, a cleaning unit 107 and discharging unit (not shown) and is a device (part) adapted to be attached to or detached from a main body of the image forming apparatus.

Referring to the image forming process by the apparatus shown in FIG. 6, the photoconductor 101, while rotating in the arrow direction, is charged by the charging unit 102, to form an electrostatic latent image corresponding to the exposed image on its surface by a light exposing unit 103 (not shown). The electrostatic latent image is developed with a toner by the development unit 104. The toner image is transferred to a transfer material by the transferring unit 106 to be printed out. Subsequently, after the image transferring, the surface of the photoconductor is cleaned by the cleaning unit 107 and discharged by a discharging unit (not shown). Again, the foregoing procedures are repeated.

According to the present invention, there is also provided a process cartridge for an image forming apparatus comprising a photoconductor having a smooth surface crosslinked layer with charge transporting ability, and at least one of charging, development, transferring, cleaning and discharging units which are integrated in a single body.

As clearly seen from the above description, the electrophotographic photoconductor according to the present invention can be widely used in an electrophotographic copier and also, in electrophotographic applied field such as laser beam printer, CRT printer, LED printer, liquid crystal printer and laser engraving.

<Synthesis of Mono-Functional Compound Having a Charge Transporting Structure>

According to the present invention, the mono-functional compound having a charge transporting structure is synthesized by, for Example, the process described in Japanese Patent No. 3164426. Also, an Example is described below.

1) Synthesis of Hydroxy Group-Substituted Triarylamine Compound (Structural Formula B)

113.85 g (0.3 mol) of a synthetic methoxy group-substituted triarylamine compound (structural formula A) of a hydroxy group-substituted triarylamine compound (structural formula B) and 138 g (0.92 mol) of sodium iodide are added to 240 ml of sulforane and heated to 60° C. with nitrogen purge. 99 g (0.91 mol) of trimethylchlorosilane is dropwisely added for 1 hour and stirred at about 60° C. for 4 hours and 30 minutes, and the reaction is completed. About 1.5 L or toluene is added to the reaction, cooled to room temperature, and repeatedly washed with water and an aqueous sodium carbonate solution. Then, the solvent is removed the toluene solution and the residue is purified by column chromatography (adsorption medium: silica gel, developing solvent: toluene:ethyl acetate=20:1). The resulting light yellow oil is crystallized with cyclohexane. Thus, 88.1 g of white crystals of the structural formula B (yield=80.4%) is obtained.

m.p.: 64.0 to 66.0° C.

TABLE 1

| | Element analysis (%) | | |
|---|---|---|---|
| | C | H | N |
| Found | 85.06 | 6.41 | 3.73 |
| Calculated | 85.44 | 6.34 | 3.83 |

formula A

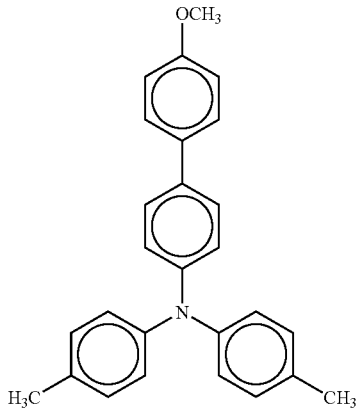

TABLE 1-continued

| | Element analysis (%) | | |
|---|---|---|---|
| | C | H | N |

formula B

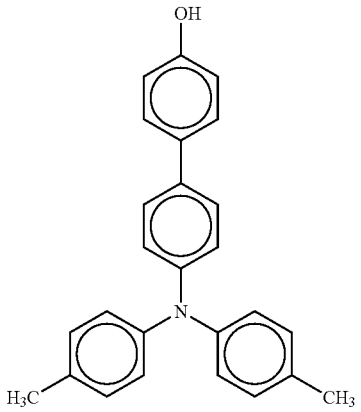

2) Triarylamino Group-Substituted Acrylate Compound (Compound No. 54 in Described Above)

82.9 g (0.227 mol) of hydroxy group-substituted triarylamine compound (structural formula B) obtained from 1) is dissolved in 400 ml of tetrahydrofuran and an aqueous sodium hydroxide solution (NaOH:12.4 g, water: 100 ml) is dropwisely added thereto. The resulting solution is cooled to 5° C. and 25.2 g (0.272 mol) of acrylic acidchloride is added thereto over 40 minutes. Then, the reaction is stirred at 5° C. for 3 hours and completed. The reaction is poured to water and extracted with toluene. The extract is repeatedly washed with an aqueous sodium bicarbonate solution and water. The solvent is removed from the toluene solution and the residue is purified by columnchromatography (adsorption medium: silica gel, developing solvent: toluene). The resulting colorless oil is crystallized with n-hexane. Thus, 73 g of white crystals of the compound No. 54 (yield=84.8%) is obtained.

m.p.: 117.5 to 119.0° C.

TABLE 2

| | Element analysis (%) | | |
|---|---|---|---|
| | C | H | N |
| Found | 83.13 | 6.01 | 3.16 |
| Calculated | 83.02 | 6.00 | 3.33 |

EXAMPLE

Now, the present invention will be explained in further detail by the following Example s. However, the present invention is not limited thereto. Also, all parts in the text are by weight.

Example A-1

On a ϕ30 mm aluminum cylinder, a coating solution for a under coating layer, a coating solution for a charge generation layer, a coating solution for a charge transport layer, each coating solution has a composition described below, were sequentially applied and dried to form a under coating layer of 3.5 μm, a charge generation layer of 0.2 μm and a charge transport layer of 18 μm. On the charge transport layer, a coating solution for a surface crosslinked layer of a composition described below was spray coated, irradiated under conditions of a metal halide lamp: 160 W/cm, irradiation distance: 120 mm, irradiation intensity: 500 mW/cm$^2$, irradiation time: 20 seconds, and further dried at 130° C. for 20 to prepare a surface cross-linked layer of 4 μm. Thus, an electrophotographic photoconductor according to the present invention is formed.

| [Coating solution for a under coating layer] | |
|---|---|
| Alkyde resin (Bekozole 1307-60-EL, DAINIPPON INK AND CHEMICALS, INCORPORATED) | 6 parts |
| Melamine resin (Super Bekamine G-821-60, DAINIPPON INK AND CHEMICALS, INCORPORATED) | 4 parts |
| Titanium oxide | 40 parts |
| Methyl ethyl ketone | 50 parts |

| [Coating solution for a charge generation layer] | |
|---|---|
| Bis-azo pigment having the following structural formula (I) | 2.5 parts |
| Polyvinyl butyral (XYHL, from UCC) | 0.5 parts |
| Cyclohexanone | 200 parts |
| Methyl ethyl ketone | 80 parts |

-continued

[Coating solution for a charge generation layer]

formula (I)

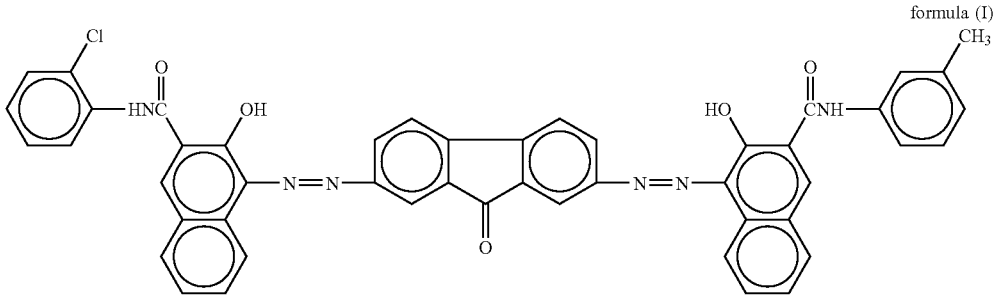

[Coating solution for a charge transport layer]

| | |
|---|---|
| Bisphenol Z polycarbonate (Panlite TS-2050, Teijin Chemicals) | 10 part |
| Low molecular weight charge transport material (D-1) having the following structural formula (II) | 7 parts |
| Tetrahydrofuran | 100 parts |
| 1% tetrahydrofuran solution in silicone oil (KF50-100CS, Shin-Etsu Chemical Co., Ltd.) | 1 part |

formula (II)

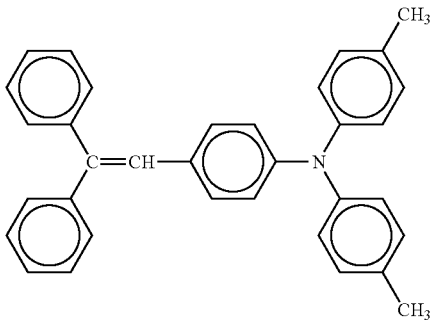

(D-1)

[Coating solution for a surface crosslinked layer]

| | |
|---|---|
| Tri- or more-functional radical polymerizable monomer without having a charge transporting structure Trimethylolpropane triacrylate (KAYARAD TMPTA, Nippon Kayaku Co., Ltd.) Molecular weight: 296, number of functional group: 3 functionality, molecular weight/number of functional group = 99 | 10 parts |
| Mono-functional radical polymerizable compound having a charge transporting structure (Compound No. 54) | 10 parts |
| Photopolymerization initiator 1-hydroxy-cyclohexyl-phenyl-ketone (IRGACURE 184, Ciba Specialty Chemicals) | 1 part |
| Tetrahydrofuran | 100 parts |

Example A-2

An electrophotographic photoconductor was prepared following the procedures in Example A-1 except that the tri- or more-functional radical polymerizable monomer without having a charge transporting structure contained in the coating solution for a surface crosslinked layer of Example A-1 was substituted with the following monomer.

Tri- or more-functional radical polymerizable monomer without having a charge transporting structure 10 parts Ditrimethylolpropane tetraacrylate (SR-355, Sartomer Company Inc.)

Molecular weight: 466, number of functional group: 4 functionality, molecular weight/number of functional group=117

Example A-3

An electrophotographic photoconductor was prepared following the same procedures as in Example A-1 except that the tri- or more-functional radical polymerizable monomer without having a charge transporting structure contained in the coating solution for a surface crosslinked layer of Example A-1 was substituted with the following 2-component monomer and the photopolymerization initiator was substituted with the following compound.

| | |
|---|---|
| Tri- or more-functional radical polymerizable monomer without having a charge transporting structure Pentaerythritol tetraacrylate (SR-295, Sartomer Company Inc.) Molecular weight: 352, number of functional group: 4 functionality, molecular weight/number of functional group = 88 | 6 parts |
| Tri- or more-functional radical polymerizable monomer without having a charge transporting structure Alkyl-modified dipentaerythritol triacrylate (KAYARAD D-330, Nippon Kayaku Co., Ltd.) Molecular weight: 584, number of functional group: 3 functionality, molecular weight/number of functional group = 195 | 4 parts |
| Photopolymerization initiator 2,2-dimethoxy-1,2-diphenylethan-1-one (IRGACURE 651, Ciba Specialty Chemicals) | 1 part |

Example A-4

An electrophotographic photoconductor was prepared following the same procedures as in Example A-1 except that the tri- or more-functional radical polymerizable monomer without having a charge transporting structure contained in the coating solution for a surface crosslinked layer of Example A-1 was substituted with the following 2-component monomer.

| | |
|---|---|
| Tri- or more-functional radical polymerizable monomer without having a charge transporting structure<br>Dipentaerythritol hexacrylate (KAYARAD DPHA, Nippon Kayaku Co., Ltd.)<br>Molecular weight: 536, number of functional group: 5.5 functional, molecular weight/number of functional group = 97 | 6 parts |
| Tri- or more-functional radical polymerizable monomer without having a charge transporting structure<br>Alkyl-modified dipentaerythritol triacrylate (KAYARAD D-330, Nippon Kayaku Co., Ltd.)<br>Molecular weight: 584, number of functional group: 3 functionality, molecular weight/number of functional group = 195 | 4 parts |

Example A-5

An electrophotographic photoconductor was prepared following the same procedures as in Example A-1 except that the tri- or more-functional radical polymerizable monomer without having a charge transporting structure contained in the coating solution for a surface crosslinked layer of Example A-1 was substituted with the following monomer.

| | |
|---|---|
| Tri- or more-functional radical polymerizable monomer without having a charge transporting structure<br>Caprolactone-modified dipentaerythritol hexacrylate (KAYARAD DFCA-60, Nippon Kayaku Co., Ltd.)<br>Molecular weight: 1263, number of functional group: 6 functionality, molecular weight/number of functional group = 211 | 10 parts |

Example A-6

An electrophotographic photoconductor was prepared following the same procedures as in Example A-1 except that the tri- or more-functional radical polymerizable monomer without having a charge transporting structure contained in the coating solution for a surface crosslinked layer of Example A-1 was substituted with the following monomer.

| | |
|---|---|
| Tri- or more-functional radical polymerizable monomer without having a charge transporting structure<br>Caprolactone-modified dipentaerythritol hexacrylate (KAYARAD DPCA-120, Nippon Kayaku Co., Ltd.)<br>Molecular weight: 1947, number of functional group: 6 functionality, molecular weight/number of functional group = 325 | 10 parts |

Example A-7

An electrophotographic photoconductor was prepared following the same procedures as in Example A-1 except that the mono-functional radical polymerizable compound having a charge transporting structure contained in the coating solution for a surface crosslinked layer of Example A-1 was substituted with 10 parts of the Compound No. 127.

Example A-8

The coating solution for a surface crosslinked layer of Example A-1, wherein the mono-functional radical polymerizable compound having a charge transporting structure was substituted with 10 parts of the Compound No. 94 and the photopolymerization initiator was substituted with the following a thermal polymerization initiator was coated on a charge transporting layer, heated in a forced air flow oven at 70° C. for 30 minutes and further heated at 150° C. for 1 hour to prepare a surface crosslinked layer of 4 μm. Thus, a photoconductor according to the present invention was formed.

| | |
|---|---|
| Thermal polymerization initiator<br>2,2-bis(4,4-di-t-butylperoxycyclohexyl)propane (Perakdox 12-EB20, Kayaku Akzo Corporation) | 1 part |

Example A-9

An electrophotographic photoconductor was prepared following the same procedures as in Example A-8 except that the mono-functional radical polymerizable compound having a charge transporting structure contained in the coating solution for a surface crosslinked layer of Example A-8 was substituted with 10 parts of the Compound No. 138.

Example A-10

An electrophotographic photoconductor was prepared following the same procedures as in Example A-2 except that the amount of the tri- or more-functional radical polymerizable monomer without having a charge transporting structure contained in the coating solution for a surface crosslinked layer of Example A-2 was changed to 6 parts and the amount of the mono-functional radical polymerizable compound having a charge transporting structure was changed to 14 parts.

Example A-11

An electrophotographic photoconductor was prepared following the same procedures as in Example A-2 except that the amount of the tri- or more-functional radical polymerizable monomer without having a charge transporting structure contained in the coating solution for a surface crosslinked layer of Example A-2 was changed to 14 parts and the amount of the mono-functional radical polymerizable compound having a charge transporting structure was changed to 6 parts.

Example A-12

A solution containing a high molecular charge transport material (PD-1) as described below in stead of the coating solution for charge transport layer of Example A-1 was applied on the same charge generation layer and dried to form a charge transport layer of 18 μm. On the charge transport layer, a surface cross-linked layer as described in Example A-1 was prepared to form an electrophotographic photoconductor.

| [Coating solution for a charge transport layer] | |
|---|---|
| High molecular charge transport material (PD-1) of the following structural formula | 15 parts |

(PD-1)

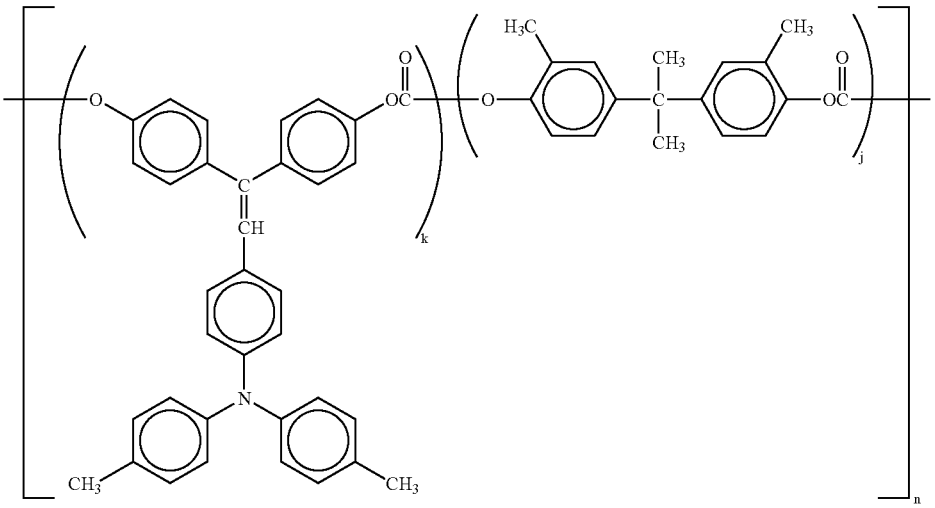

k = 042, j = 0.58 Mw = 160000 (polystyrene conversion)

| | |
|---|---|
| Tetrahydrofuran | 100 parts |
| 1% tetrahydrofuran solution in silicone oil (KF50-100 CS, Shin-Etsu Chemical Co., Ltd.) | 0.3 parts |

Example A-13

A coating solution for a surface crosslinked layer of the following composition was spray coated on the charge generation layer of Example A-1 and irradiated under the same conditions with Example A-1 except for the irradiation time of 40 seconds to prepare a surface crosslinked layer of 22 μm. Thus, a photoconductor according to the present invention was formed.

| [Coating solution for a surface crosslinked layer] | |
|---|---|
| Tri- or more-functional radical polymerizable monomer without having a charge transporting structure<br>Caprolactone-modified dipentaerythritol hexacrylate<br>(KAYARAD DPCA-60, Nippon Kayaku Co., Ltd.)<br>Molecular weight: 1263, number of functional group: 6<br>functionality, molecular weight/number of functional group = 211 | 6 parts |
| Tri- or more-functional radical polymerizable monomer without having a charge transporting structure<br>Pentaerythritol tetraacrylate<br>(SR-295, Sartomer Company Inc.)<br>Molecular weight: 352, number of functional group: 4<br>functionality, molecular weight/number of functional group = 88 | 4 parts |
| Mono-functional radical polymerizable compound having a charge transporting structure<br>(Compound No. 54) | 10 parts |
| Photopolymerization initiator<br>1-hydroxy-cyclohexyl-phenyl-ketone (IRGACURE 184, Ciba Specialty Chemicals) | 2 parts |
| Tetrahydrofuran | 60 parts |
| Cyclohexanone | 20 parts |

Comparative Example A-1

An electrophotographic photoconductor was prepared following the procedures of Example A-1 except that the coating solution for a surface crosslinked layer of Example A-1 was substituted with the following composition.

| [Coating solution for a surface crosslinked layer] | |
|---|---|
| Tri- or more-functional radical polymerizable monomer without having a charge transporting structure<br>Trimethylolpropane triacrylate<br>(KAYARAD TMPTA, Nippon Kayaku Co., Ltd.)<br>Molecular weight: 296, number of functional group: 3<br>functionality, molecular weight/number of functional group = 99 | 8 parts |
| Polymer material<br>Bisphenol A polycarbonate (Panlite TS-2050, Teijin Chemicals) | 2 parts |
| Mono-functional radical polymerizable compound having a charge transporting structure<br>(Compound No. 54) | 10 parts |
| Photopolymerization initiator<br>1-hydroxy-cyclohexyl-phenyl-ketone (IRGACURE 184, Ciba Specialty Chemicals) | 1 part |
| Tetrahydrofuran | 100 parts |

Comparative Example A-2

An electrophotographic photoconductor was prepared following the procedures of Example A-1 except that the coating solution for a surface crosslinked layer of Example A-1 was substituted with the following composition.

| [Coating solution for a surface crosslinked layer] | |
|---|---|
| Tri- or more-functional radical polymerizable monomer without having a charge transporting structure<br>Trimethylolpropane triacrylate<br>(KAYARAD TMPTA, Nippon Kayaku Co., Ltd.)<br>Molecular weight: 296, number of functional group: 3 functionality, molecular weight/number of functional group = 99 | 8 parts |
| Polymer material<br>Polyarylate (U polymer U-100, Unitika Ltd.) | 2 parts |
| Mono-functional radical polymerizable compound having a charge transporting structure<br>(Compound No. 54) | 10 parts |
| Photopolymerization initiator<br>1-hydroxy-cyclohexyl-phenyl-ketone (IRGACURE 184, Ciba Specialty Chemicals) | 1 part |
| Tetrahydrofuran | 100 parts |

Comparative Example A-3

An electrophotographic photoconductor was prepared following the same procedures as in Example A-1 except that the mono-functional radical polymerizable compound having a charge transporting structure contained in the coating solution for a surface crosslinked layer of Example A-1 was substituted with 10 parts of a bi-functional radical polymerizable compound having a charge transporting structure of the following structural formula.

| | |
|---|---|
| Bi-functional radical polymerizable compound having a charge transporting structure | 10 parts |

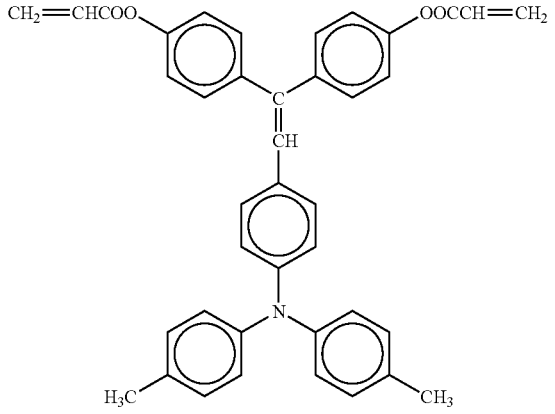

Comparative Example A-4

An electrophotographic photoconductor was prepared following the same procedures as in Example A-1 except that the tri- or more-functional radical polymerizable monomer without having a charge transporting structure contained in the coating solution for a surface crosslinked layer of Example A-1 was substituted with 10 parts of a bi-functional radical polymerizable monomer without having a charge transporting structure of the following structural formula.

| | |
|---|---|
| Bi-functional radical polymerizable monomer without having a charge transporting structure<br>1,6-hexanediol diacrylate (Wako Pure Chemical Industries, Ltd.)<br>Molecular weight: 226, number of functional group: 2 functionality, molecular weight/number of functional group = 113 | 10 parts |

Comparative Example A-5

An electrophotographic photoconductor was prepared following the same procedures as in Example A-1 except that the tri- or more-functional radical polymerizable monomer without having a charge transporting structure which had been contained in the coating solution for a surface crosslinked layer of Example A-1 was not used and the amount of the mono-functional radical polymerizable compound having a charge transporting structure was changed to 20 parts.

Comparative Example A-6

An electrophotographic photoconductor was prepared following the same procedures as in Example A-1 except that the mono-functional radical polymerizable compound having a charge transporting structure which had been contained in the coating solution for a surface crosslinked layer of Example A-1 was not used and the amount of the tri- or more-functional radical polymerizable monomer without having a charge transporting structure was changed to 20 parts.

Comparative Example A-7

A electrophotographic photoconductor was prepared by the procedure of Example A-1, except for using 10 parts of a low-molecular-weight charge transporting substance (D-2) having the following structural formula instead of the mono-functional radically polymerizable compound having a charge transporting structure in the coating composition for surface crosslinked layer.

(D-2)

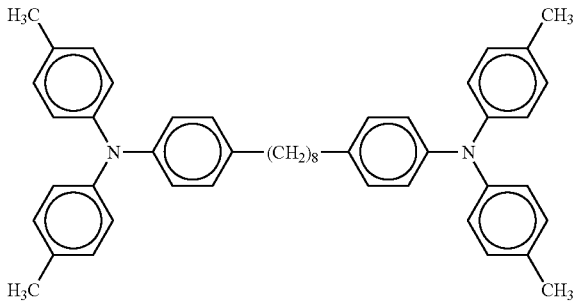

Comparative Example A-8

An electrophotographic photoconductor was prepared by the procedure of Example A-1, except that 45 parts of dichloromethane was used instead of 100 parts of tetrahydrofuran as the solvent in the coating composition for surface crosslinked layer, and that the coating composition for surface crosslinked layer was applied using a ring coater.

Comparative Example A-9

An electrophotographic photoconductor was prepared by the procedure of Example A-1, except for using 80 parts of butanol instead of 100 parts of tetrahydrofuran as the solvent in the coating composition for surface crosslinked layer.

Comparative Example A-10

An electrophotographic photoconductor was prepared by the procedure of Example A-7, except that a surface crosslinked layer 4 μm thick was formed by application of light at an intensity of 40 mW/cm$^2$ for 5 minutes using the same light source as in Example 1 to cure the coating composition.

Comparative Example A-11

An electrophotographic photoconductor was prepared by the procedure of Example A-8, except that except that a surface crosslinked layer 4 μm thick was formed by heating at 70° C. for 3 hours to cure the coating composition.

Comparative Example A-12

An electrophotographic photoconductor was prepared by the procedure of Example A-1, except that the surface crosslinked layer was not formed and the charge transporting layer had a thickness of 22 μm.

Comparative Example A-13

An electrophotographic photoconductor was prepared by the procedure of Example A-12, except that the surface crosslinked layer was not formed and the charge transporting layer had a thickness of 22 μm.

Each of the electrophotographic photoconductors according to Example A-1 through A-13 and Comparative Examples A-1 through A-13 was cut to a suitable size to yield a test sample. The displacement-load curve of the test sample was determined using a Dynamic Ultra Micro Hardness Tester DUH-201 (trade name, a product of Shimadzu Corp.) with a triangular pyramid indenter (115 degrees) in a cycle of application of the load, pose and removal of the load. The applied load was set so that the maximum displacement was one-tenths of the thickness of the surface crosslinked layer, the load was applied and removed at a rate of 0.0145 gf/sec with a pose at the maximum displacement of 5 seconds. The elastic displacement τe was determined by calculation according to the following equation from the measured maximum displacement and plastic displacement. The elastic displacement τe was defined as the average of measurements of arbitrary ten points of the test sample. The standard deviation of the elastic displacement was determined by calculation from the ten measurements of the elastic displacement. The results are shown in Table 3-1 and 3-2

Elastic Displacement $\tau e(\%)=[(\text{Maximum displacement})-(\text{Plastic displacement})]/(\text{Maximum displacement})\times 100$ The above dynamic ultra micro hardness measurement was performed at a temperature of 22° C. at relative humidity of 55%.

Separately, each of the electrophotographic photoconductors according Example A-1 through A-13 and Comparative Examples A-1 through A-13 was subjected to a printing test on 30,000 A4-sized sheets in the following manner. Initially, the tested electrophotographic photoconductor was attached to a process cartridge for electrophotographic apparatus, and the process cartridge was then attached to a modified machine of imagio Neo 270 (trade name, a product of Ricoh Company, Limited) using semiconductor laser at 655 nm as an imaging light source at an initial unexposed part potential of −700 V. Then, the print test was initiated. Images at the beginning of the test and every 5,000 sheets, potentials at the unexposed part and light exposed part at the beginning of the test and after 30,000 sheets copying, the reduction in the thickness after 30,000 sheets copying were determined. The results are shown in Table 3-1 and 3-2. For the photoconductors showing significant image inferiority from the beginning, the test was stopped.

TABLE 3-1

| | Elastic displacement τe (%) | Standard deviation of elastic displacement (%) | Image evaluation | | | | | | |
|---|---|---|---|---|---|---|---|---|---|
| | | | Initial | 5000 sheets | 10000 sheets | 15000 sheets | 20000 sheets | 25000 sheets | 30000 sheets |
| Example 1 | 42.0 | 0.85 | G | G | G | G | G | G | G |
| Example 2 | 40.7 | 1.48 | G | G | G | G | G | G | G |
| Example 3 | 48.3 | 0.97 | G | G | G | G | G | G | G |
| Example 4 | 46.2 | 1.06 | G | G | G | G | G | G | G |
| Example 5 | 44.4 | 0.80 | G | G | G | G | G | G | G |
| Example 6 | 37.5 | 0.78 | G | G | G | G | G | G | A |
| Example 7 | 46.1 | 0.72 | G | G | G | G | G | G | G |
| Example 8 | 36.8 | 1.92 | G | G | G | G | G | G | A, B |
| Example 9 | 38.0 | 1.85 | G | G | G | G | G | G | B |
| Example 10 | 35.7 | 1.69 | G | G | G | G | G | G | A |
| Example 11 | 53.3 | 0.92 | G | G | G | G | G | D | D |
| Example 12 | 44.8 | 0.76 | G | G | G | G | G | G | G |
| Example 13 | 40.5 | 1.68 | G | G | G | G | G | D | B, D |

TABLE 3-1-continued

| | Reduction of membrane thickness (μm) | Initial potential (−V) Unexposed part | Initial potential (−V) Exposed part | Potential after 30,000 sheets (−V) Unexposed part | Potential after 30,000 sheets (−V) Exposed part |
|---|---|---|---|---|---|
| Example 1 | 0.6 | 700 | 40 | 710 | 60 |
| Example 2 | 0.7 | 700 | 40 | 700 | 65 |
| Example 3 | 0.7 | 700 | 40 | 700 | 60 |
| Example 4 | 0.7 | 700 | 40 | 720 | 60 |
| Example 5 | 1.0 | 700 | 35 | 690 | 60 |
| Example 6 | 1.6 | 700 | 35 | 680 | 55 |
| Example 7 | 0.6 | 700 | 50 | 710 | 70 |
| Example 8 | 1.2 | 700 | 50 | 710 | 80 |
| Example 9 | 1.0 | 700 | 50 | 710 | 80 |
| Example 10 | 1.4 | 700 | 30 | 680 | 45 |
| Example 11 | 0.3 | 700 | 55 | 720 | 130 |
| Example 12 | 0.4 | 700 | 45 | 710 | 75 |
| Example 13 | 1.1 | 700 | 60 | 710 | 160 |

Image evaluation
G: good
A: Partial contamination of the ground surface
B: Partial contamination of striped pattern
C: Slight reduction of resolution
D: Slight reduction of image density
AA: Contamination of the ground surface all over the paper
BB: Contamination of striped patter all over the paper
CC: Significant reduction of resolution
DD: Signification reduction of image density

TABLE 3-2

| | Elastic displacement τe (%) | Standard deviation of elastic displacement (%) | Image evaluation Initial | 5000 sheets | 10000 sheets | 15000 sheets | 20000 sheets | 25000 sheets | 30000 sheets | Reduction of membrane thickness (μm) | Initial potential (−V) Unexposed part | Initial potential (−V) Exposed part | Potential after 30,000 sheets (−V) Unexposed part | Potential after 30,000 sheets (−V) Exposed part |
|---|---|---|---|---|---|---|---|---|---|---|---|---|---|---|
| Comp. Ex. 1 | 39.6 | 5.19 | G | B | B | BB | BB | BB, C | BB, C | 1.5-4.2 | 700 | 40 | 660 | 55 |
| Comp. Ex. 2 | 37.6 | 6.69 | G | B | B | BB | BB, C | BB, C | BB, C | 1.8-5.0 | 700 | 40 | 660 | 55 |
| Comp. Ex. 3 | 43.8 | 4.16 | B | B | B | BB | BB | BB | BB | 3.0 | 700 | 50 | 670 | 110 |
| Comp. Ex. 4 | 33.0 | 1.90 | G | G | G | A | A | AA | AA | 3.7 | 700 | 40 | 670 | 60 |
| Comp. Ex. 5 | 9.57 | 2.82 | A, BB | | | | | | | stopped | 700 | 60 | | |
| Comp. Ex. 6 | 62.7 | 0.77 | D | DD | DD, C | DD, C | DD, C | DD, C | DD, C | 0.2 | 700 | 160 | 740 | 280 |
| Comp. Ex. 7 | 37.3 | 5.43 | G | G | B | B | BB | BB, D | BB, D | 1.3-3.2 | 700 | 50 | 720 | 140 |
| Comp. Ex. 8 | 28.6 | 2.93 | G | G | G | A | A | AA | AA | 4.7 | 700 | 40 | 650 | 40 |
| Comp. Ex. 9 | 38.5 | 7.81 | BB, CC | | | | | | | stopped | 700 | 40 | | |
| Comp. Ex. 10 | 24.2 | 1.17 | G | A | A | A | AA, B | AA, B | AA, B | 6.3 | 700 | 50 | 640 | 40 |
| Comp. Ex. 11 | 26.5 | 1.35 | G | G | G | G | A | AA | AA | 5.0 | 700 | 60 | 650 | 45 |
| Comp. Ex. 12 | 27.7 | 0.70 | G | G | G | G | A | A | AA | 3.5 | 700 | 30 | 660 | 45 |
| Comp. Ex. 13 | 32.5 | 0.89 | G | G | G | G | G | A | A | 2.0 | 700 | 35 | 660 | 55 |

A: Partial contamination of the ground surface
B: Partial contamination of striped pattern
C: Slight reduction of resolution
D: Slight reduction of image density
AA: Contamination of the ground surface all over the paper
BB: Contamination of striped patter all over the paper
CC: Significant reduction of resolution
DD: Signification reduction of image density The electrophotographic photoconductors according to Comparative Examples A-1, A-2 and A-7 show large differences in thickness loss from measuring point to point. The electrophotographic photoconductor according to Comparative Example A-4 has an uncured surface layer.

The results in the printing test in Table 3-1 and 3-2 shows that the photoconductors of Example A-1 through A-13 according to the present invention having the surface crosslinked layer are highly resistant to abrasion, have good electric properties, and can produce satisfactory images over a long period of time. The photoconductors of Comparative Example A-1, A-2, A-8, A-9, A-10 and A-11 having an elastic displacement τe of the surface crosslinked layer less than 35% or its standard deviation exceeding 2% depending on their compositions and/or curing conditions show significant abrasion or wear entirely or locally and thus invite image defects initially or with the elapse of time. The photoconductors of Comparative Examples A-3 through A-7 containing radically polymerizable compositions out of the scope of the present invention have insufficient surface uniformity, abrasion resistance and/or electric properties and show low durability. The photoconductor of Comparative Example A-12 using a conventional thermoplastic binder resin in the charge transporting layer and the photoconductor of Comparative Example A-13 using a polymeric charge transporting material in the charge transporting layer have lower abrasion resistance and lower durability than the photoconductors of the present invention.

Comparative Example A-14

A photoconductor prepared by the procedure of Example A-1 was attached to a cyan photoconductor unit of IPSIO color 8000 (trade name, a product of Ricoh Company, Limited). A cyan image with an image occupancy of 10% was printed on 2,000 plies of A4-sized sheets fed in a transverse direction, and the surface of the photoconductor was observed and the image after 2,000 sheets printing was evaluated. As a result, no scratch and adhered matter was observed on the photoconductor surface, and the image after 2,000 sheets printing was satisfactory as the image at the beginning of the test.

Comparative Example A-14

A photoconductor prepared by the procedure of Comparative Example A-1 was subjected to a 2,000-sheets printing test by the procedure of Example A-14, and the surface of the photoconductor was observed and the image after 2,000 sheets printing was evaluated. As a result, a multitude of silica adhesion added as the toner external additive was observed on the photoconductor surface, and the halftone image after 2,000 sheets printing showed irregular density as compared with the image at the beginning of the test.

The photoconductor of Example A-14 having a surface crosslinked layer according to the present invention is free from adhesion of the toner external additive and can produce good images stably, in contrast to the photoconductor of Comparative Example A-14 having a surface crosslinked layer with an excessively large standard deviation of elastic displacement.

These results show that the photoconductors of the present invention can produce good images stably over a long period of time and have a long life and high performance by comprising an outermost layer of the photoconductive layer which is a cured crosslinked product of a coating composition containing a trifunctional or higher (tri- or more-functional) radically polymerizable monomer having no charge transporting structure and a monofunctional radically polymerizable compound having a charge transporting structure, and which surface crosslinked layer has an elastic displacement $\tau e$ of 35% or more with a standard deviation of 2% or less. They also show that the image forming process, image forming apparatus and process cartridge therefore using the photoconductors of the present invention show high performance and high reliability.

As is described in detail above, the electrophotographic photoconductors of the present invention comprise a surface crosslinked layer of the photoconductive layer as a cured product of a composition containing a trifunctional or higher radically polymerizable monomer having no charge transporting structure and a monofunctional radically polymerizable compound having a charge transporting structure. The surface crosslinked layer is highly elastic and is uniform as having an elastic displacement $\tau e$ of 35% or more with a standard deviation of 2% or less. Thus, the photoconductive layer has a surface free from local adhesion with the external additive or paper dust to thereby avoid image deterioration and is free from scratch due to carrier deposition and/or plastic deformation caused by accumulated heat energy derived from stress applied in a developing area or cleaning area. Thus, the photoconductors have further improved durability. Accordingly, the present invention can provide photoconductors having high durability and high performance, and by using the photoconductors, it can provide an image forming process, image forming apparatus and process cartridge therefor that can produce good images over a long period of time and have high performance and high reliability.

Example B

In the following examples, the thickness of the surface crosslinked layer was varied.

Example B-1

On a $\phi$30 mm aluminum cylinder, a coating solution for a under coating layer, a coating solution for a charge generation layer, a coating solution has a composition described below, were sequentially applied and dried to form a under coating layer of 3.5 μm, a charge generation layer of 0.2 μm and a charge transport layer of 18 μm. A coating composition for surface crosslinked layer having the following composition was applied to the charge transporting layer by spray coating, the applied film was air-dried for 20 minutes and was irradiated with light using a metal halide lamp at 160 W/cm, an irradiation distance of 120 mm, an irradiation intensity of 500 mW/cm$^2$ for 60 seconds to thereby cure the applied film. The cured film was dried at 130° C. for 20 minutes and thereby yielded a surface crosslinked layer 5.2 μm thick. Thus, an electrophotographic photoconductor according to the present invention was prepared.

[Coating solution for a under coating layer]

| | |
|---|---|
| Alkyde resin (Bekozole 1307-60-EL, DAINIPPON INK AND CHEMICALS, INCORPORATED) | 6 parts |
| Melamine resin (Super Bekamine G-821-60, DAINIPPON INK AND CHEMICALS, INCORPORATED) | 4 parts |
| Titanium oxide | 40 parts |
| Methyl ethyl ketone | 50 parts |

-continued

| [Coating solution for a charge generation layer] | |
|---|---|
| Bis-azo pigment having the following structural formula (I) | 2.5 parts |
| Polyvinyl butyral (XYHL, from UCC) | 0.5 parts |
| Cyclohexanone | 200 parts |
| Methyl ethyl ketone | 80 parts |

formula (I)

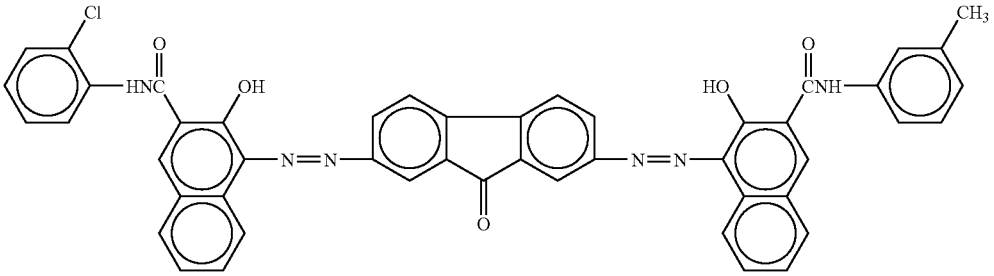

| [Coating solution for a charge transport layer] | |
|---|---|
| Bisphenol Z polycarbonate (Panlite TS-2050, Teijin Chemicals) | 10 part |
| Low molecular weight charge transport material (D-1) having the following structural formula (II) | 7 parts |
| Tetrahydrofuran | 100 parts |
| 1% tetrahydrofuran solution in silicone oil (KF50-100CS, Shin-Etsu Chemical Co., Ltd.) | 0.2 part |

formula (II)

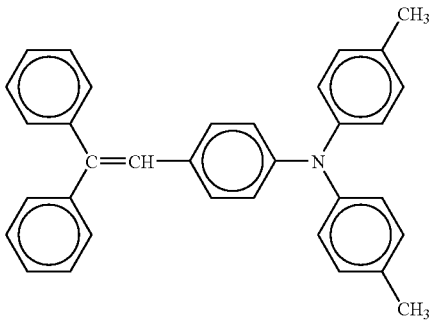

(D-1)

| [Coating solution for a surface crosslinked layer] | |
|---|---|
| Tri- or more-functional radical polymerizable monomer without having a charge transporting structure Trimethylolpropane triacrylate (KAYARAD TMPTA, Nippon Kayaku Co., Ltd.) Molecular weight: 296, number of functional group: 3 functionality, molecular weight/number of functional group = 99 | 10 parts |
| Mono-functional radical polymerizable compound having a charge transporting structure (Compound No. 54) | 10 parts |
| Photopolymerization initiator 1-hydroxy-cyclohexyl-phenyl-ketone (IRGACURE 184, Ciba Specialty Chemicals) | 1 part |
| Tetrahydrofuran | 100 parts |

Example B-2

An electrophotographic photoconductor was prepared by the procedure of Example B-1, except that the resulting surface crosslinked layer had a thickness of 1.2 μm.

Example B-3

An electrophotographic photoconductor was prepared by the procedure of Example B-1, except that the resulting surface crosslinked layer had a thickness of 7.8 μm.

Example B-4

An electrophotographic photoconductor was prepared by the procedure of Example B-1, except that the following monomer was used as the trifunctional or higher radically polymerizable monomer having no charge transporting structure and 10 parts of Compound No. 138 was used as the monofunctional radically polymerizable monomer having a charge transporting structure in the coating composition for surface crosslinked layer, and that the resulting surface crosslinked layer had a thickness of 5.4 μm.

| | |
|---|---|
| Tri- or more-functional radical polymerizable monomer without having a charge transporting structure Pentaerythritol tetraacrylate (SR-295, Sartomer Company Inc.) Molecular weight: 352, number of functional group: 4 functionality, molecular weight/number of functional group = 88 | 10 parts |

Example B-5

An electrophotographic photoconductor was prepared by the procedure of Example B-4, except that the resulting surface crosslinked layer had a thickness of 1.3 μm.

Example B-6

An electrophotographic photoconductor was prepared by the procedure of Example B-4, except that the resulting surface crosslinked layer had a thickness of 7.6 μm.

Example B-7

An electrophotographic photoconductor was prepared by the procedure of Example B-1, except that the following monomer was used as the trifunctional or higher radically polymerizable monomer having no charge transporting structure and 1 part of the following compound was used as the photopolymerization initiator in the coating composition for surface crosslinked layer, and that the resulting surface crosslinked layer had a thickness of 5.0 μm.

| | |
|---|---|
| Tri- or more-functional radical polymerizable monomer without having a charge transporting structure<br>Caprolactone-modified dipentaerythritol hexacrylate<br>(KAYARAD DPCA-60, Nippon Kayaku Co., Ltd.)<br>Molecular weight: 1263, number of functional group: 6<br>functionality, molecular weight/number of functional group = 211 | 10 parts |
| Photopolymerization initiator<br>2,2-dimethoxy-1,2-diphenylethan-1-one<br>(IRGACURE 651, Ciba Specialty Chemicals) | 1 part |

Example B-8

An electrophotographic photoconductor was prepared by the procedure of Example B-7, except that the resulting surface crosslinked layer had a thickness of 9.5 μm.

Example B-9

An electrophotographic photoconductor was prepared by the procedure of Example B-7, except that the resulting surface crosslinked layer had a thickness of 1.8 μm.

Example B-10

An electrophotographic photoconductor was prepared by the procedure of Example B-7, except that the resulting surface crosslinked layer had a thickness of 2.3 μm.

Example B-11

An electrophotographic photoconductor was prepared by the procedure of Example B-1, except that the following monomer was used as the trifunctional or higher radically polymerizable monomer having no charge transporting structure in the coating composition for surface crosslinked layer, and that the resulting surface crosslinked layer had a thickness of 5.8 μm.

| | |
|---|---|
| Tri- or more-functional radical polymerizable monomer without having a charge transporting structure<br>Caprolactone-modified dipentaerythritol hexacrylate<br>(KAYARAD DPCA-120, Nippon Kayaku Co., Ltd.)<br>Molecular weight: 1947, number of functional group: 6<br>functionality, molecular weight/number of functional group = 325 | 10 parts |

Example B-12

An electrophotographic photoconductor was prepared by the procedure of Example B-11, except that the resulting surface crosslinked layer had a thickness of 9.7 μm.

Example B-13

An electrophotographic photoconductor was prepared by the procedure of Example B-11, except that the resulting surface crosslinked layer had a thickness of 2.0 μm.

Example B-14

An electrophotographic photoconductor was prepared by the procedure of Example B-1, except for using a composition having the following formulation as the coating composition for surface crosslinked layer and that the resulting surface crosslinked layer had a thickness of 5.0 μm.

| | |
|---|---|
| Tri- or more-functional radical polymerizable monomer without having a charge transporting structure<br>Trimethylolpropane triacrylate<br>(KAYARAD TMPTA, Nippon Kayaku Co., Ltd.)<br>Molecular weight: 296, number of functional group: 3<br>functionality, molecular weight/number of functional group = 99 | 9 parts |
| Mono-functional radical polymerizable compound having a charge transporting structure<br>(Compound No. 54) | 10 parts |
| Photopolymerization initiator<br>1-hydroxy-cyclohexyl-phenyl-ketone (IRGACURE 184, Ciba Specialty Chemicals) | 1 part |
| Bisphenol Z polycarbonate<br>(Panlite TS-2050, Teijin Chemicals) | 1 part |
| Tetrahydrofuran | 100 parts |

Example B-15

An electrophotographic photoconductor was prepared by the procedure of Example B-1, except for using 9 parts of Monofunctional Compound No. 54 and 1 part of a bifunctional compound having the following structure as the radically polymerizable compound having a charge transporting structure in the coating composition for surface crosslinked layer and that the resulting surface crosslinked layer had a thickness of 5.2 μm.

| | |
|---|---|
| Mono-functional radical polymerizable compound having a charge transporting structure<br>(Compound No. 54) | 9 parts |
| Bifunctional radically polymerizable compound having a charge transporting structure | 1 part |

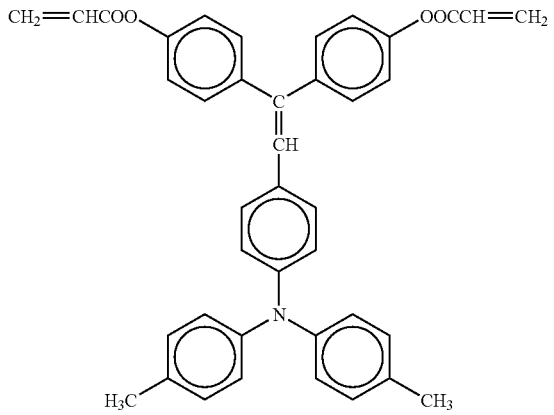

Example B-16

An electrophotographic photoconductor was prepared by the procedure of Example B-1, except for using 6 parts of the trifunctional or higher radically polymerizable monomer having no charge transporting structure and 14 parts of the monofunctional radically polymerizable compound having a charge transporting structure in the coating composition for surface crosslinked layer and that the resulting surface crosslinked layer had a thickness of 5.5 μm.

Example B-17

An electrophotographic photoconductor was prepared by the procedure of Example B-1, except for using 14 parts of the trifunctional or higher radically polymerizable monomer having no charge transporting structure and 6 parts of the monofunctional radically polymerizable compound having a charge transporting structure in the coating composition for surface crosslinked layer and that the resulting surface crosslinked layer had a thickness of 5.5 μm.

Example B-18

An electrophotographic photoconductor was prepared by the procedure of Example B-1, except for using 10 parts of Compound No. 144 as the monofunctional radically polymerizable compound having a charge transporting structure in the coating composition for surface crosslinked layer and that the resulting surface crosslinked layer had a thickness of 4.3 μm.

Example B-19

An electrophotographic photoconductor was prepared by the procedure of Example B-1, except for using the following thermal polymerization initiator instead of the photopolymerization initiator in the coating composition for surface crosslinked layer, and that a surface crosslinked layer 4.1 μm thick was formed by applying the coating composition to the charge transporting layer, air drying, heating at 70° C. for 30 minutes and then heating at 150° C. for 1 hour in a blast dryer.

| | |
|---|---|
| Thermal polymerization initiator<br>2,2-bis(4,4-di-t-butylperoxycyclohexyl)propane<br>(Perakdox 12-EB20, Kayaku Akzo Corporation) | 1 part |

Example B-20

An electrophotographic photoconductor was prepared by the procedure of Example B-19, except that the resulting surface crosslinked layer had a thickness of 2.0 μm.

Example B-21

A solution containing a high molecular charge transport material (PD-1) as described below in stead of the coating solution for charge transport layer of Example B-1 was applied on the same charge generation layer and dried to form a charge transport layer of 18 μm. A surface crosslinked layer 2.2 μm thick was formed on the charge transporting layer by the procedure of Example B-11. Thus, an electrophotographic photoconductor was prepared.

| [Coating solution for a charge transport layer] | |
|---|---|
| High molecular charge transport material (PD-1) of the following structural formula | 15 parts |

(PD-1)

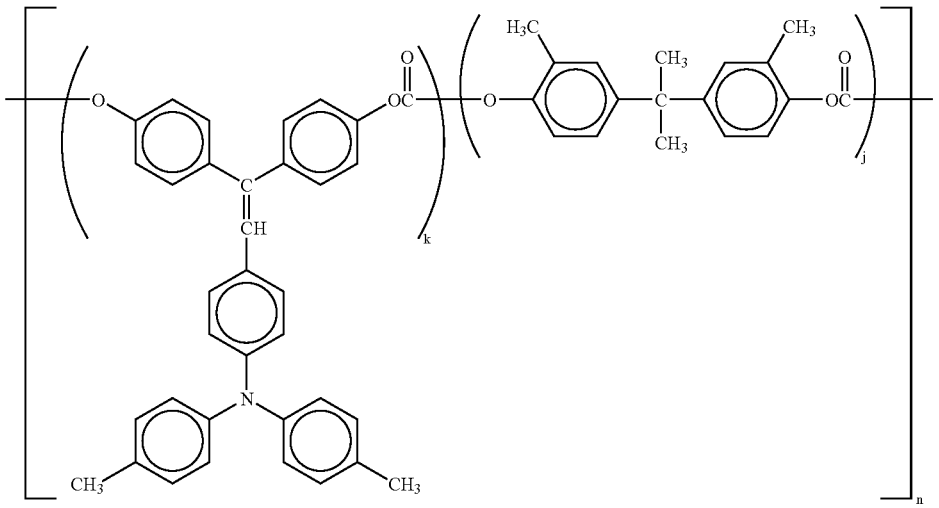

k = 042, j = 0.58 Mw = 160000 (polystyrene converstion)

| | |
|---|---|
| Tetrahydrofuran | 100 parts |
| 1% tetrahydrofuran solution in silicone oil<br>(KF50-100 CS, Shin-Etsu Chemical Co., Ltd.) | 0.3 parts |

Comparative Example B-1

An electrophotographic photoconductor was prepared by the procedure of Example B-1, except that 10 parts of a bifunctional radically polymerizable monomer having the following structural formula and having no charge transporting structure was used instead of the trifunctional or higher radically polymerizable monomer having no charge transporting structure in the coating composition for surface crosslinked layer, and that the resulting surface crosslinked layer had a thickness of 5.4 μm.

| | |
|---|---|
| Bi-functional radical polymerizable monomer without having a charge transporting structure<br>1,6-hexanediol diacrylate (Wako Pure Chemical Industries, Ltd.)<br>Molecular weight: 226, number of functional group: 2<br>functionality, molecular weight/number of functional group = 113 | 10 parts |

Comparative Example B-2

An electrophotographic photoconductor was prepared by the procedure of Example B-1, except that 10 parts of the bifunctional radically polymerizable monomer used in Example B-15 was used instead of the monofunctional radically polymerizable compound having a charge transporting structure in the coating composition for surface crosslinked layer, and that the resulting surface crosslinked layer had a thickness of 7.2 μm.

Comparative Example B-3

An electrophotographic photoconductor was prepared by the procedure of Example B-1, except that the trifunctional or higher radically polymerizable monomer having no charge transporting structure was not used and 20 parts of the monofunctional radically polymerizable compound having a charge transporting structure was used in the coating composition for surface crosslinked layer, and that the resulting surface crosslinked layer had a thickness of 4.2 μm.

Comparative Example B-4

An electrophotographic photoconductor was prepared by the procedure of Example B-1, except that the monofunctional radically polymerizable compound having a charge transporting structure was not used and 20 parts of the trifunctional or higher radically polymerizable monomer having no charge transporting structure was used in the coating composition for surface crosslinked layer, and that the resulting surface crosslinked layer had a thickness of 4.6 μm.

Comparative Example B-5

An electrophotographic photoconductor was prepared by the procedure of Example B-1, except that 10 parts of the low-molecular-weight charge transporting material (D-1) of Structural Formula (II) used in the coating composition for charge transporting layer was used instead of the monofunctional radically polymerizable compound having a charge transporting structure in the coating composition for surface crosslinked layer, and that the resulting surface crosslinked layer had a thickness of 5.2 μm Comparative Example B-6

An electrophotographic photoconductor was prepared by the procedure of Example B-1, except that the resulting surface crosslinked layer had a thickness of 0.8 μm.

Comparative Example B-7

An electrophotographic photoconductor was prepared by the procedure of Example B-1, except that the resulting surface crosslinked layer had a thickness of 10.5 μm.

Comparative Example B-8

An electrophotographic photoconductor was prepared by the procedure of Example B-4, except that the resulting surface crosslinked layer had a thickness of 0.7 μm.

Comparative Example B-9

An electrophotographic photoconductor was prepared by the procedure of Example B-4, except that the resulting surface crosslinked layer had a thickness of 10.3 μm.

Comparative Example B-10

An electrophotographic photoconductor was prepared by the procedure of Example B-7, except that the resulting surface crosslinked layer had a thickness of 0.8 μm.

Comparative Example B-11

An electrophotographic photoconductor was prepared by the procedure of Example B-11, except that the resulting surface crosslinked layer had a thickness of 0.9 μm.

Comparative Example B-12

An electrophotographic photoconductor was prepared by the procedure of Example B-19, except that the resulting surface crosslinked layer had a thickness of 0.8 μm.

Comparative Example B-13

An electrophotographic photoconductor was prepared by the procedure of Example B-1, except for forming a surface crosslinked layer 18.0 μm thick instead of the charge transporting layer, by applying the coating composition for surface crosslinked layer having the following composition to the charge generation layer and curing the applied film.

| [Coating solution for a surface crosslinked layer] | |
|---|---|
| Tri- or more-functional radical polymerizable monomer without having a charge transporting structure<br>Pentaerythritol tetraacrylate<br>(SR-295, Sartomer Company Inc.)<br>Molecular weight: 352, number of functional group: 4<br>functionality, molecular weight/number of functional group = 88 | 8 parts |
| Tri- or more-functional radical polymerizable monomer without having a charge transporting structure<br>Caprolactone-modified dipentaerythritol hexacrylate<br>(KAYARAD DPCA-60, Nippon Kayaku Co., Ltd.) | 2 parts |
| Mono-functional radical polymerizable compound having a charge transporting structure<br>(Compound No. 54) | 10 parts |
| Photopolymerization initiator | 1 part |

-continued

| [Coating solution for a surface crosslinked layer] | |
|---|---|
| 1-hydroxy-cyclohexyl-phenyl-ketone (IRGACURE 184, Ciba Specialty Chemicals) | |
| Tetrahydrofuran | 100 parts |

Comparative Example B-14

An electrophotographic photoconductor was prepared by the procedure of Example B-1, except for forming a surface crosslinked layer 15.0 μm thick instead of the charge transporting layer, by applying the coating composition for surface crosslinked layer having the following composition to the charge generation layer and curing the applied film.

| [Coating solution for a surface crosslinked layer] | |
|---|---|
| Tri- or more-functional radical polymerizable monomer without having a charge transporting structure Trimethylolpropane triacrylate (KAYARAD TMPTA, Nippon Kayaku Co., Ltd.) Molecular weight: 296, number of functional group: 3 functionality, molecular weight/number of functional group = 99 | 8 parts |
| Tri- or more-functional radical polymerizable monomer without having a charge transporting structure Caprolactone-modified dipentaerythritol hexacrylate (KAYARAD DPCA-60, Nippon Kayaku Co., Ltd.) | 6 parts |

-continued

| [Coating solution for a surface crosslinked layer] | |
|---|---|
| Mono-functional radical polymerizable compound having a charge transporting structure (Compound No. 54) | 10 parts |
| Photopolymerization initiator 1-hydroxy-cyclohexyl-phenyl-ketone (IRGACURE 184, Ciba Specialty Chemicals) | 1 part |
| Tetrahydrofuran | 100 parts |

Comparative Example B-15

An electrophotographic photoconductor was prepared by the procedure of Example B-1, except that the surface crosslinked layer was not formed and that the charge transporting layer had a thickness of 22 μm.

The appearance of each of the electrophotographic photoconductors according to Examples B-1 through B-21 and Comparative Examples B-1 through B-15 was visually observed to determine whether or not cracking and/or flaking off occurred. Next, the solubility in organic solvents of the electrophotographic photoconductors was determined by adding one drop of tetrahydrofuran (hereinafter referred to as THF) and dichloromethane (hereinafter referred to as MDC) to a sample electrophotographic photoconductor, air-drying, and observing the surface dimensions. The results are shown in Table 4.

TABLE 4

| No. | Crosslinked surface layer thickness (μm) | Appearance | Solubility THF | Solubility MDC |
|---|---|---|---|---|
| Example B-1 | 5.2 | good | insoluble | insoluble |
| Example B-2 | 1.2 | good | insoluble | insoluble |
| Example B-3 | 7.8 | good | insoluble | insoluble |
| Example B-4 | 5.4 | good | insoluble | insoluble |
| Example B-5 | 1.3 | good | insoluble | insoluble |
| Example B-6 | 7.6 | good | insoluble | insoluble |
| Example B-7 | 5.0 | good | insoluble | insoluble |
| Example B-8 | 9.5 | good | insoluble | insoluble |
| Example B-9 | 1.8 | good | insoluble | insoluble |
| Example B-10 | 2.3 | good | insoluble | insoluble |
| Example B-11 | 5.8 | good | insoluble | insoluble |
| Example B-12 | 9.7 | good | insoluble | insoluble |
| Example B-13 | 2.0 | good | slightly soluble | slightly soluble |
| Example B-14 | 5.0 | good | slightly soluble | slightly soluble |
| Example B-15 | 5.2 | good | insoluble | insoluble |
| Example B-16 | 5.5 | good | insoluble | insoluble |
| Example B-17 | 5.5 | good | insoluble | insoluble |
| Example 18 | 4.3 | good | slightly soluble | slightly soluble |
| Example 19 | 4.1 | good | insoluble | insoluble |
| Example 20 | 2.0 | good | insoluble | insoluble |
| Example 21 | 2.2 | good | insoluble | insoluble |
| Comp. Ex. B-1 | 5.4 | good | slightly soluble | slightly soluble |
| Comp. Ex. B-2 | 7.2 | cracking | insoluble | insoluble |
| Comp. Ex. B-3 | 4.2 | insufficiently cured and stickly | soluble | soluble |
| Comp. Ex. B-4 | 4.6 | good | insoluble | insoluble |
| Comp. Ex. B-5 | 5.2 | clouding induced by precipitated charge transporting material | soluble | soluble |
| Comp. Ex. B-6 | 0.8 | good | insoluble | insoluble |
| Comp. Ex. B-7 | 10.5 | cracking | insoluble | insoluble |
| Comp. Ex. B-8 | 0.7 | good | insoluble | insoluble |

TABLE 4-continued

| No. | Crosslinked surface layer thickness (μm) | Appearance | Solubility THF | Solubility MDC |
|---|---|---|---|---|
| Comp. Ex. B-9 | 10.3 | flaking off | insoluble | insoluble |
| Comp. Ex. B-10 | 0.8 | good | soluble | soluble |
| Comp. Ex. B-11 | 0.9 | good | soluble | soluble |
| Comp. Ex. B-12 | 0.8 | good | slightly soluble | slightly soluble |
| Comp. Ex. B-13 | 18.0 | flaking off | insoluble | insoluble |
| Comp. Ex. B-14 | 15.0 | good | insoluble | insoluble |
| Comp. Ex. B-15 | | good | soluble | soluble |

Table 4 shows that the electrophotographic photoconductors of the present invention having a surface crosslinked layer 1 to 10 μm thick according to Examples B-1 through B-12 have good appearance without cracking and flaking off. The photoconductor according to Comparative Example B-2 using a bifunctional radically polymerizable compound having a charge transporting layer in the surface crosslinked layer and those according to Comparative Example B-7, B-9 and B-13 having a surface crosslinked layer with a thickness exceeding 10 μm invite cracking or flaking off in the formation of the surface crosslinked layer. The photoconductors according to Examples B-1 through B-21 are insoluble or slightly soluble in organic solvents, indicating that the surface crosslinked layer has crosslinks with high density. The photoconductors having a surface crosslinked layer with a thickness of 2 μm or more show further excellent insolubility in organic solvents. In contrast, the photoconductors according to Comparative Examples B-3, B-5, B-10 and B-11 are soluble in organic solvents because the charge transporting material is exposed to the surface of the surface crosslinked layer due to the components in the surface crosslinked layer (Comparative Examples B-3 and B-5) or an excessively small thickness of the surface crosslinked layer (Comparative Examples B-10 and B-11).

Next, photoconductors were prepared according to Example B-1 through B-21 and Comparative Examples B-1 through B-15 and were subjected to a printing test on 50,000 sheets of A4-sized paper, except for the photoconductors of Comparative Examples B-2, B-7, B-9 and B-13 showing cracking or flaking off and for the photoconductor of Comparative Example B-3 having an uncured surface crosslinked layer. Initially, the tested electrophotographic photoconductor was attached to a process cartridge for electrophotographic apparatus, and the process cartridge was then attached to a modified machine of imagio Neo 270 (trade name, a product of Ricoh Company, Limited) using semiconductor laser at 655 nm as an imaging light source at an initial unexposed part potential of −700 V. Then, the print test was initiated. Potentials at the unexposed part and light exposed part at the beginning of the test and after 50,000 sheets copying were determined. In addition, the total thickness of the photoconductor was measured at the beginning of the test and after 50,000 sheets copying, and the abrasion loss was determined by calculation from the difference between the measurements. The results are shown in Table 5-1 and 5-2.

TABLE 5-1

| No. | Initial thickness of surface crosslinked layer (μm) | Initial potential (−V) Unexposed part | Initial potential (−V) Exposed part | Potential after 50000 sheets copying (−V) Unexposed part | Potential after 50000 sheets copying (−V) Exposed part | Initial image | Image after 50000 sheets copying | Abrasion loss (μm) |
|---|---|---|---|---|---|---|---|---|
| Example B-1 | 5.2 | 700 | 45 | 710 | 70 | good | good | 0.9 |
| Example B-2 | 1.2 | 700 | 40 | 690 | 55 | good | good | 1.1 |
| Example B-3 | 7.8 | 700 | 50 | 720 | 90 | good | good | 0.9 |
| Example B-4 | 5.4 | 700 | 55 | 700 | 80 | good | good | 0.8 |
| Example B-5 | 1.3 | 700 | 45 | 680 | 55 | good | good | 1.1 |
| Example B-6 | 7.6 | 700 | 65 | 710 | 100 | good | good | 0.8 |
| Example B-7 | 5.0 | 700 | 40 | 710 | 65 | good | good | 1.5 |
| Example B-8 | 9.5 | 700 | 65 | 720 | 90 | good | good | 1.5 |
| Example B-9 | 1.8 | 700 | 40 | 690 | 50 | good | slightly uneven density in halftone image | 1.7-2.2 |
| Example B-10 | 2.3 | 700 | 40 | 680 | 55 | good | good | 1.8 |
| Example B-11 | 5.8 | 700 | 45 | 700 | 70 | good | good | 2.2 |
| Example B-12 | 9.7 | 700 | 50 | 710 | 95 | good | good | 2.2 |
| Example B-13 | 2.0 | 700 | 40 | 670 | 45 | good | slightly uneven density in halftone image | 2.0-2.6 |
| Example B-14 | 5.0 | 700 | 40 | 680 | 80 | good | good | 2.5 |
| Example B-15 | 5.2 | 700 | 40 | 680 | 75 | good | good | 1.8 |
| Example B-16 | 5.5 | 700 | 35 | 660 | 50 | good | good | 2.8 |
| Example B-17 | 5.5 | 700 | 70 | 720 | 145 | good | slightly low image density | 0.5 |
| Example B-18 | 4.3 | 700 | 65 | 710 | 110 | good | good | 2.8 |
| Example B-19 | 4.1 | 700 | 65 | 720 | 105 | good | good | 1.5 |

TABLE 5-1-continued

| No. | Initial thickness of surface crosslinked layer (μm) | Initial potential (−V) Unexposed part | Initial potential (−V) Exposed part | Potential after 50000 sheets copying (−V) Unexposed part | Potential after 50000 sheets copying (−V) Exposed part | Initial image | Image after 50000 sheets copying | Abrasion loss (μm) |
|---|---|---|---|---|---|---|---|---|
| Example B-20 | 2.0 | 700 | 55 | 700 | 85 | good | slightly uneven density in halftone image | 1.5-2.5 |
| Example B-21 | 2.2 | 700 | 55 | 720 | 70 | good | good | 1.8 |

TABLE 5-2

| No. | Initial thickness of surface crosslinked layer (μm) | Initial potential (−V) Unexposed part | Initial potential (−V) Exposed part | Potential after 50,000 sheets (−V) Unexposed part | Potential after 50,000 sheets (−V) Exposed part | Initial image | Image after 50,000 sheets | Abrasion loss (μm) |
|---|---|---|---|---|---|---|---|---|
| Comp. Ex. 1 | 5.4 | 700 | 50 | 680 | 50 | Good | background toner deposition | 5.8 |
| Comp. Ex. 4 | 4.6 | 700 | 180 | 750 | 330 | low image density | very low image density | 0.4 |
| Comp. Ex. 5 | 5.2 | 700 | 55 | 720 | 160 | background toner deposition | overall background toner deposition and streaks with low image density | 2.5-4.7 |
| Comp. Ex. 6 | 0.8 | 700 | 40 | 670 | 55 | Good | uneven density in halftone image and streaks | 0.8-3.6 |
| Comp. Ex. 8 | 0.7 | 700 | 50 | 690 | 55 | Good | uneven density in halftone image, background toner deposition and streaks | 1.2-3.2 |
| Comp. Ex. 10 | 0.8 | 700 | 40 | 690 | 55 | Good | uneven density in halftone image, background toner deposition and streaks | 2.0-4.0 |
| Comp. Ex. 11 | 0.9 | 700 | 40 | 690 | 50 | Good | uneven density in halftone image, background toner deposition and streaks | 3.5-4.5 |
| Comp. Ex. 12 | 0.8 | 700 | | 670 | 55 | Good | uneven density in halftone image, background toner deposition and streaks | 2.5-3.8 |
| Comp. Ex. 14 | 15.0 | 700 | 60 | | | Good | flaking-off occurred after 5000 sheets copying and the test was discontinued | |
| Comp. Ex. 15 | | 700 | 35 | 660 | 55 | Good | overall background toner deposition | 5.9 |

Tables 6-1 and 6-2 show that the photoconductors having a specific surface crosslinked layer of Example B-1 through B-21 according to the present invention are highly resistant to abrasion and have good electric properties and can produce good images over a long period of time. Among them, those having a surface crosslinked layer with a thickness of 2 μm or more have a further longer life and can produce good images over a further longer period of time. In contrast, the photoconductors of Comparative Examples B-1 and B-5 using a bifunctional monomer or a low-molecular-weight charge transporting material having no functional group in the surface crosslinked layer show low abrasion resistance and significantly deteriorated image due to low crosslinking density or uneven curing of the surface crosslinked layer. The photoconductors of Comparative Example B-6 through B-12 having a surface crosslinked layer with a thickness less than 1 μm are unevenly abraded and invite uneven density in halftone image or streaky background deposition of toner due to cleaning failure. The photoconductor of Comparative Example B-14 having a surface crosslinked layer instead of a charge transporting layer invites flaking off after 5000 sheets copying due to its large internal stress. The photoconductor of Comparative Example B-15 having no surface crosslinked layer and comprising a charge transporting layer using a conventional thermoplastic binder resin shows inferior abrasion resistance and durability to the photoconductors of the present invention.

These results show that the photoconductors of the present invention have high abrasion resistance and scratch resistance without cracking and flaking off by comprising, as a surface crosslinked layer of the photoconductive layer, a cured crosslinked product of a coating composition containing a trifunctional or higher radically polymerizable monomer having no charge transporting structure and a monofunctional radically polymerizable compound having a charge transporting structure, and setting the thickness of the surface crosslinked layer from 1 μm to 10 μm. They also show that the image forming process, image forming apparatus and process cartridge therefor using the photoconductors of the present invention show high performance and high reliability.

As is thus described in detail above, the present invention can provide photoconductors having high abrasion resistance and scratch resistance, showing good electric properties and having high durability and high performance by comprising, as a surface crosslinked layer of the photoconductive layer, a cured crosslinked product of a coating composition containing a trifunctional or higher (tri- or more-functional) radically polymerizable monomer having no charge transporting structure and a monofunctional radically polymerizable compound having a charge transporting structure, and setting the thickness of the surface crosslinked layer from 1 μm to 10 μm. The present invention can also provide an image forming process, image forming apparatus and process cartridge therefor that can produce good images over a long period of time and have high performance and reliability using the photoconductors.

What is claimed is:

1. An electrophotographic photoconductor, comprising:

an electroconductive substrate; and a photoconductive layer on or above the electroconductive substrate, the photoconductive layer comprising:

a cross-linked surface layer which comprises:

a cured tri- or more-functional radical polymerizable monomer without having a charge transporting structure; and a cured mono-functional radical polymerizable compound having a charge transporting structure, wherein the cross-linked surface layer has an elastic displacement rate τe of 35% or more and a standard deviation of the elastic displacement rate τe of 2% or less; and the cured tri- or more-functional radical polymerizable monomer without having a charge transporting structure has a functional group selected from the group consisting of an acryloyloxy group and a methacryloyloxy group.

2. An electrophotographic photoconductor according to claim 1, wherein the cured tri- or more-functional radical polymerizable monomer without having a charge transporting structure has a ratio (molecular weight/number of functional group) of molecular weight to the number of functional group of 250 or less.

3. An electrophotographic photoconductor according to claim 1, wherein the cured mono-functional radical polymerizable compound having a charge transporting structure has a functional group selected from the group consisting of an acryloyloxy group and a methacryloyloxy group.

4. An electrophotographic photoconductor according to claim 1, wherein the charge transporting structure of the cured mono-functional radical polymerizable compound having a charge transporting structure is a triarylamine structure.

5. An electrophotographic photoconductor according to claim 1, wherein the cured mono-functional radical polymerizable compound having a charge transporting structure is represented by one of the formulae (1) and (2):

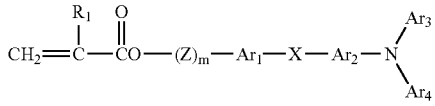

(1)

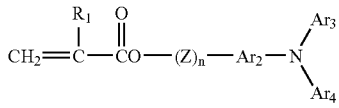

(2)

wherein, $R_1$ represents a hydrogen atom, a halogen atom, an alkyl group which may be substituted, an aralkyl group which may be substituted, an aryl group which may be substituted, a cyano group, a nitro group, an alkoxy group, —$COOR_7$ ($R_7$ represents a hydrogen atom, an alkyl group which may be substituted, an aralkyl group which may be substituted or an aryl group which may be substituted), a halogenated carbonyl group or $CONR_8R_9$ ($R_8$ and $R_9$ represent a hydrogen atom, a halogen atom, an alkyl group which may be substituted, an aralkyl group which may be substituted or an aryl group which may be substituted, which may be identical or different);

$Ar_1$ and $Ar_2$ represent a substituted or unsubstituted arylene group, which may be identical or different;

$Ar_3$ and $Ar_4$ represent a substituted or unsubstituted aryl group, which may be identical or different;

X represents a single bond, a substituted or unsubstituted alkylene group, a substituted or unsubstituted cycloalkylene group, a substituted or unsubstituted alkylene ether group, a oxygen atom, a sulfur atom or a vinylene group;

Z represents a substituted or unsubstituted alkylene group, a substituted or unsubstituted alkylene ether group or an alkyleneoxycarbonyl group; and "m" and "n" represent an integer of 0 to 3.

6. An electrophotographic photoconductor according to claim 1, wherein the cured mono-functional radical polymerizable compound having a charge transporting structure is represented by the following formula (3):

(3)

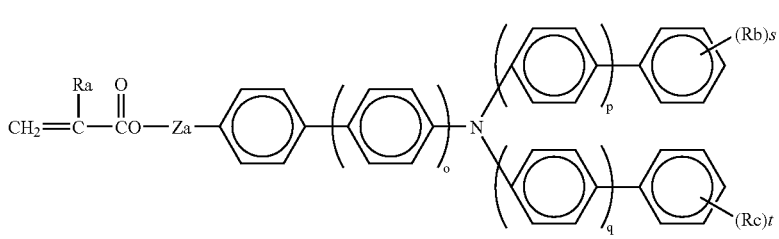

wherein, "o," "p" and "q" each represent an integer of 0 or 1;

Ra represents a hydrogen atom or a methyl group;

Rb and Rc represent an alkyl group having 1 to 6 carbon atoms, wherein each of Rb and Rc may be different when there are two or more Rb and Rc, respectively;

"s" and "t" represent an integer of 0 to 3; and

Za represents a single bond, a methylene group, an ethylene group,

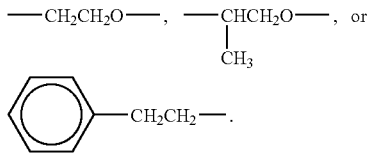

7. An electrophotographic photoconductor according to claim 1, wherein the cured tri- or more-functional radical polymerizable monomer without having a charge transporting structure is 30% to 70% by weight, based on the total amount of the cross-linked surface layer.

8. An electrophotographic photoconductor according to claim 1, wherein the cured mono-functional radical polymerizable compound having a charge transporting structure is 30% to 70% by weight, based on the total amount of the cross-linked surface layer.

9. An electrophotographic photoconductor according to claim 1, wherein the photoconductive layer comprises:

a charge generation layer;

a charge transport layer; and the cross-linked surface layer laminated on or above the electroconductive substrate in this order.

10. An electrophotographic photoconductor according to claim 9, wherein the charge transport layer comprises a polymer charge transport material.

11. An electrophotographic photoconductor according to claim 10, wherein the polymer charge transport material is a polycarbonate having a triarylamine structure in the main chain or side chain thereof.

12. An electrophotographic photoconductor according to claim 1, wherein the cross-linked surface layer is cured by one of heating and light irradiation.

13. An electrophotographic photoconductor according to claim 9, wherein the cross-linked surface layer has a thickness of from 1 μm to 10 μm.

14. An electrophotographic photoconductor according to claim 9, wherein the thickness is from 2 μm to 8 μm.

15. An electrophotographic photoconductor according to claim 9, wherein the cross-linked surface layer is insoluble in an organic solvent.

16. An electrophotographic photoconductor, comprising:

an electroconductive substrate;

a charge generation layer;

a charge transport layer; and a cross-linked surface layer, the layers sequentially laminated on the electroconductive substrate, wherein the cross-linked surface layer comprises:

a cross-linked and cured tri- or more-functional radical polymerizable monomer without having a charge transporting structure; and a cross-linked and cured mono-functional radical polymerizable compound having a charge transporting structure, wherein the cross-linked surface layer has thickness of from 1 μm to 10 μm; and the cross-linked and cured tri- or more-functional radical polymerizable monomer without having a charge transporting structure has a functional group selected from the group consisting of an acryloyloxy group and a methacryloyloxy group.

17. An electrophotographic photoconductor according to claim 16, wherein the thickness is from 2 μm to 8 μm.

18. An electrophotographic photoconductor according to claim 16, wherein the cross-linked surface layer is insoluble in an organic solvent.

19. An electrophotographic photoconductor according to claim 16, wherein the cross-linked and cured tri- or more-functional radical polymerizable monomer without having a charge transporting structure has a ratio (molecular weight/number of functional group) of molecular weight to the number of functional group of 250 or less.

20. An electrophotographic photoconductor according to claim 16, wherein the cross-linked and cured mono-functional radical polymerizable compound having a charge transporting structure has a functional group selected from the group consisting of an acryloyloxy group and a methacryloyloxy group.

21. An electrophotographic photoconductor according to claim 16, wherein the charge transporting structure of the cross-linked and cured mono-functional radical polymerizable compound having a charge transporting structure is a triarylamine structure.

22. An electrophotographic photoconductor according to claim 16, wherein the cross-linked and cured mono-functional radical polymerizable compound having a charge transporting structure is represented by one of the formulae (1) and (2):

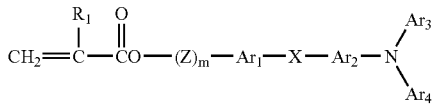

(1)

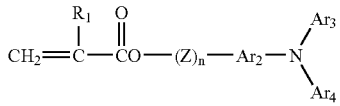

(2)

wherein, $R_1$ represents a hydrogen atom, a halogen atom, an alkyl group which may be substituted, an aralkyl group which may be substituted, an aryl group which may be substituted, a cyano group, a nitro group, an alkoxy group, —$COOR_7$ ($R_7$ represents a hydrogen atom, an alkyl group which may be substituted, an aralkyl group which may be substituted or an aryl group which may be substituted), a halogenated carbonyl group or $CONR_8R_9$ ($R_8$ and $R_9$ represent a hydrogen atom, a halogen atom, an alkyl group which may be substituted, an aralkyl group which may be substituted or an aryl group which may be substituted, which may be identical or different);

$Ar_1$ and $Ar_2$ represent a substituted or unsubstituted arylene group, which may be identical or different;

$Ar_3$ and $Ar_4$ represent a substituted or unsubstituted aryl group, which may be identical or different;

X represents a single bond, a substituted or unsubstituted alkylene group, a substituted or unsubstituted cycloalkylene group, a substituted or unsubstituted alkylene ether group, a oxygen atom, a sulfur atom or a vinylene group;

Z represents a substituted or unsubstituted alkylene group, a substituted or unsubstituted alkylene ether group or an alkyleneoxycarbonyl group; and "m" and "n" represent an integer of 0 to 3.

23. An electrophotographic photoconductor according to claim 16, wherein the cross-linked and cured mono-functional radical polymerizable compound having a charge transporting structure is represented by the following formula (3):

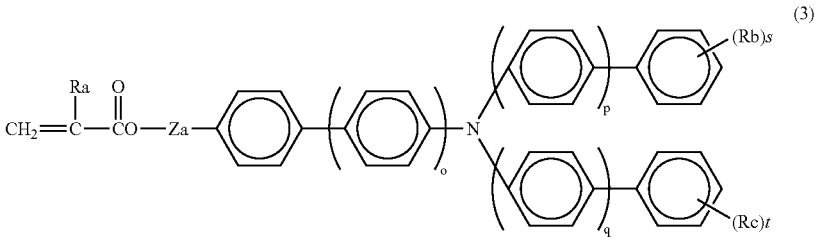

(3)

wherein, "o," "p" and "q" each represent an integer of 0 or 1;

Ra represents a hydrogen atom, a methyl group;

Rb and Rc represent an alkyl group having 1 to 6 carbon atoms, wherein each of Rb and Rc may be different when there are two or more Rb and Rc, respectively;

"s" and "t" represent an integer of 0 to 3; and

Za represents a single bond, a methylene group, an ethylene group,

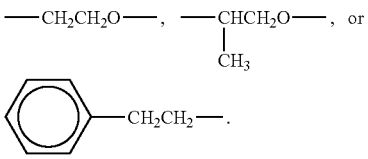

24. An electrophotographic photoconductor according to claim 16, wherein the cross-linked and cured tri- or more-functional radical polymerizable monomer without having a charge transporting structure is 30% to 70% by weight, based on the total amount of the cross-linked surface layer.

25. An electrophotographic photoconductor according to claim 16, wherein the cross-linked and cured mono-functional radical polymerizable compound having a charge transporting structure is 30% to 70% by weight, based on the total amount of the cross-linked surface layer.

26. An electrophotographic photoconductor according to claim 16, wherein the charge transport layer comprises a polymer charge transport material.

27. An electrophotographic photoconductor according to claim 26, wherein the polymer charge transport material is a polycarbonate having a triarylamine structure in the main chain or side chain thereof.

28. An electrophotographic photoconductor according to claim 16, wherein the cross-linked surface layer is cured by one of heating and light irradiation.

29. An electrophotographic photoconductor according to claim 16, wherein the cross-linked surface layer has an elastic displacement rate τe of 35% or more and a standard deviation of the elastic displacement rate τe of 2% or less.

30. A process for forming an image, comprising:

charging an electrophotographic photoconductor;

exposing the electrophotographic photoconductor which is charged to a recording light so as to form an electrostatic latent image;

developing the electrostatic latent image by a developing agent so as to visualize the electrostatic latent image and form a toner image; and transferring the toner image formed by developing onto a transfer material, wherein the electrophotographic photoconductor comprises:

an electroconductive substrate; and a photoconductive layer on or above the electroconductive substrate, the photoconductive layer comprising:

a cross-linked surface layer which comprises:

a cured tri- or more-functional radical polymerizable monomer without having a charge transporting structure; and a cured mono-functional radical polymerizable compound having a charge transporting structure, wherein the cross-linked surface layer has an elastic displacement rate τe of 35% or more and a standard deviation of the elastic displacement rate τe of 2% or less; and the cured tri- or more-functional radical polymerizable monomer without having a charge transporting structure has a functional group selected from the group consisting of an acryloyloxy group and a methacryloyloxy group.

31. A process for forming an image, comprising:

charging an electrophotographic photoconductor;

exposing the electrophotographic photoconductor which is charged to a recording light so as to form an electrostatic latent image;

developing the electrostatic latent image by a developing agent so as to visualize the electrostatic latent image and form a toner image; and transferring the toner image formed by developing onto a transfer material, wherein the electrophotographic photoconductor comprises:

an electroconductive substrate;

a charge generation layer;

a charge transport layer; and a cross-linked surface layer, the layers sequentially laminated on the electroconductive substrate, wherein the cross-linked surface layer comprises:

a cross-linked and cured tri- or more-functional radical polymerizable monomer without having a charge transporting structure; and a cross-linked and cured mono-functional radical polymerizable compound having a charge transporting structure, wherein the cross-linked surface layer has thickness of from 1 μm to 10 μm; and the cross-linked and cured tri- or more-functional radical polymerizable monomer without having a charge transporting structure has a functional group selected from the group consisting of an acryloyloxy group and a methacryloyloxy group.

32. An apparatus for forming an image, comprising:

an electrophotographic photoconductor;

a charger to charge the electrophotographic photoconductor;

an exposer to expose the electrophotographic photoconductor charged by the charger to a recording light to form an electrostatic latent image;

a developing unit to supply a developing agent to the electrostatic latent image to visualize the electrostatic latent image and form a toner image; and a transferring unit to transfer the toner image formed by the developing unit on a transfer material, wherein the electrophotographic photoconductor comprises:

an electroconductive substrate; and a photoconductive layer on or above the electroconductive substrate, the photoconductive layer comprising:

a cross-linked surface layer which comprises:

a cured tri- or more-functional radical polymerizable monomer without having a charge transporting structure; and a cured mono-functional radical polymerizable compound having a charge transporting structure, wherein the cross-linked surface layer has an elastic displacement rate τe of 35% or more and a standard deviation of the elastic displacement rate τe of 2% or less; and the cured tri- or more-functional radical polymerizable monomer without having a charge transporting structure has a functional group selected from the group consisting of an acryloyloxy group and a methacryloyloxy group.

33. An apparatus for forming an image, comprising:

an electrophotographic photoconductor;

a charger to charge the electrophotographic photoconductor;

an exposer to expose the electrophotographic photoconductor charged by the charger to a recording light to form an electrostatic latent image;

a developing unit to supply a developing agent to the electrostatic latent image to visualize the electrostatic latent image and form a toner image; and a transferring unit to transfer the toner image formed by the developing unit on a transfer material, wherein the electrophotographic photoconductor comprises:

an electroconductive substrate;

a charge generation layer;

a charge transport layer; and a cross-linked surface layer, the layers sequentially laminated on the electroconductive substrate, wherein the cross-linked surface layer comprises:

a cross-linked and cured tri- or more-functional radical polymerizable monomer without having a charge transporting structure; and a cross-linked and cured mono-functional radical polymerizable compound having a charge transporting structure, wherein the cross-linked surface layer has thickness of from 1 μm to 10 μm; and the cross-linked and cured tri- or more-functional radical polymerizable monomer without having a charge transporting structure has a functional group selected from the group consisting of an acryloyloxy group and a methacryloyloxy group.

34. A process cartridge for an image forming apparatus, comprising:

an electrophotographic photoconductor; and at least one selected from the group consisting of:

a charger to charge the electrophotographic photoconductor;

a developing unit to supply a developing agent to an electrostatic latent image formed by exposure on the electrophotographic photoconductor to visualize the electrostatic latent image and form a toner image;

a transferring unit to transfer the toner image formed by the developing unit on a transfer material;

a cleaning unit to remove toner remaining on the electrophotographic photoconductor after transferring; and a discharging unit to remove the latent image on the photoconductor after transferring so as to form a monolithic structure, wherein the process cartridge is adapted to be attached to and detached from a main body of the image forming apparatus, and the electrophotographic photoconductor comprises:

an electroconductive substrate; and a photoconductive layer on or above the electroconductive substrate, the photoconductive layer comprising:

a cross-linked surface layer which comprises:

a cured tri- or more-functional radical polymerizable monomer without having a charge transporting structure; and a cured mono-functional radical polymerizable compound having a charge transporting structure, wherein the cross-linked surface layer has an elastic displacement rate τe of 35% or more and a standard deviation of the elastic displacement rate τe of 2% or less; and the cured tri- or more-functional radical polymerizable monomer without having a charge transporting structure has a functional group selected from the group consisting of an acryloyloxy group and a methacryloyloxy group.

35. A process cartridge for an image forming apparatus, comprising:

an electrophotographic photoconductor; and at least one selected from the group consisting of:

a charger to charge the electrophotographic photoconductor;

a developing unit to supply a developing agent to an electrostatic latent image formed by exposure on the electrophotographic photoconductor to visualize the electrostatic latent image and form a toner image;

a transferring unit to transfer the toner image formed by the developing unit on a transfer material;

a cleaning unit to remove toner remaining on the electrophotographic photoconductor after transferring; and a discharging unit to remove the latent image on the photoconductor after transferring so as to form a monolithic structure, wherein the process cartridge is adapted to be attached to and detached from a main body of the image forming apparatus, and the electrophotographic photoconductor comprises:

an electroconductive substrate;

a charge generation layer;

a charge transport layer; and a cross-linked surface layer, the layers sequentially laminated on the electroconductive substrate, wherein the cross-linked surface layer comprises:

a cross-linked and cured tri- or more-functional radical polymerizable monomer without having a charge transporting structure; and a cross-linked and cured mono-functional radical polymerizable compound having a charge transporting structure, wherein the cross-linked surface layer has thickness of from 1 μm to 10 μm; and the cross-linked and cured tri- or more-functional radical polymerizable monomer without having a charge transporting structure has a functional group selected from the group consisting of an acryloyloxy group and a methacryloyloxy group.

* * * * *